US010010735B2

(12) United States Patent
Kwo

(10) Patent No.: US 10,010,735 B2
(45) Date of Patent: Jul. 3, 2018

(54) MODULAR PORTABLE BALLET BAR EXERCISE DEVICE

(71) Applicant: Fluidity Enterprises, Inc., Jacksonville, FL (US)

(72) Inventor: Jennie Kwo, Cambridge, MA (US)

(73) Assignee: Fluidity Enterprises, Inc., Jacksonville, FL (US)

( * ) Notice: Subject to any disclaimer, the term of this patent is extended or adjusted under 35 U.S.C. 154(b) by 0 days.

(21) Appl. No.: 14/542,061

(22) Filed: Nov. 14, 2014

(65) Prior Publication Data

US 2016/0136472 A1 May 19, 2016

(51) Int. Cl.

| | |
|---|---|
| ***A63B 1/00*** | (2006.01) |
| ***A63B 71/02*** | (2006.01) |
| *A63B 21/02* | (2006.01) |
| *A63B 21/00* | (2006.01) |

(52) U.S. Cl.

CPC ..... *A63B 1/00* (2013.01); *A63B 71/023* (2013.01); *A63B 21/02* (2013.01); *A63B 21/4037* (2015.10); *A63B 2071/025* (2013.01); *A63B 2210/50* (2013.01); *A63B 2225/093* (2013.01); *A63B 2244/22* (2013.01)

(58) Field of Classification Search

CPC ... A63B 1/00; A63B 2210/50; A63B 23/1218; A63B 2225/093; A63B 21/4035; A63B 21/00047; A63B 21/0552; A63B 2208/12; A63B 21/0442; A63B 2208/0204; A63B 23/12; A63B 21/068; A63B 23/1227; A63B 21/1636; A63B 71/023; A63B 9/00

USPC ..... 482/38

See application file for complete search history.

(56) References Cited

U.S. PATENT DOCUMENTS

| | | | | |
|---|---|---|---|---|
| 860,517 | A * | 7/1907 | Berglund | A63B 3/00 482/41 |
| 2,932,510 | A | 4/1960 | Kravitz | |
| 3,800,338 | A | 4/1974 | Smith | |
| 3,803,012 | A | 4/1974 | Kurr | |
| 3,944,219 | A | 3/1976 | LoPresti | |
| 4,008,892 | A | 2/1977 | Nissen | |
| 4,111,414 | A | 9/1978 | Roberts | |
| 4,126,307 | A | 11/1978 | Stevenson | |
| 4,696,470 | A | 9/1987 | Fenner | |
| 4,815,732 | A | 3/1989 | Mahvi | |
| 4,905,990 | A | 3/1990 | Desantis | |
| 5,046,722 | A | 9/1991 | Antoon | |
| 5,080,352 | A | 1/1992 | Freed | |
| 5,277,676 | A | 1/1994 | Holland et al. | |
| 5,306,217 | A | 4/1994 | Bracone | |
| 5,389,055 | A | 2/1995 | Gangloff | |

(Continued)

FOREIGN PATENT DOCUMENTS

| | | |
|---|---|---|
| CN | 201969236 | 9/2011 |
| GB | 2 354 435 A | 3/2001 |

(Continued)

*Primary Examiner* — Andrew S Lo

(74) *Attorney, Agent, or Firm* — DLA Piper LLP (US)

(57) ABSTRACT

Multiple embodiments of a portable ballet bar exercise device are disclosed. In certain embodiments, the portable ballet bar exercise device is modular in nature such that it can be used as a single stand-alone unit or a single wall-mountable unit, or can be combined with an identical unit to form a double stand-alone unit or a double wall-mountable unit.

21 Claims, 52 Drawing Sheets

(56) References Cited

U.S. PATENT DOCUMENTS

| | | | | |
|---|---|---|---|---|
| 5,405,306 | A | 4/1995 | Goldsmith et al. | |
| 5,501,647 | A | 3/1996 | Snyder | |
| D372,059 | S | 7/1996 | Taylor | |
| 5,662,556 | A * | 9/1997 | Gangloff | A63B 1/005 482/17 |
| 5,697,875 | A | 12/1997 | Stan | |
| 5,776,037 | A | 7/1998 | Millington | |
| D410,050 | S | 5/1999 | Matte | |
| 6,248,047 | B1 | 6/2001 | Abdo | |
| 6,336,414 | B1 | 1/2002 | Stewart et al. | |
| 6,402,670 | B1 * | 6/2002 | Anagnostou | A63B 21/0004 482/148 |
| 6,415,723 | B1 | 7/2002 | Kopish et al. | |
| 6,652,419 | B1 | 11/2003 | Rota | |
| 6,699,162 | B2 | 3/2004 | Chen | |
| 6,743,152 | B2 | 6/2004 | Weiss | |
| 7,275,273 | B2 | 10/2007 | Lary et al. | |
| 7,494,454 | B2 | 2/2009 | Sheets | |
| 7,608,029 | B2 | 10/2009 | Weiss et al. | |
| 7,699,756 | B2 * | 4/2010 | Piane, Jr. | A63B 1/00 248/222.52 |
| D633,962 | S | 3/2011 | Stacey | |
| 7,896,786 | B1 * | 3/2011 | Osbourne | A63B 21/0552 482/122 |
| 8,834,327 | B1 * | 9/2014 | George, Jr. | A63B 23/1218 482/141 |
| 2006/0035750 | A1 * | 2/2006 | Weiss | A63B 1/00 482/34 |
| 2006/0122044 | A1 | 6/2006 | Ho | |
| 2009/0098987 | A1 | 4/2009 | McBride et al. | |
| 2009/0111657 | A1 | 4/2009 | Snow | |
| 2010/0190612 | A1 | 7/2010 | Cook | |
| 2012/0077655 | A1 | 3/2012 | Wilson | |
| 2012/0202661 | A1 | 8/2012 | Jordan | |
| 2013/0035217 | A1 | 2/2013 | Beck et al. | |
| 2013/0225372 | A1 * | 8/2013 | Rochford | A63B 1/00 482/38 |
| 2013/0237394 | A1 | 9/2013 | Fowler | |
| 2013/0331232 | A1 | 12/2013 | Kwo | |
| 2013/0345026 | A1 | 12/2013 | Eberflus et al. | |
| 2015/0290488 | A1 * | 10/2015 | Hopperstad | A63B 21/078 482/38 |

FOREIGN PATENT DOCUMENTS

| | | |
|---|---|---|
| JP | 55070157 | 5/1980 |
| TW | M268074 | 6/2005 |
| TW | M281657 | 12/2005 |
| TW | I271210 | 1/2007 |
| TW | M425695 | 4/2012 |
| WO | WO 2005/034605 | 4/2005 |
| WO | 2014 013011 A1 | 1/2014 |

* cited by examiner

MODULAR PORTABLE BALLET BAR EXERCISE DEVICE

TECHNICAL FIELD

Multiple embodiments of a modular portable ballet bar exercise device are disclosed.

BACKGROUND OF THE INVENTION

Fixed ballet bars are standard equipment in dance studios and exercise facilities. Ballet bars are used by dancers and persons exercising to keep their balance while engaging in stretching, dancing, cardio-vascular, weight-strengthening, and other exercise activities.

Traditional free-standing ballet bars in the prior art were relatively heavy and cumbersome to transport and use. In addition, they often were difficult to store because they could not be easily collapsed into a compact configuration.

The assignee of this application is an innovator in free-standing ballet bar exercise devices and previously obtained U.S. Pat. Nos. 6,743,152 and 7,608,029, both of which are incorporated by reference herein. The inventions of those patents greatly improved upon the prior art, but nevertheless still contained limitations.

What is needed is an improved portable ballet bar exercise device that is adjustable in height, easier to assemble, collapse, transport, and store than the prior art devices. What is further needed is a portable ballet bar with an improved structural design. What is further needed is a portable ballet bar with fewer components, to simplify the manufacturing and assembly process. What is further needed is a portable ballet bar that is modular in nature such that it can be used as a single stand-alone unit or a single wall-mountable unit, or can be combined with an identical unit to form a double stand-alone unit or a double wall-mountable unit.

SUMMARY OF THE INVENTION

Multiple embodiments of a portable ballet bar exercise device are disclosed.

DETAILED DESCRIPTION OF THE PREFERRED EMBODIMENTS

Figure 1:
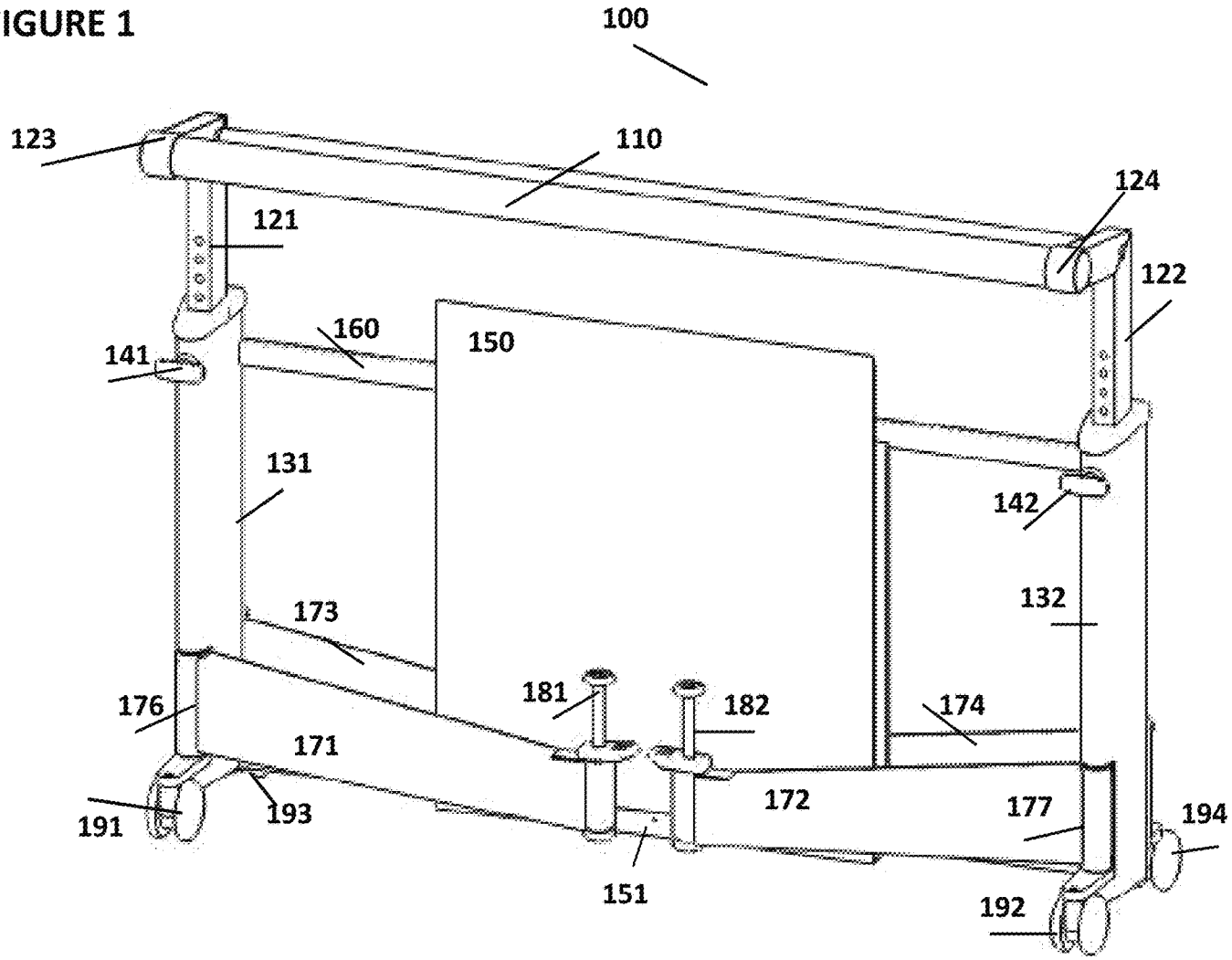
FIG. 1 depicts a front view of an embodiment of a single unit portable exercise bar device with legs and floorboard folded inward.

STAND-ALONE SINGLE UNIT PORTABLE EXERCISE BAR. FIG. 1 depicts a front view of an embodiment of a portable exercise bar 100. Portable exercise bar 100 is a single unit. Portable exercise bar 100 comprises horizontal bar 110, neck 121, neck 122, vertical column 131, vertical column 132, knob 141, knob 142, floorboard 150, hinge 151, crossbar 160, leg 171, leg 172, leg 173, leg 174, shaft 176, shaft 177, shaft 178 (not shown), shaft 179 (not shown), foot mechanism 181, foot mechanism 182, wheel 191, wheel 192, wheel 193, and wheel 194.

Horizontal bar 110 optionally is a ballet bar. Horizontal bar 110 is secured in place by neck 121 and neck 122. Neck 121 comprises clamping mechanism 123, and neck 122 comprises clamping mechanism 124. Clamping mechanism 123 and clamping mechanism 124 are secured to horizontal bar 110 such that horizontal bar 110 does not move within clamping mechanism 123 and clamping mechanism 124.

Figure 24:
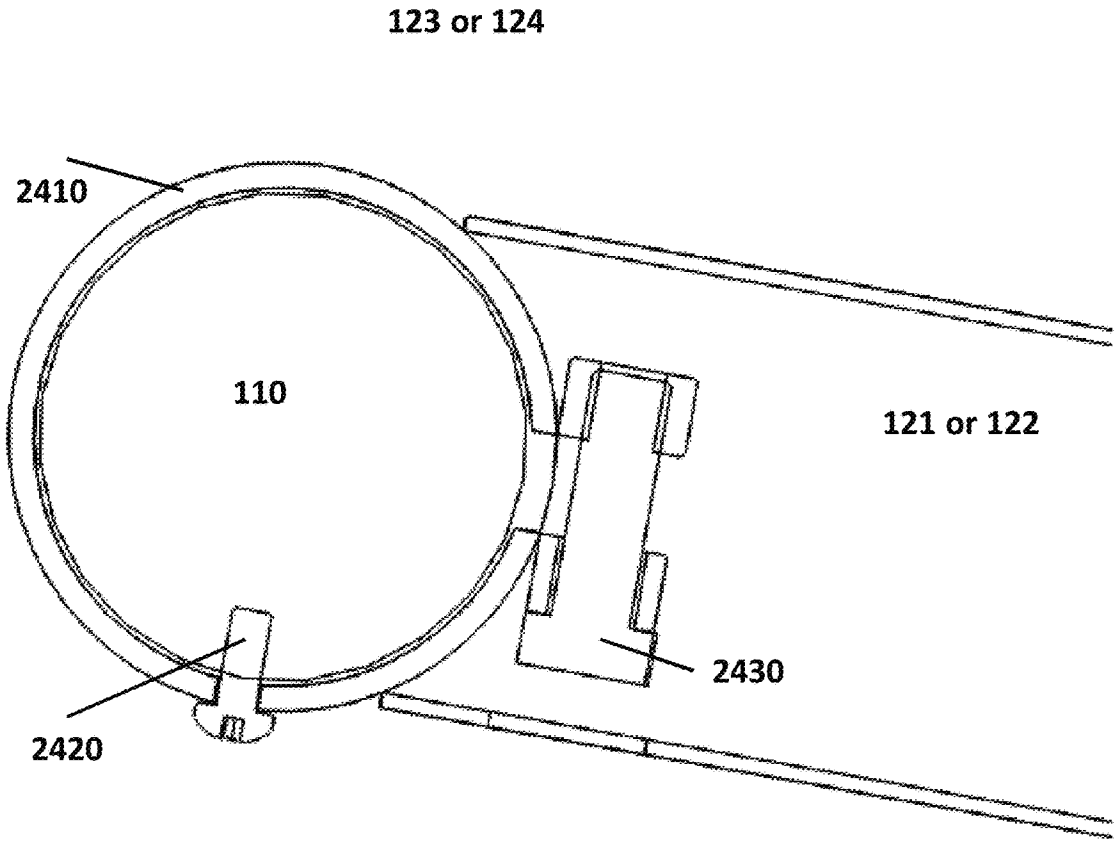
FIG. 24 depicts a clamping mechanism for holding a horizontal bar in a portable exercise bar device.

Further detail regarding clamping mechanism 123 and clamping mechanism 124 is shown in FIG. 24. Clamping mechanism 123 and 124 each comprise band 2410, screw 2420, and bolt 2430. Band 2410 wraps around horizontal bar 110 and is tightened with bolt 2430. Bolt 2430 optionally can be a hex bolt. Screw 2420 is inserted through band 2410 into horizontal bar 110.

With reference to FIG. 1, neck 121 can slide within vertical column 131 when knob 141 is pulled outward from vertical column 131, and neck 121 is held in place within vertical column 131 by knob 141 when knob 141 is not pulled outward. Neck 122 can slide within vertical column 132 when knob 142 is pulled outward from vertical column 132, and neck 122 is held in place within vertical column 132 by knob 142 when knob 142 is not pulled outward. Knob 141 and knob 142 optionally are spring-loaded. In this exemplary embodiment, knob 141 and knob 142 are T-shaped, which is a shape that is easy for the human hand to grasp and pull. Other shapes are possible, such as a circular shape. In one embodiment, neck 121 and neck 122 can be held in place by knob 141 and knob 142, respectively, in a maximum vertical position such that horizontal bar 110 is located at least 28.00 inches from the floor.

Crossbar 160 is coupled to vertical column 131 and vertical column 132.

Figure 4:
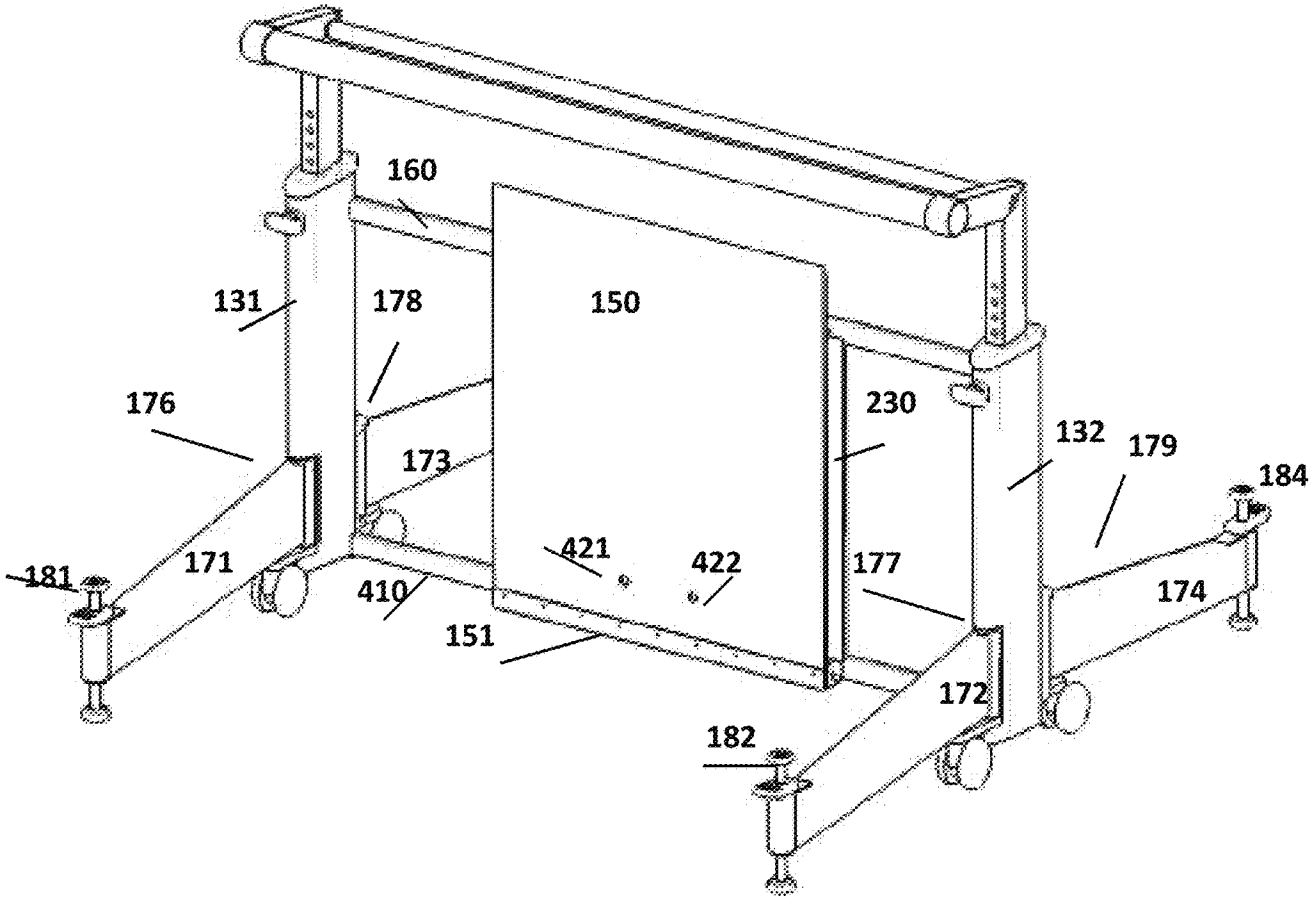
FIG. 4 depicts a front view of an embodiment of a single unit portable exercise bar device with legs extended outward and floorboard folded inward.

Floorboard 150 is coupled to hinge 151, which also is coupled to crossbar 410 (shown in FIG. 4). Optionally, hinge 151 is designed such that when floorboard 150 is folded in, hinge 151 is raised off the floor to provide clearance when portable exercise bar 100 is transported. When floorboard 150 is extended to the floor, hinge 151 extends to the floor such that floorboard 150 is placed in contact with the floor. For example, hinge 151 can be spring loaded so that floorboard 150 is placed in contact with the floor when a user stands on floorboard 150.

Leg 171 and leg 173 are coupled to vertical column 131 by shaft 176 and shaft 178, respectively. Leg 172 and leg 174 are coupled to vertical column 132 by shaft 177 and 179 (shown in FIG. 2 but not FIG. 1), respectively. Shafts 176, 177, 178, and 179 optionally are embedded within the legs as shown. Leg 171 can rotate about shaft 176 between a folded position (shown in FIGS. 1-3) and an extended position (shown in FIGS. 4-9). Optionally, vertical columns 131 and 132 each comprise a cut-out portion for receiving shafts 176, 177, 178, and 179. The cut-out prevents legs 171, 172, 173, and 174 from extending beyond the position where the leg is parallel with floorboard 150 in the unfolded position (i.e., it prevents over-extension of the legs), which is a feature that enhances user safety. Leg 172 can rotate about shaft 177, leg 173 can rotate about shaft 178, and leg 174 can rotate about shaft 179 in the same manner described for leg 171 and shaft 176. In the alternative, shafts 176, 177, 178, and 179 each can be attached to a bracket, which in turn is attached to vertical columns 131 and 132, and the brackets can prevent legs 171, 172, 173, and 174 from extending beyond the position where the leg is parallel with floorboard 150 in the unfolded position, in accordance with the design shown in FIG. 67.

In one embodiment, the distance between the bottom of vertical column 131 and the floor is at least 1.80 inches and the distance between the bottom of vertical column 132 and the floor is at least 1.80 inches.

Figure 14:
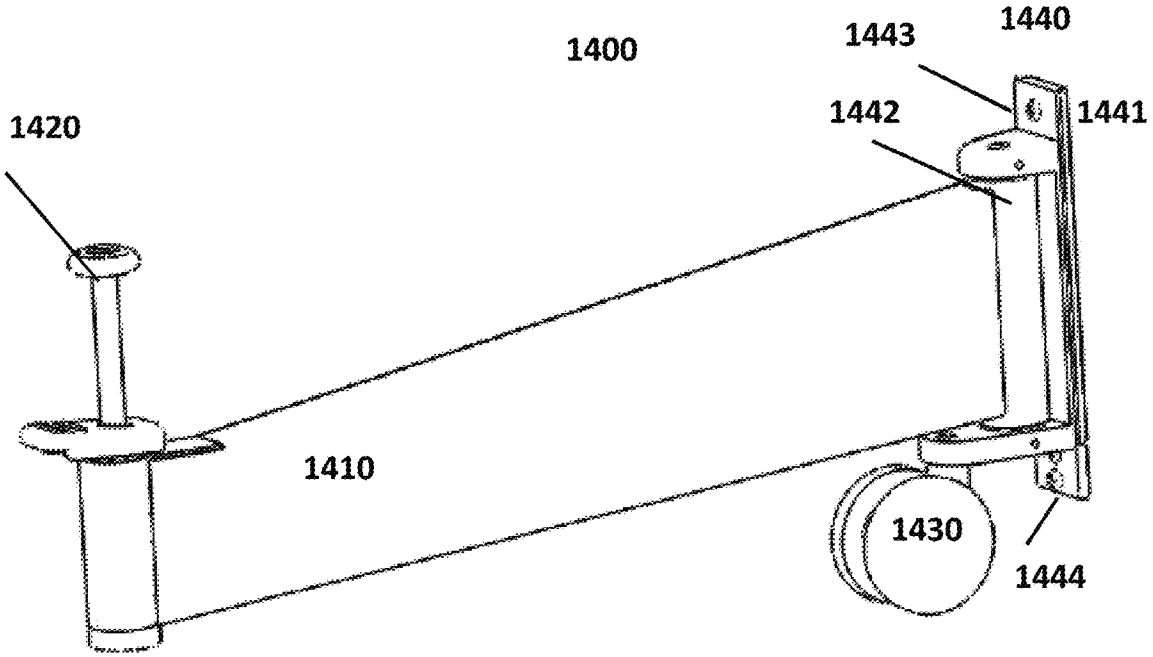
FIG. 14 depicts an embodiment of a leg assembly.

Various designs for shafts 176, 177, 178, and 179 are possible. For example, each of shafts 176, 177, 178, and 179 can comprise a hollow cylinder fixed to each of legs 171, 172, 173, and 174, respectively, with each cylinder enclosing another cylinder (or pin) fixed to vertical columns 131 (for shafts 176 and 178) and 132 (for shafts 177 and 179). In another example, each of shafts 176, 177, 178, and 179 can comprise a cylinder fixed to each of legs 171, 172, 173, and 174, respectively, with spring-loaded members extending from the top and bottom of each cylinder received by a recess in vertical columns 131 and 132. One embodiment of a leg and shaft design is shown in FIG. 14 and described below.

Wheels 191 ad 193 are connected to a horizontal bracket that is connected to vertical column 131, and wheels 192 and 194 are connected to a horizontal bracket that is connected to vertical column 132.

Foot mechanism 181 is coupled to leg 171, foot mechanism 182 is coupled to leg 172, foot mechanism 183 (not shown) is coupled to leg 173, and foot mechanism 184 (not shown) is coupled to leg 174. Foot mechanism 181, 182, 183, and 184 each comprise a knob and a lever, and the user can lock each foot mechanism by pushing the knob and release the lock by pushing the lever.

Figure 2:
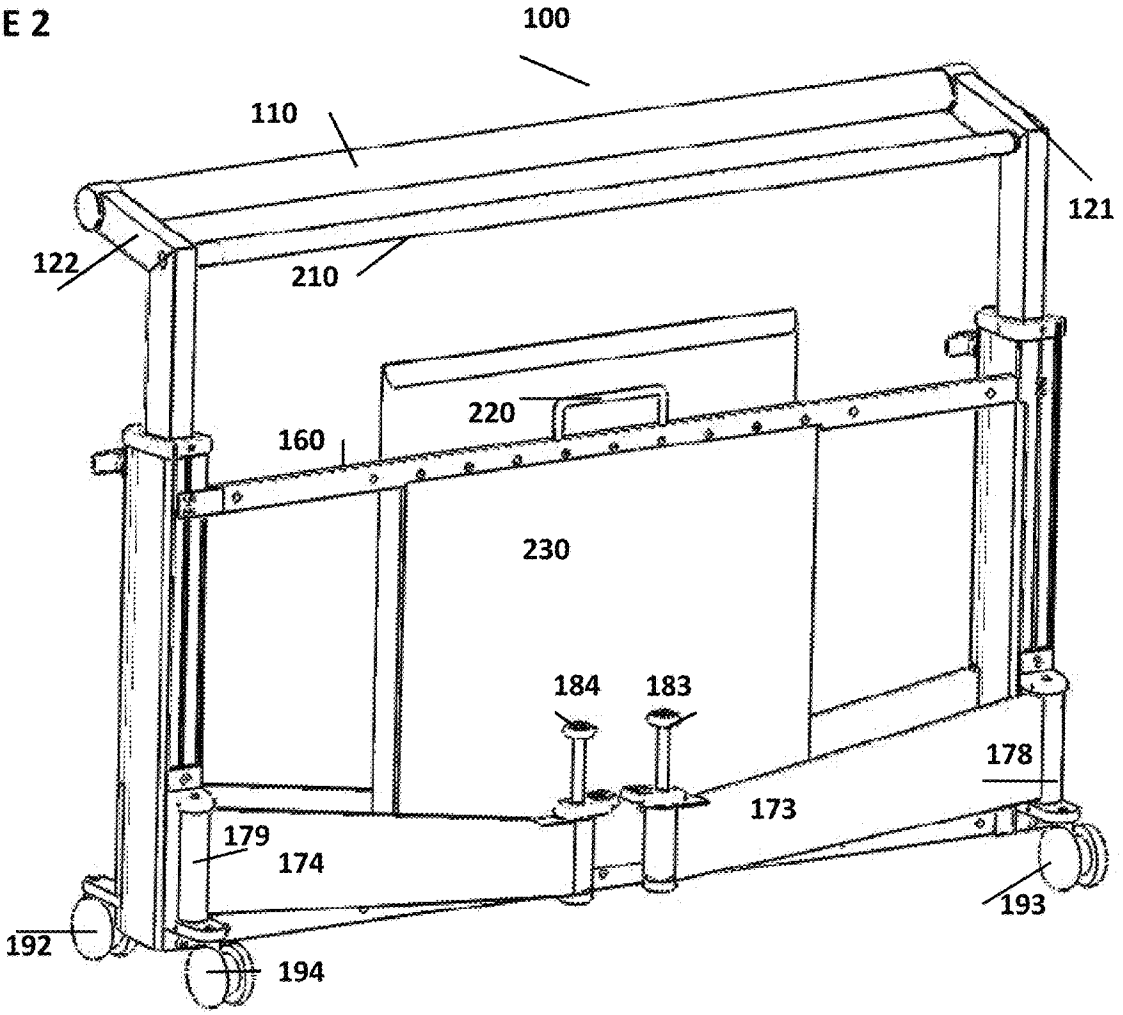
FIG. 2 depicts a back view of an embodiment of a single unit portable exercise bar device with legs and floorboard folded inward.

FIG. 2 depicts a rear view of the embodiment of a portable exercise bar 100. Portable exercise bar 100 further comprises horizontal bar 210, handle 220, backboard 230, leg 173, leg 174, shaft 178, shaft 179, foot mechanism 183, and foot mechanism 184.

Horizontal bar 210 is substantially parallel to horizontal bar 110 and is coupled to neck 121 and neck 122. Horizontal bar 210 provides additional stability for portable exercise bar 100.

Handle 220 is coupled to crossbar 160 and can be used for carrying or rolling portable exercise bar 100. It also can be used to hold floorboard 150 and mat 610 in the folded position. For example, a latch or velcro strap (not shown) can be used to connect floorboard 150 to handle 220 when floorboard 150 is folded inward.

Figure 3:
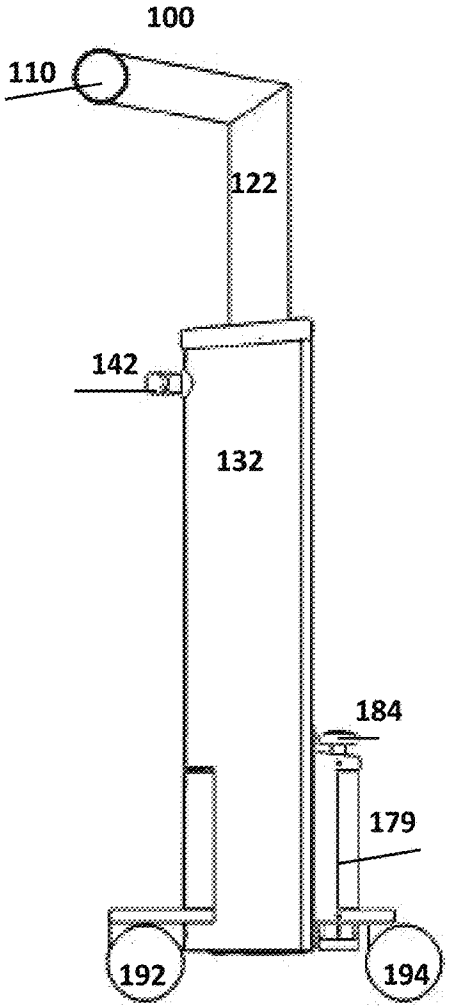
FIG. 3 depicts a side view of an embodiment of a single unit portable exercise bar device with legs and floorboard folded inward.

FIG. 3 depicts a side view of the embodiment of a portable exercise bar 100.

FIG. 4 depicts another front view of portable exercise bar 100. In this view, legs 171, 172, 173, and 174 have been extended outward. Backboard 230 is coupled to crossbar 160 and crossbar 410. Crossbar 410 is coupled to vertical column 131 and vertical column 132.

Floorboard 150 comprises magnet 421 and magnet 422. In the folded position (as in FIG. 1), magnet 421 will hold leg 171 against floorboard 150 through magnetic force, and magnet 422 will hold leg 172 against floorboard 150 through magnetic force.

Figure 5:
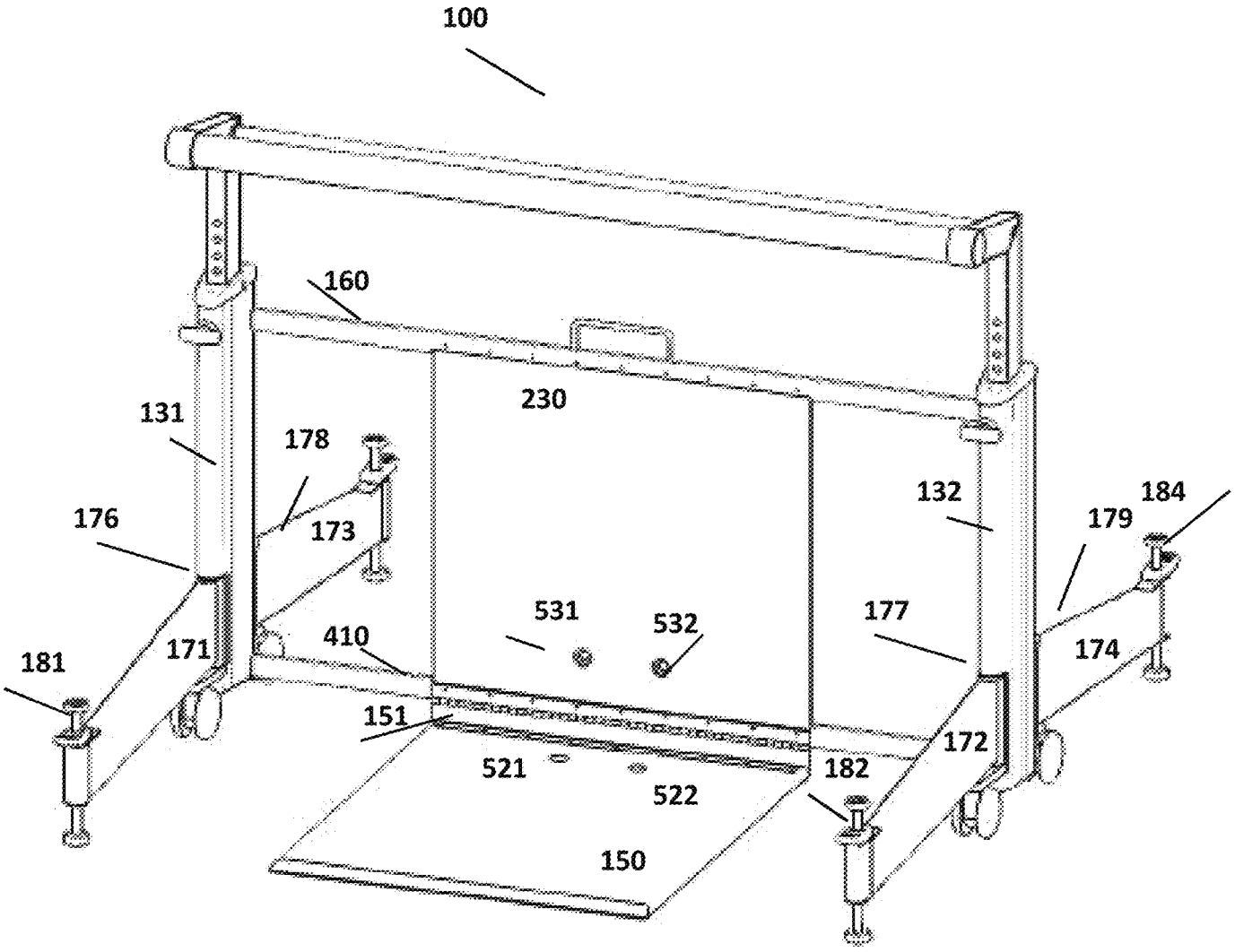
FIG. 5 depicts a front view of an embodiment of a single unit portable exercise bar device with legs and floorboard extended outward.

FIG. 5 depicts the same view as FIG. 4, except floorboard 150 now has been unfolded to the ground. Floorboard 150 comprises bore 521 and bore 522. Magnet 421 is placed into bore 521, and magnet 422 is placed into bore 522. The diameters of bore 521 and bore 522 preferably are smaller on the side of floorboard 150 facing outward (i.e., the side of floorboard 150 shown in FIG. 4), such that magnets 421 and 422 are retained within floorboard 150 by the floorboard 150 itself, and the diameters of bore 521 and 522 are larger on the side of floorboard 150 facing backboard 230 to increase the ease with which magnets 421 and 422 are installed in bores 521 and 522 during the manufacturing process. Magnets 421 and 422 optionally are secured within bores 521 and 522, respectively, by epoxy or other adhesive or mechanical means (for example, a metal plate with fasteners).

Backboard 230 comprises bore 531 and bore 532, into which other magnets are installed, as discussed below with reference to FIG. 7. Bores 531 and 532 are similar in design to bores 521 and 522.

Figure 23:
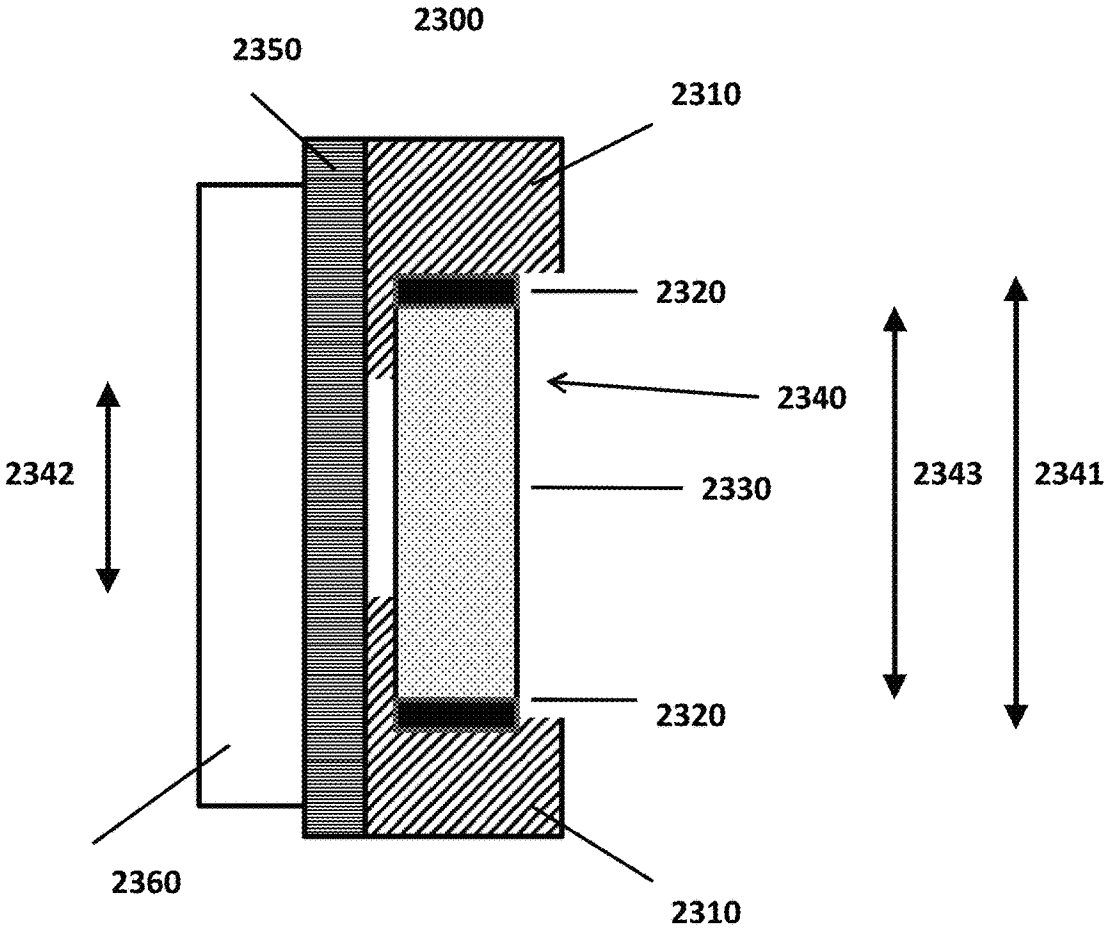
FIG. 23 depicts a magnet embedded in a bore in a floorboard of a portable exercise bar device.

FIG. 23 contains further detail regarding the magnets and bores shown previously in FIGS. 4-5 (as well as FIGS. 16-17 discussed below). Magnetic system 2300 is depicted. A floorboard 2310 comprises bore 2340. Within bore 2340, magnet 2330 is installed and secured with adhesive 2320. Bore 2340 comprises a portion with a first diameter 2341 (I think 2341 needs to be labeled, unless I am not reading image correctly) and a portion with a second diameter 2342, and the diameter 2343 of magnet 2330 is larger than the first diameter 2341 and smaller than the second diameter 2342. Magnet 2330 generates a magnetic field according to known magnetic principles. The magnetic field attracts leg 2360 toward magnet 2330, even with mat 2350 located between leg 2360 and magnet 2330. Magnet 2330 is held in place by floorboard 2310. Magnet 2330 optionally can be a rare-earth magnet such as a neodymium magnet or samarium-cobalt magnet and ideally is selected such that leg 2360 is held in place even when the unit is being moved yet is easy for a normal user to overcome when he or she wishes to extend the leg to use the portable exercise bar by pushing/pulling the leg outward with his or her hands or feet.

Figure 6:
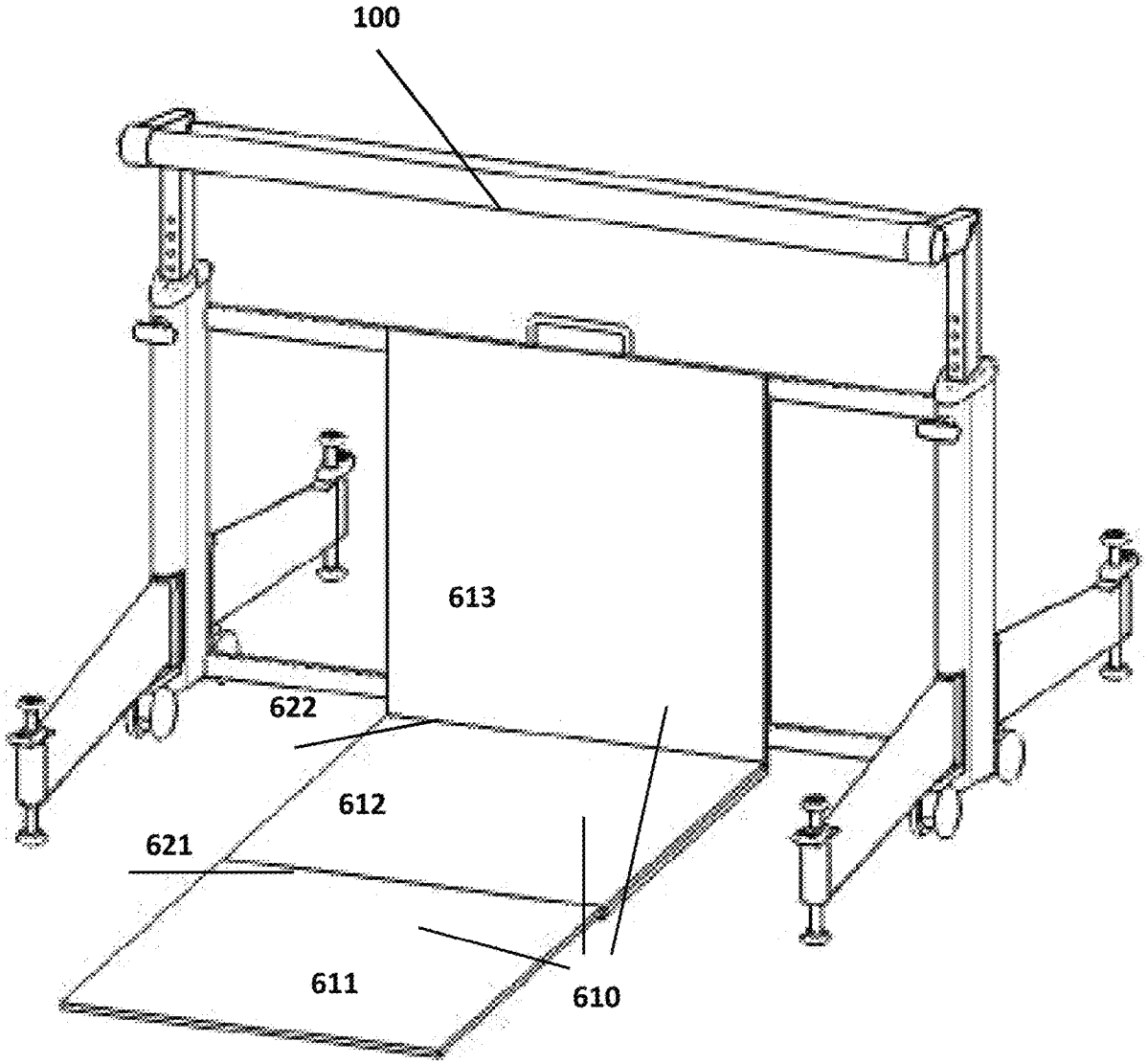
FIG. 6 depicts a front view of an embodiment of a single unit portable exercise bar device with legs and floorboard extended outward with a mat installed.
Figure 8:
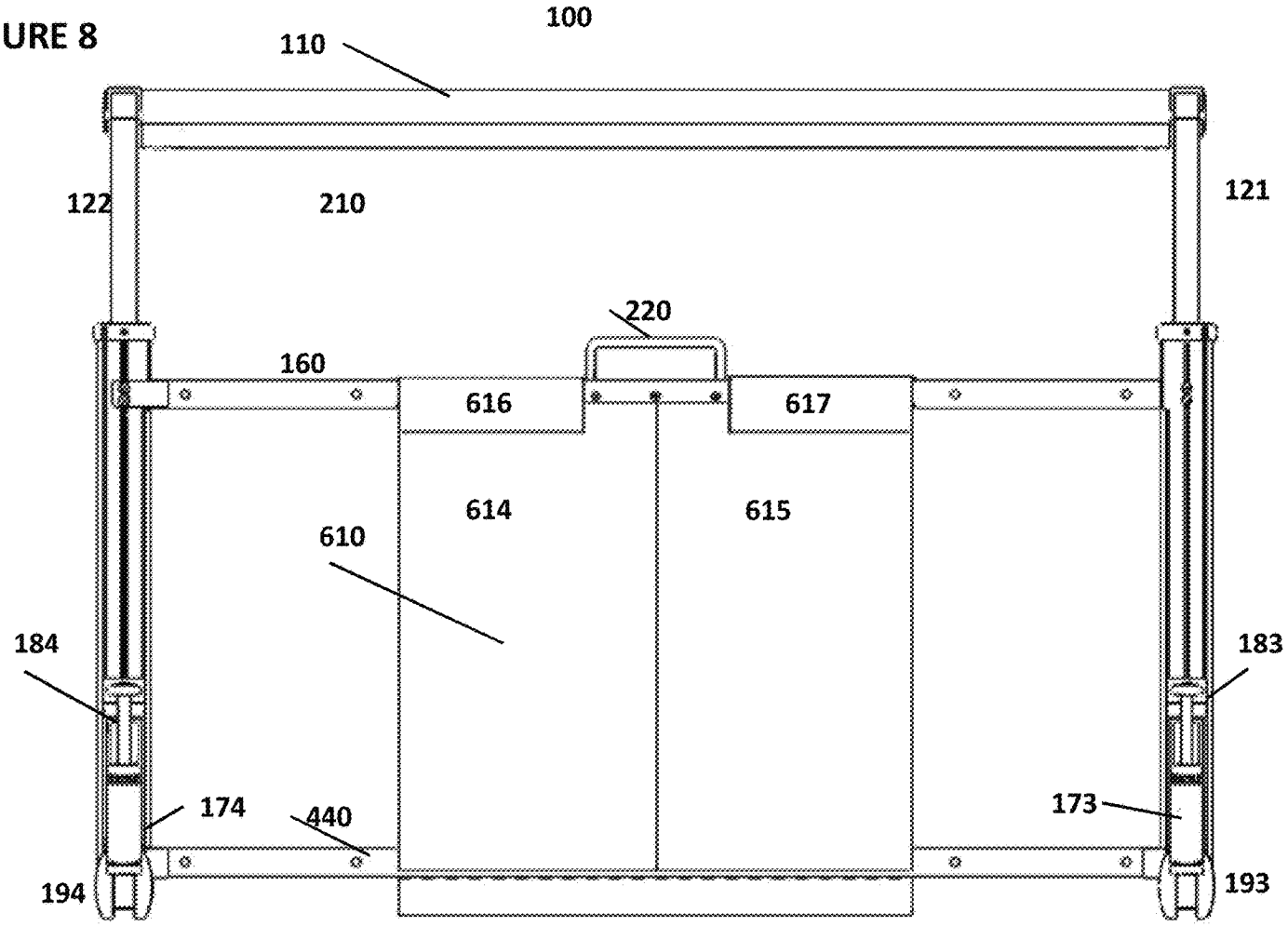
FIG. 8 depicts a back view of an embodiment of a single unit portable exercise bar device with legs extended outward with a mat installed.

FIG. 6 depicts the same configuration of portable exercise bar 100 shown in FIG. 5, except that mat 610 has been placed over floorboard 150 and wrapped around backboard 230 as shown in FIGS. 6 and 8. Mat 610 optionally comprises portions 611, 612, and 613 which join at creases 621 and 622. The user can add mat 610 after unfolding legs 171 and 172 and floorboard 150, or mat 610 can be coupled to floorboard 150 and backboard 230 and remain attached even when floorboard 150 and legs 171 and 172 are folded inward. For example, portion 612 can include a pocket that envelopes floorboard 150. Mat 610 is utilized by the user during exercises and provides padding on the floor. Mat 610 also provides padding for crossbar 160, which is beneficial if the user stretches his or her leg by placing the leg on crossbar 160. Optionally, portions 612 and 613 comprise a vinyl covering over adhesive foam that is attached to floorboard 150 and backboard 230, respectively, and portion 611 comprises a vinyl enclosure containing foam.

Figure 7:
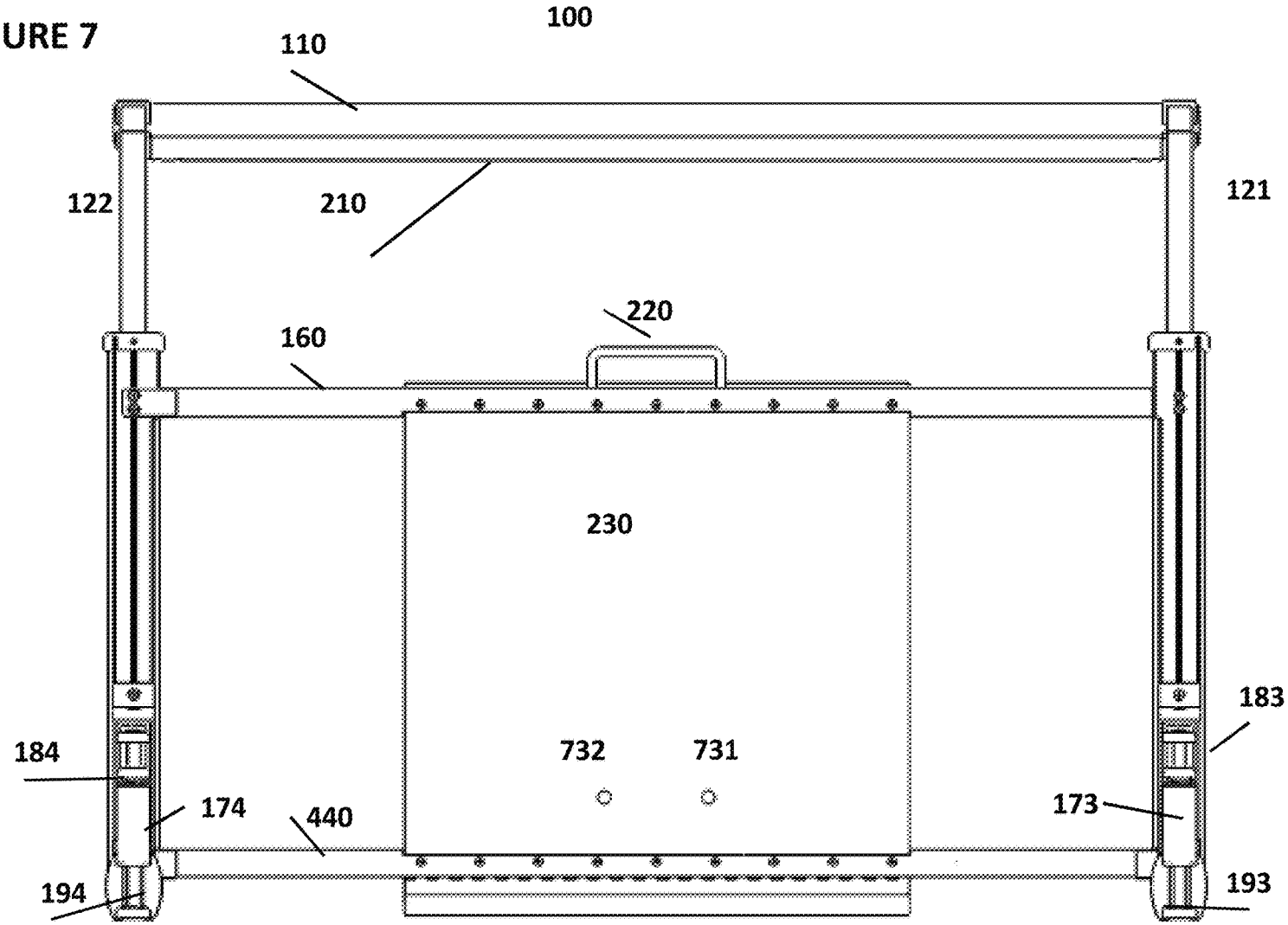
FIG. 7 depicts a back view of an embodiment of a single unit portable exercise bar device with legs extended outward.

FIG. 7 depicts another rear view of portable exercise bar 100. In this view, legs 173 and 174 have been extended. Backboard 230 comprises magnets 731 and 732. Magnet 731 is placed in bore 531, and magnet 732 is placed in bore 532 (such as through the mechanism shown in FIG. 23). The diameters of bore 531 and bore 532 preferably are smaller on the side of backboard 230 on the rear of portable exercise bar 100 ((i.e., the side of backboard 230 shown in FIG. 7), such that magnets 731 and 732 are retained within backboard 230 by backboard 230 itself, and the diameters of bore 531 and 532 are larger on the side of backboard 230 facing floorboard 150 to increase the ease with which magnets 731 and 732 are installed in bores 531 and 532 during the manufacturing process. Magnets 731 and 732 optionally are secured within bores 531 and 532, respectively, by epoxy or other adhesive.

In the folded position (as in FIG. 2), magnet 731 will hold leg 173 against backboard 230 through magnetic force, and magnet 732 will hold leg 174 against backboard 230 through magnetic force.

FIG. 8 is the same view as FIG. 7 of portable exercise bar 100, except mat 610 comprises portions 614 and 615 that wrap around the vertical sides of backboard 230 and portions 616 and 617 that wrap over the top side of backboard 230 next to handle 220. This provides further stability for mat 610. Mat 610 optionally can be screwed into hinge 151.

Figure 9:
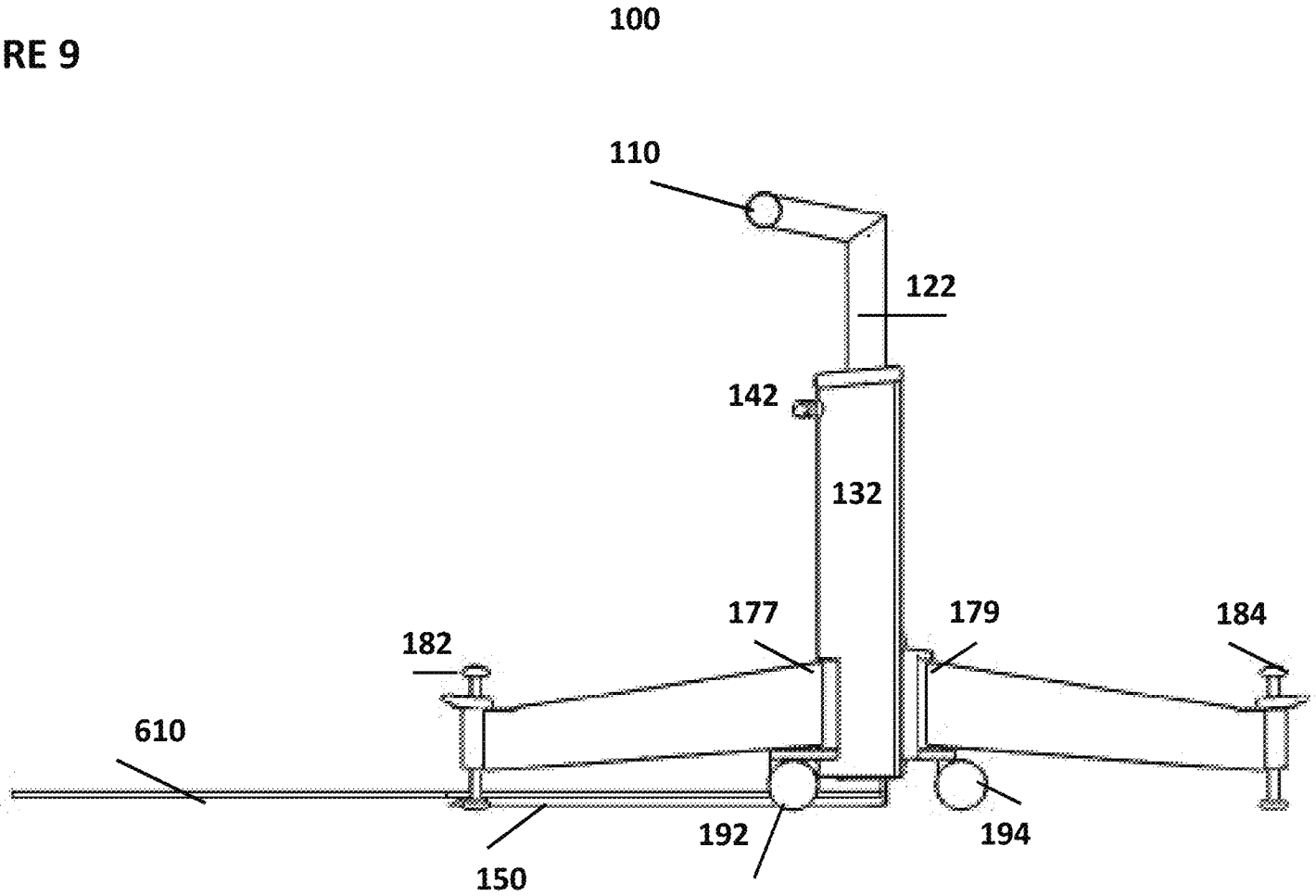
FIG. 9 depicts a side view of an embodiment of a single unit portable exercise bar device with legs and floorboard extended outward with a mat installed.

FIG. 9 depicts another side view of portable exercise bar 100. In this view, floorboard 150 has been unfolded away from crossbar 160 and legs 171, 172, 173, and 174 have been extended.

During operation of portable exercise bar 100 by a user, the configuration of FIGS. 4-9 is used, with floorboard 150 unfolded, legs 171, 172, 173, and 174 extended, and mat 610 installed. The user can hold horizontal bar 120 while exercising or stretching, just as he or she could do with a fixed ballet bar.

Figure 10:
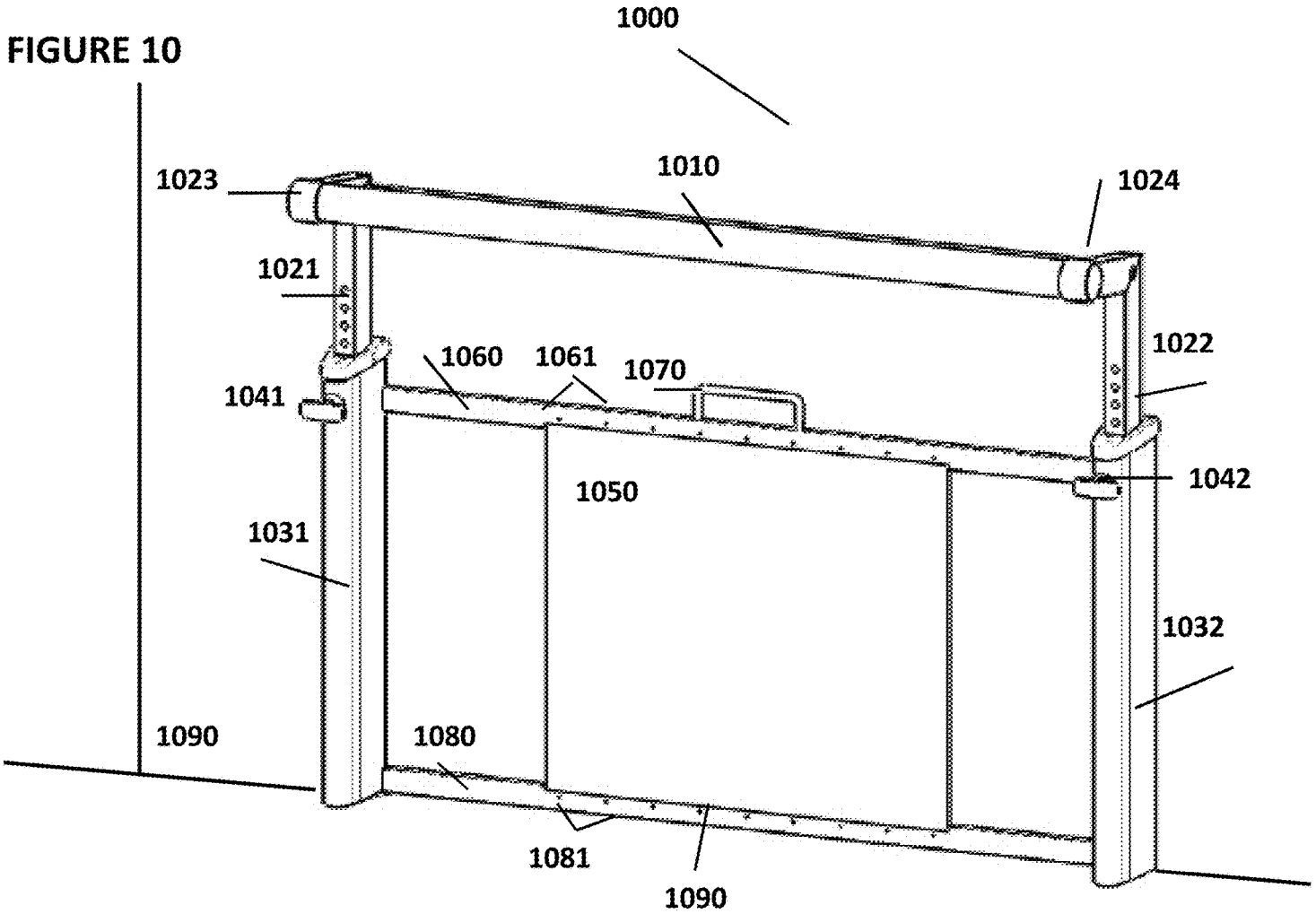
FIG. 10 depicts a front view of an embodiment of a single unit portable exercise bar device mounted on a wall.

WALL-MOUNTABLE SINGLE UNIT PORTABLE EXERCISE BAR. Another embodiment is depicted in FIGS. 10-13. With reference to FIG. 10, wall-mountable portable exercise bar 1000 comprises horizontal bar 1010, neck 1021, neck 1022, vertical column 1031, vertical column 1032, knob 1041, knob 1042, backboard 1220 (shown in FIG. 12), hinge 1090, crossbar 1060, crossbar 1080, and handle 1070. Wall-mountable portable exercise bar 1000 can be mounted to wall 1090.

Horizontal bar 1010 optionally is a ballet bar. Horizontal bar 1010 is secured in place by neck 1021 and neck 1022. Neck 1021 comprises clamping mechanism 1023, and neck 1022 comprises clamping mechanism 1024. Clamping mechanism 1023 and clamping mechanism 1024 are secured to horizontal bar 1010 such that horizontal bar 1010 does not move within clamping mechanism 1023 and clamping mechanism 1024.

Neck 1021 can slide within vertical column 1031 when knob 1041 is pulled outward from vertical column 1031, and neck 1021 is held in place within vertical column 1031 by knob 1041 when knob 1041 is not pulled outward. Neck 1022 can slide within vertical column 1032 when knob 1042 is pulled outward from vertical column 1032, and neck 1022 is held in place within vertical column 1032 by knob 1042 when knob 1042 is not pulled outward. Knob 1041 and knob 1042 optionally are spring-loaded. In this exemplary embodiment, knob 1041 and knob 1042 are T-shaped, which is a shape that is easy for the human hand to grasp and pull. Other shapes are possible, such as a circular shape. In one embodiment, neck 1021 and neck 1022 can be held in place by knob 1041 and knob 1042, respectively, in a maximum vertical position such that horizontal bar 1010 is located at least 28.00 inches from the floor.

Crossbar 1060 and crossbar 1080 are coupled to vertical column 1031 and vertical column 1032. Crossbars 1060 and 1080 optionally comprise a plurality of holes 1061 and 1081, respectively, for receiving attachment devices such as screws.

Backboard 1220 is coupled to crossbar 1060 and crossbar 1080.

Figure 11:
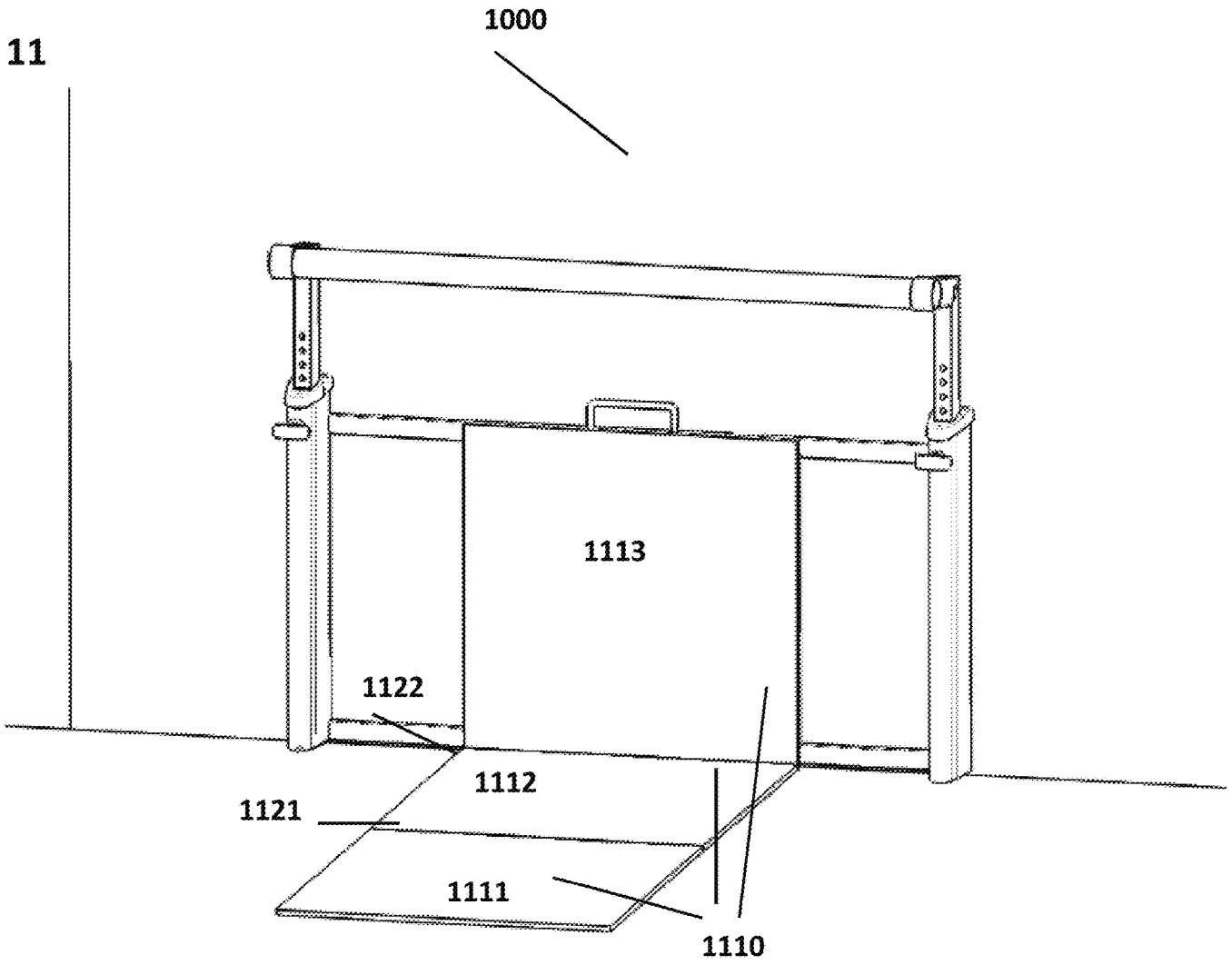
FIG. 11 depicts a front view of an embodiment of a single unit portable exercise bar device mounted on a wall with mat installed.

FIG. 11 depicts the same configuration of wall-mountable portable exercise bar 1000 as shown in FIG. 10, except mat 1110 has been placed over backboard 1220 as shown. Mat 1110 optionally comprises portions 1111, 1112, and 1113, which join at creases 1121 and 1122. Mat 1110 can be attached to backboard 1220. For example, portion 1113 can be attached to backboard 1220 using velcro straps. Portions 1111 and 1112 can be folded upward toward backboard 1220 and can be attached to handle 1070 with velcro straps.

Figure 12:
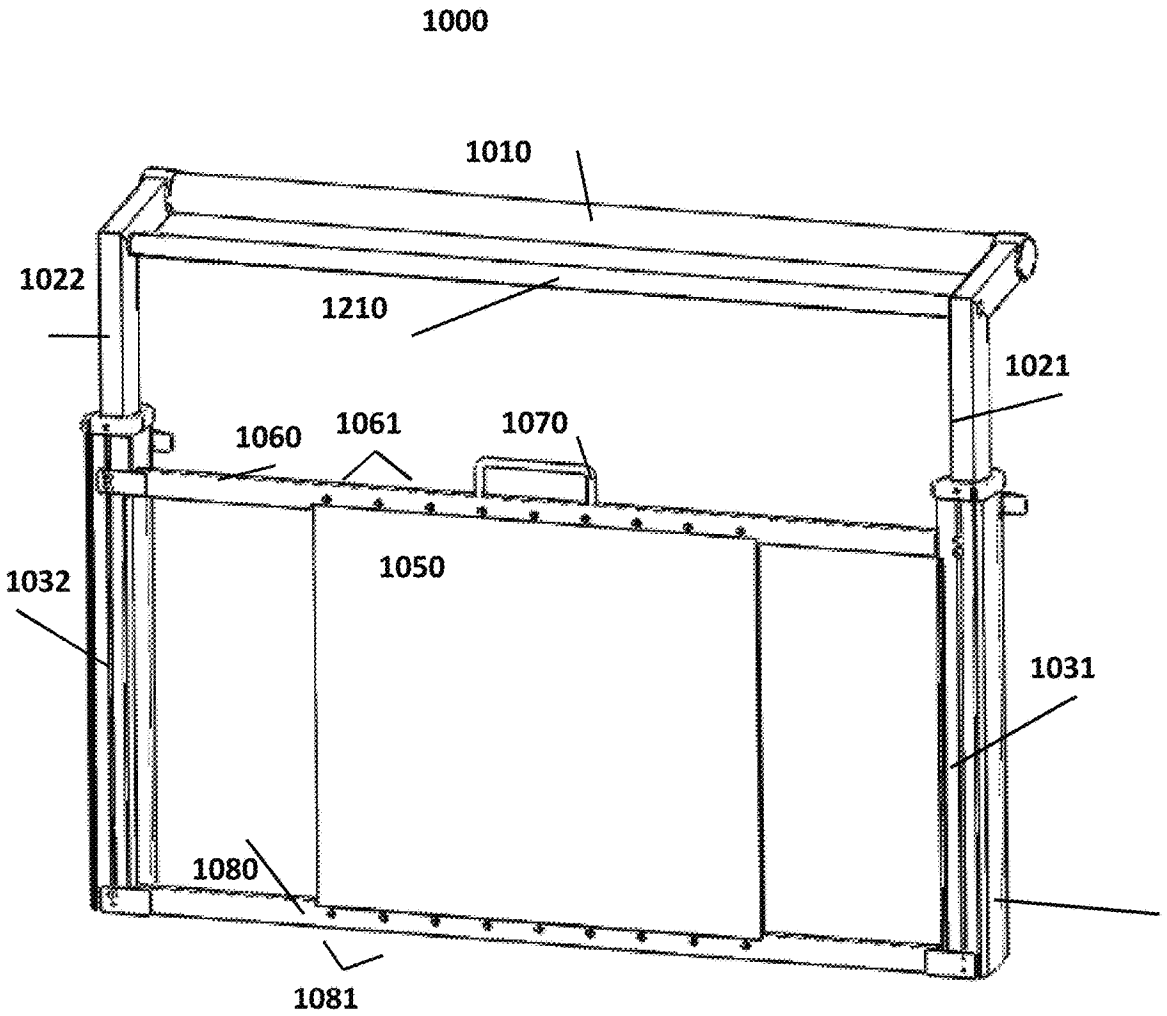
FIG. 12 depicts a back view of an embodiment of a single unit portable exercise bar device that can be mounted on a wall.

FIG. 12 depicts a rear view of the embodiment of a wall-mountable portable exercise bar 1000. Wall-mountable portable exercise bar 1000 further comprises horizontal bar 1210. Horizontal bar 1210 is substantially parallel to horizontal bar 1110 and is coupled to neck 1121 and neck 1122. Horizontal bar 1210 provides additional stability for wall-mountable portable exercise bar 1000.

Figure 13:
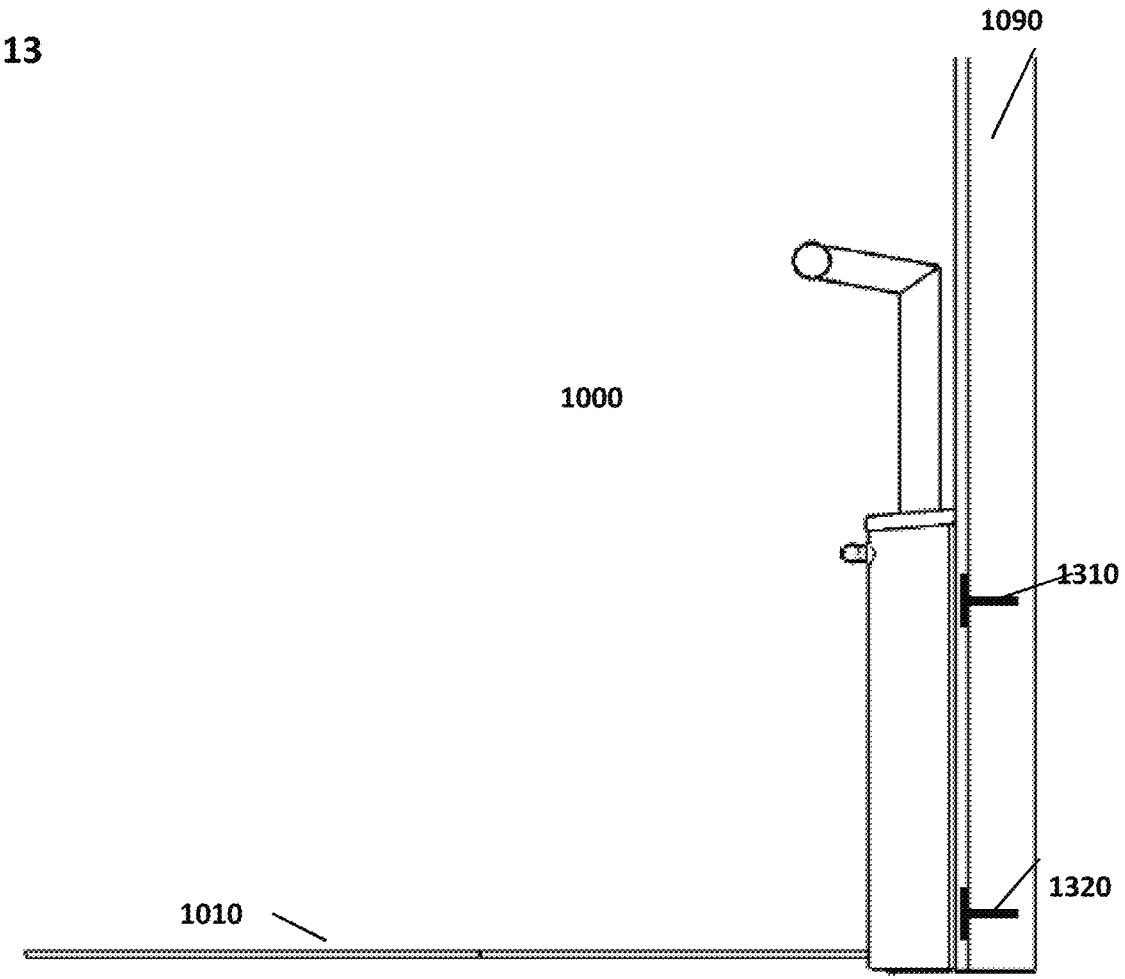
FIG. 13 depicts a side view of an embodiment of a single unit portable exercise bar device mounted on a wall and a mat installed.

FIG. 13 depicts a side view of wall-mountable portable exercise bar 1000. Wall-mountable portable exercise bar 1000 is mounted to wall 1090 with attachment devices 1310 and 1320. Attachment devices 1310 and 1320 each can comprise a metal bracket that is attached to studs in wall 1090, such as by screws. Crossbar 1060 and/or crossbar 1080 are then attached to metal bracket, such as by using nuts and bolts through plurality of holes 1061 and 1081.

One of ordinary skill the art will understand that portable exercise bar 100 can be modified into portable exercise bar 1010 by removing leg 171-174, wheels 191-194, shafts 176-179, and foot mechanisms 181-184. Thus, portable exercise bar 100 can be used as a stand-alone unit or as a wall-mountable unit.

To that end, FIG. 14 depicts assembly 1400. Assembly 1400 comprises leg 1410, foot mechanism 1420, wheel 1430, and attachment mechanism 1440. Attachment mechanism 1440 optionally comprises shaft 1442 (which allows leg 1410 to rotate about an axis), attachment device 1443, and attachment device 1444. Attachment device 1443 and attachment device 1444 optionally are screws that are placed in holes in attachment mechanism 1440 and then screwed into vertical columns 131 and 132. Thus, assembly 1400 can be used for either the front legs or rear legs attached to vertical columns 131 and 132 in portable exercise bar 100. When attached to the front and rear of vertical columns 131 and 132, the unit becomes portable exercise bar 100. When removed from the front and rear of vertical columns 131 and 132, the unit becomes wall-mountable portable exercise bar 1000. The use of assembly 1400 in this manner creates a versatile portable exercise bar that can be either a stand-alone unit (such as portable exercise bar 100) or a wall-mounted unit (such as wall-mountable portable exercise bar 1000).

STAND-ALONE DOUBLE UNIT PORTABLE EXERCISE BAR. FIGS. 15-20 depict an embodiment of a stand-alone double unit portable exercise bar.

Figure 15:
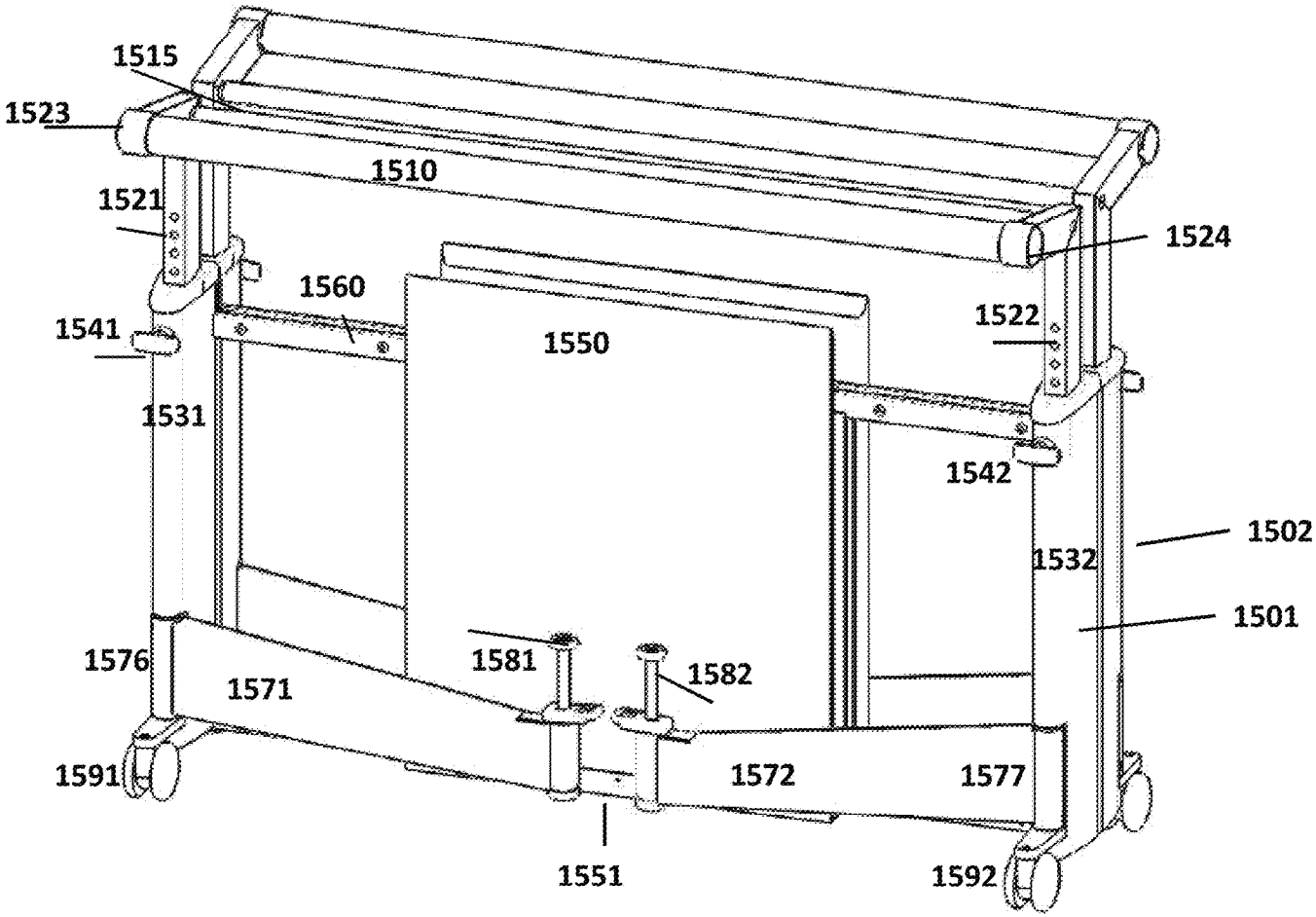
FIG. 15 depicts a front view of an embodiment of a double unit portable exercise bar device with legs and floorboards folded inward.

With reference to FIG. 15, double unit portable exercise bar 1500 is depicted. Double unit portable exercise bar 1500 comprises first module 1501 and second module 1502. First module 1501 and second module 1502 are identical and attach in a back-to-back configuration as shown.

Description will now be made of first module 1501. It should be understood that the description applies to second module 1502 as well.

First module 1501 comprises horizontal bar 1510, neck 1521, neck 1522, vertical column 1531, vertical column 1532, knob 1541, knob 1542, floorboard 1550, hinge 1551, crossbar 1560, leg 1571, leg 1572, shaft 1576, shaft 1577, foot mechanism 1581, foot mechanism 1582, wheel 1591, and wheel 1592.

Horizontal bar 1510 optionally is a ballet bar. Horizontal bar 1510 is secured in place by neck 1521 and neck 1522. Neck 1521 comprises clamping mechanism 1523, and neck 1522 comprises clamping mechanism 1524. Clamping mechanism 1523 and clamping mechanism 1524 are secured to horizontal bar 1510 such that horizontal bar 1510 does not move within clamping mechanism 1523 and clamping mechanism 1524. Clamping mechanisms 1523 and 1524 can follow the design of FIG. 24, described previously.

Neck 1521 can slide within vertical column 1531 when knob 1541 is pulled outward from vertical column 1531, and neck 1521 is held in place within vertical column 1531 by knob 1541 when knob 1541 is not pulled outward. Neck 1522 can slide within vertical column 1532 when knob 1542 is pulled outward from vertical column 1532, and neck 1522 is held in place within vertical column 1532 by knob 1542 when knob 1542 is not pulled outward. Knob 1541 and knob 1542 optionally are spring-loaded. In this exemplary embodiment, knob 1541 and knob 1542 are T-shaped, which is a shape that is easy for the human hand to grasp and pull. Other shapes are possible, such as a circular shape.

Crossbar 1560 is coupled to vertical column 1531 and vertical column 1532.

Horizontal bar 1515 is coupled to vertical column 1531 and vertical column 1532 and provides additional stability for double unit portable exercise bar 1500.

Figure 16:
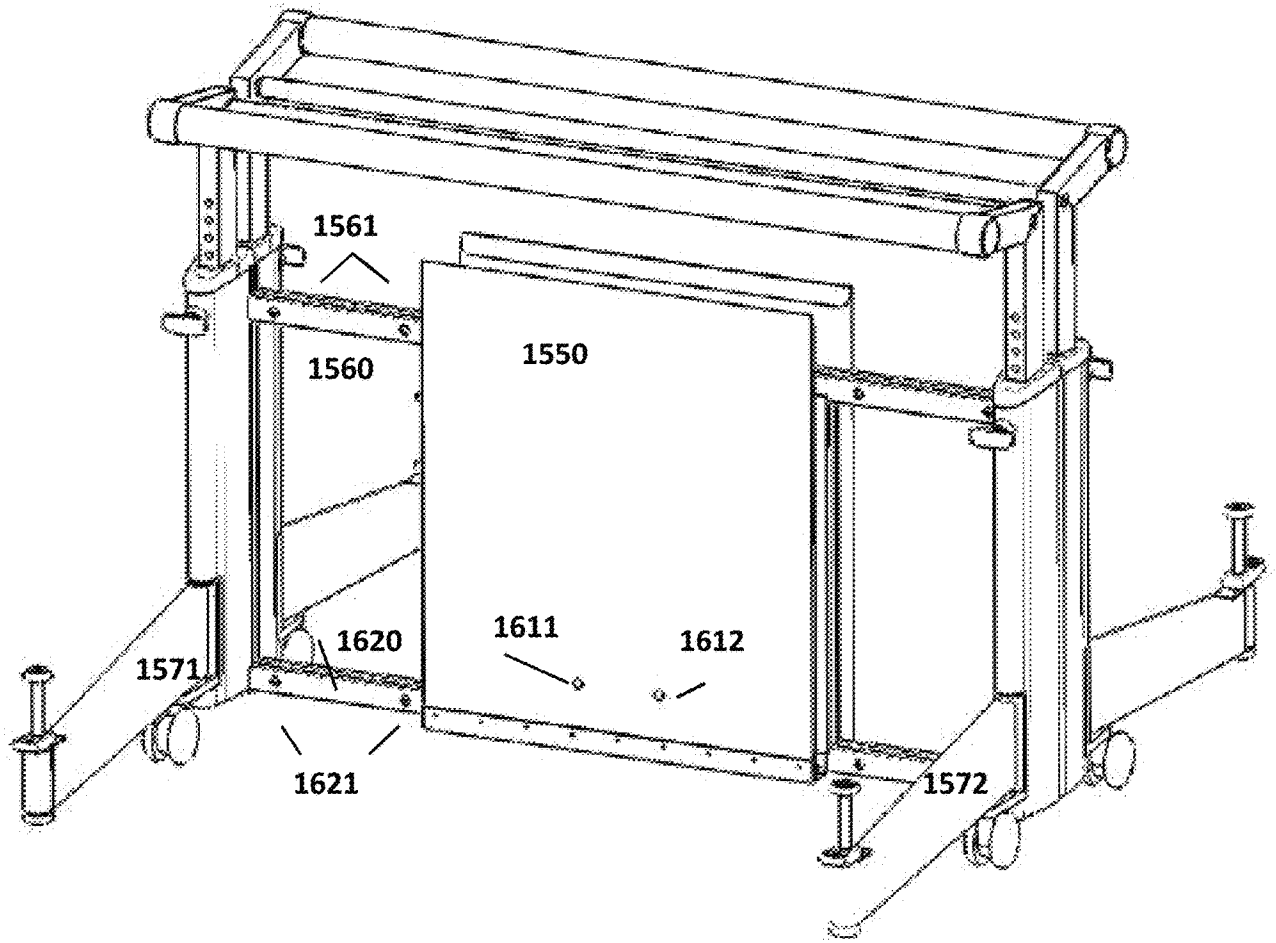
FIG. 16 depicts a front view of an embodiment of a double unit portable exercise bar device with legs extended outward and floorboards folded inward.

Floorboard 1550 is coupled to hinge 1551, which also is coupled to backboard 1610 (shown in FIG. 16). Optionally, hinge 1551 is designed such that when floorboard 1550 is folded in, hinge 1551 is raised off the floor to provide clearance when portable exercise bar 1500 is transported. When floorboard 1550 is extended to the floor, hinge 1551 extends to the floor such that floorboard 1550 is placed in contact with the floor. For example, hinge 1551 can be spring loaded so that floorboard 1550 is placed in contact with the floor when a user stands on floorboard 1550.

Leg 1571 is coupled to vertical column 1531 by shaft 1576. Leg 1572 is coupled to vertical column 1532 by shaft 1577. Shafts 1576 and 1577 optionally are embedded within the legs as shown. Leg 1571 can rotate about shaft 1576 between a folded position (shown in FIGS. 15, 18, and 21) and an extended position (shown in FIGS. 16-17 and 19-20). Optionally, vertical columns 1531 and 1532 each comprise a cut-out portion for receiving shafts 1576, 1577, 1578, and 1579. The cut-out prevents legs 1571, 1572, 1573, and 1574 from extending beyond the position where the leg is parallel with floorboard 1550 in the unfolded position (i.e., it prevents over-extension of the legs), which is a feature that enhances user safety. Leg 1572 can rotate about shaft 1577, leg 1573 can rotate about shaft 1578, and leg 1574 can rotate about shaft 1579 in the same manner described for leg 1571 and shaft 1576. Leg 1572 can rotate about shaft 1577 in the same manner described for leg 171 and shaft 176.

Figure 67:
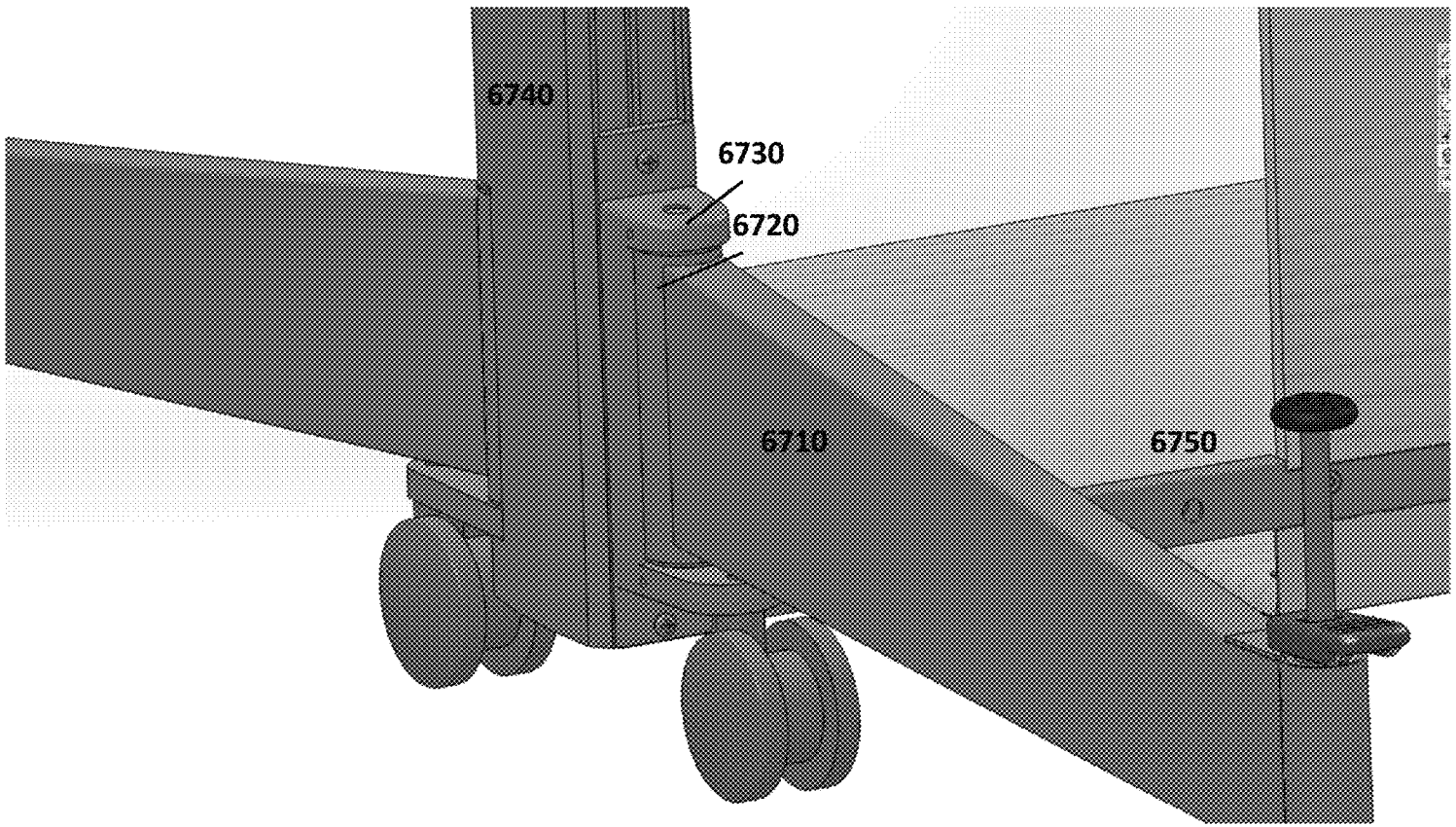
FIG. 67 depicts a leg mounting mechanism in a portable exercise bar device.

In the alternative, shafts 1576, 1577, 1578, and 1579 each can be attached to a bracket, which in turn is attached to vertical columns 1531 and 1532, and the brackets can prevent legs 1571, 1572, 1573, and 1574 from extending beyond the position where the leg is parallel with floorboard 1550 in the unfolded position, in accordance with the design shown in FIG. 67.

In one embodiment, the distance between the bottom of vertical column 1531 and the floor is at least 1.80 inches and the distance between the bottom of vertical column 1532 and the floor is at least 1.80 inches.

Various designs for shafts 1576 and 1577 are possible. For example, each of shafts 1576 and 1577 can comprise a hollow cylinder fixed to each of legs 1571 and 1572, respectively, with each cylinder enclosing another cylinder (or pin) fixed to vertical columns 1531 (for shaft 1576) and 1532 (for shafts 1577). In another example, each of shafts 1576 and 1577 can comprise a cylinder fixed to each of legs 1571 and 1572, respectively, with spring-loaded members extending from the top and bottom of each cylinder received by a recess in vertical columns 1531 and 1532. One embodiment of a leg and shaft design is shown in FIG. 14.

Wheel 1591 is connected to a horizontal bracket that is connected to vertical column 1531, and wheel 1592 is connected to a horizontal bracket that is connected to vertical column 1532.

Foot mechanism 1581 is coupled to leg 1581, and foot mechanism 1582 is coupled to leg 1572. Foot mechanism 1581 and 1582 each comprise a knob and a lever, and the user can lock each foot mechanism by pushing the knob and release the lock by pushing the lever.

FIG. 16 depicts the same view as FIG. 15, except legs 1571 and 1572 have been extended. Floorboard 1550 comprises magnet 1611 and magnet 1612.

In the folded position (as in FIG. 15), magnet 1611 will hold leg 1571 against floorboard 1550 through magnetic force, and magnet 1612 will hold leg 1572 against floorboard 1550 through magnetic force. Crossbar 1620 is coupled to vertical column 1531 and vertical column 1532 and provides additional stability for double unit portable exercise bar 1500. Crossbar 1560 comprises plurality of holes 1561, and crossbar 1620 comprises plurality of holes 1621.

Figure 17:
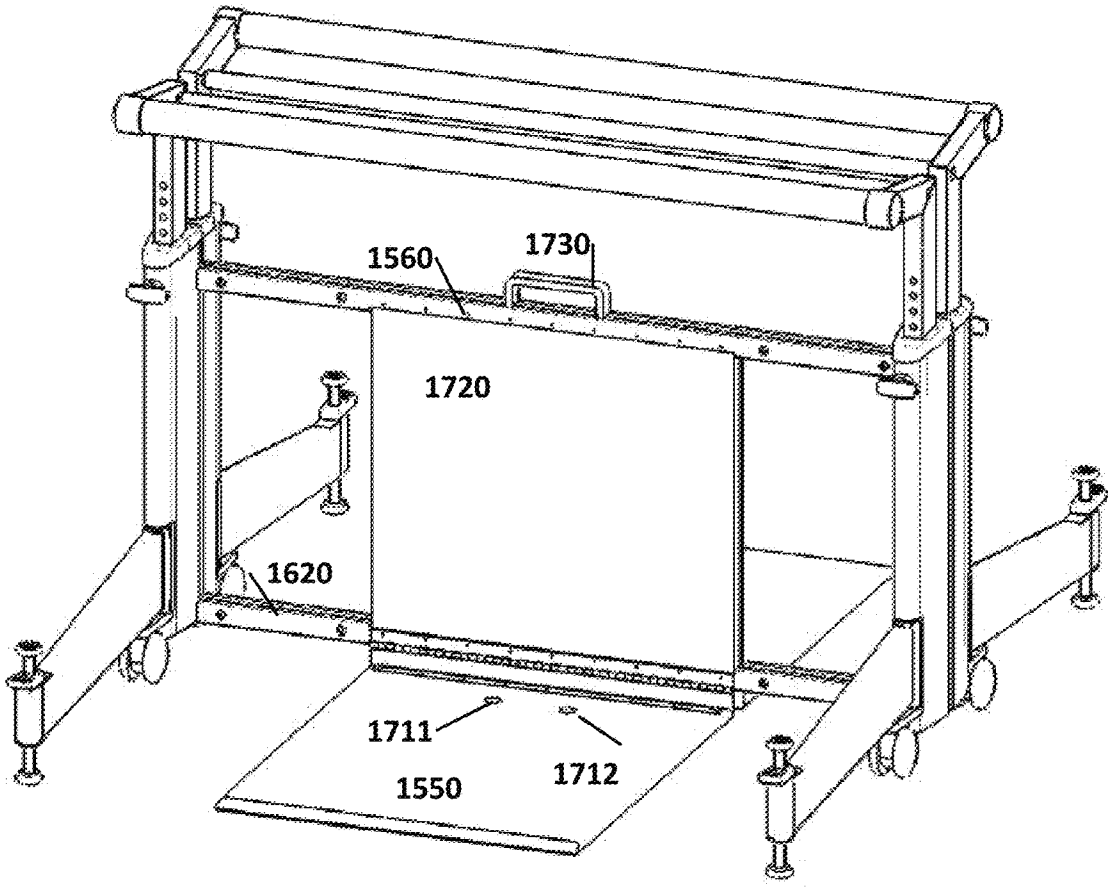
FIG. 17 depicts a front view of an embodiment of a double unit portable exercise bar device with legs and floorboards extended outward.

FIG. 17 depicts the same view as FIG. 16, except floorboard 1550 now has been unfolded to the ground. Floorboard 1550 comprises bore 1711 and 1712. Magnet 1611 is placed into bore 1711, and magnet 1612 is placed into bore 1712 (such as through the design of FIG. 23). The diameters of bores 1621 and 1612 preferably are smaller on the side of floorboard 1550 facing outward (i.e., the side of floorboard 1550 shown in FIG. 16), such that magnets 1611 and 1612 are retained within floorboard 1550 by the floorboard 1550 itself, and the diameters of bore 1711 and 1712 are larger on the side of floorboard 1550 facing backboard 1720 to increase the ease with which magnets 1611 and 1612 are installed in bores 1711 and 1712 during the manufacturing process. Magnets 1611 and 1612 optionally are secured within bores 1711 and 1712, respectively, by epoxy or other adhesive or mechanical means (for example, a metal plate with fasteners). Further detail regarding these magnets and bores is shown in FIG. 23 and was previously described.

Handle 1730 is coupled to crossbar 1560. Backboard 1720 is coupled to crossbar 1560 and crossbar 1620.

Figure 18:
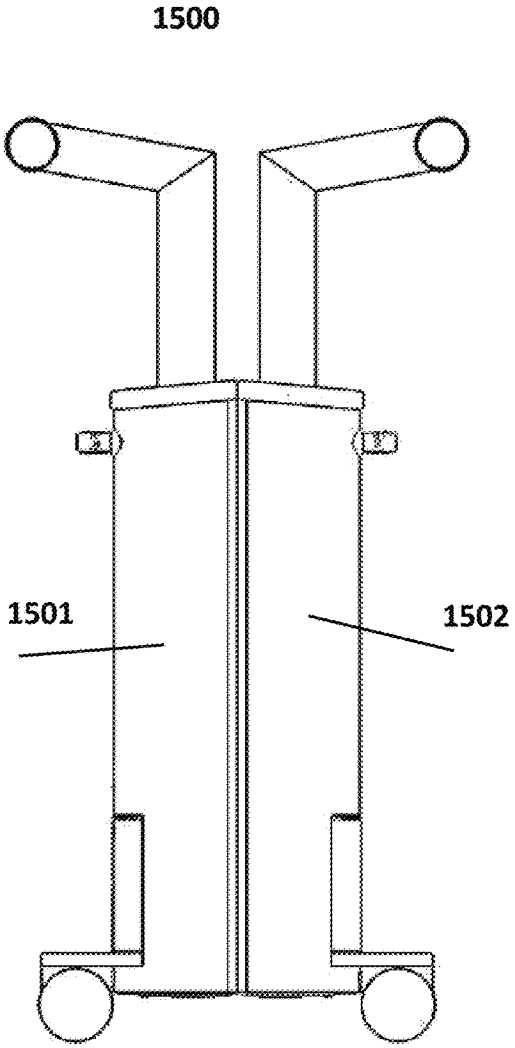
FIG. 18 depicts a side view of an embodiment of a double unit portable exercise bar device with legs and floorboards folded inward.

FIG. 18 depicts a side view of double unit portable exercise bar 1500 with legs and floorboards in a folded position. First module 1501 and second module 1502 are shown in a back-to-back configuration. In this configuration, double unit portable exercise bar 1500 is extremely compact and space-efficient, which is useful when it is being stored.

Figure 19:
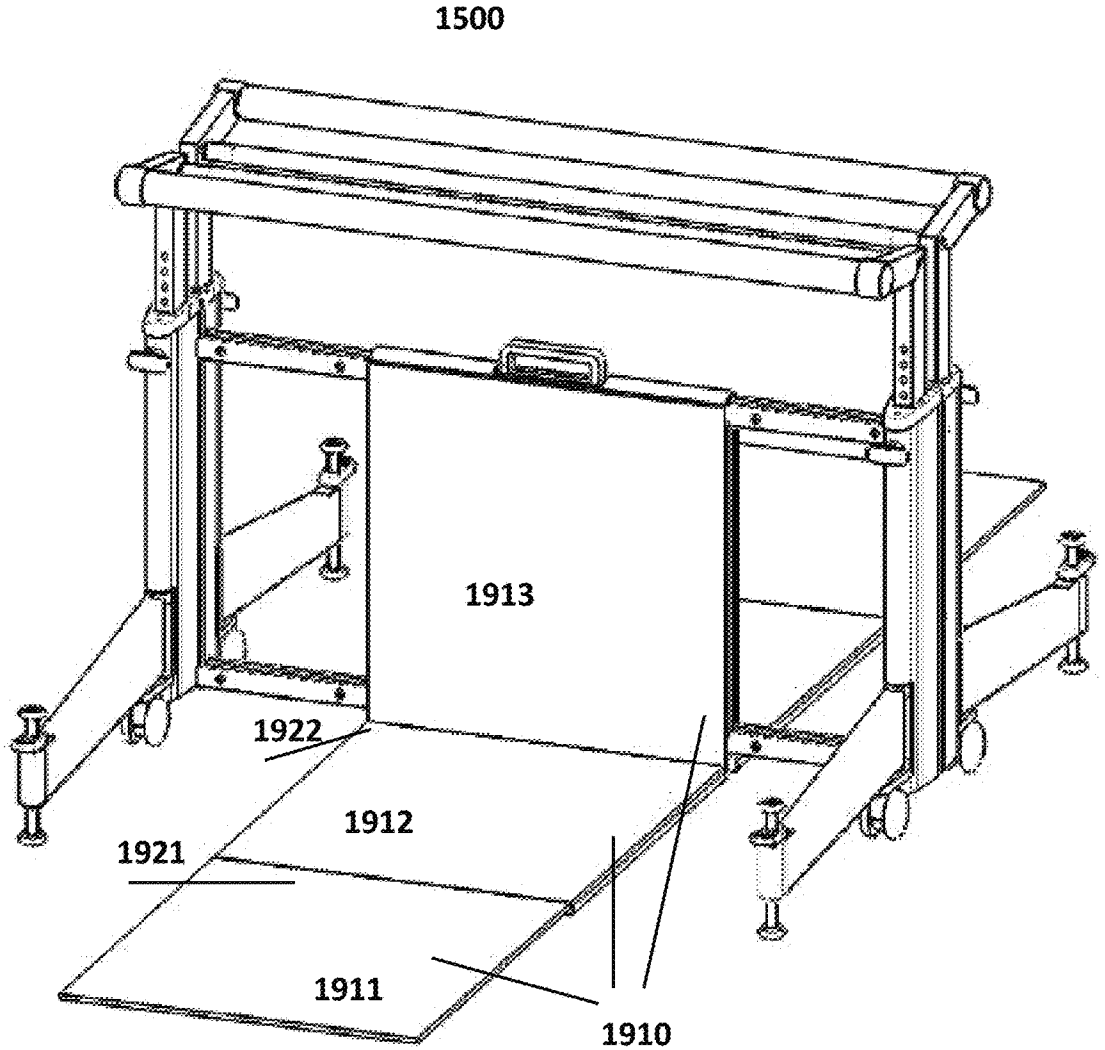
FIG. 19 depicts a front view of an embodiment of a double unit portable exercise bar device with legs and floorboard extended outward with a mat installed.

FIG. 19 depicts the same configuration of double unit portable exercise bar 1500 as shown in FIG. 17, except that mat 1910 has been placed over floorboard 1550 and backboard 1720 as shown. Mat 1910 optionally comprises portions 1911, 1912, and 1913, which join at creases 1921 and 1922. The user can add mat 1910 after unfolding legs 1571 and 1572 and floorboard 1550, or mat 1910 can be coupled to floorboard 1550 and backboard 1720 and remain attached even when floorboard 1550 and legs 1571 and 1572 are folded inward. For example, portion 1912 can include a pocket that envelopes floorboard 1550. Optionally, portions 1912 and 1913 comprise a vinyl covering over adhesive foam that is attached to floorboard 1550 and backboard 1720, respectively, and portion 1911 comprises a vinyl enclosure containing foam.

Figure 20:
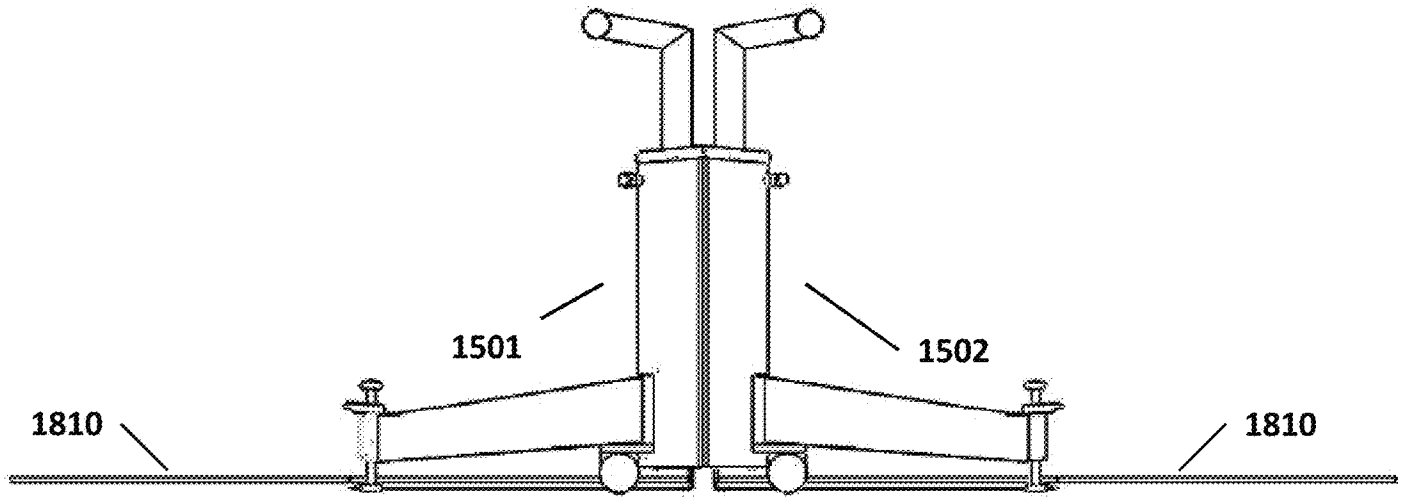
FIG. 20 depicts a side view of an embodiment of a double unit portable exercise bar device with legs and floorboard extended outward with a mat installed.

FIG. 20 depicts the same side view of double unit poi table exercise bar 1500 as shown in FIG. 18, except mat 1810 has been added to first module 1501 and second module 1502.

Figure 21:
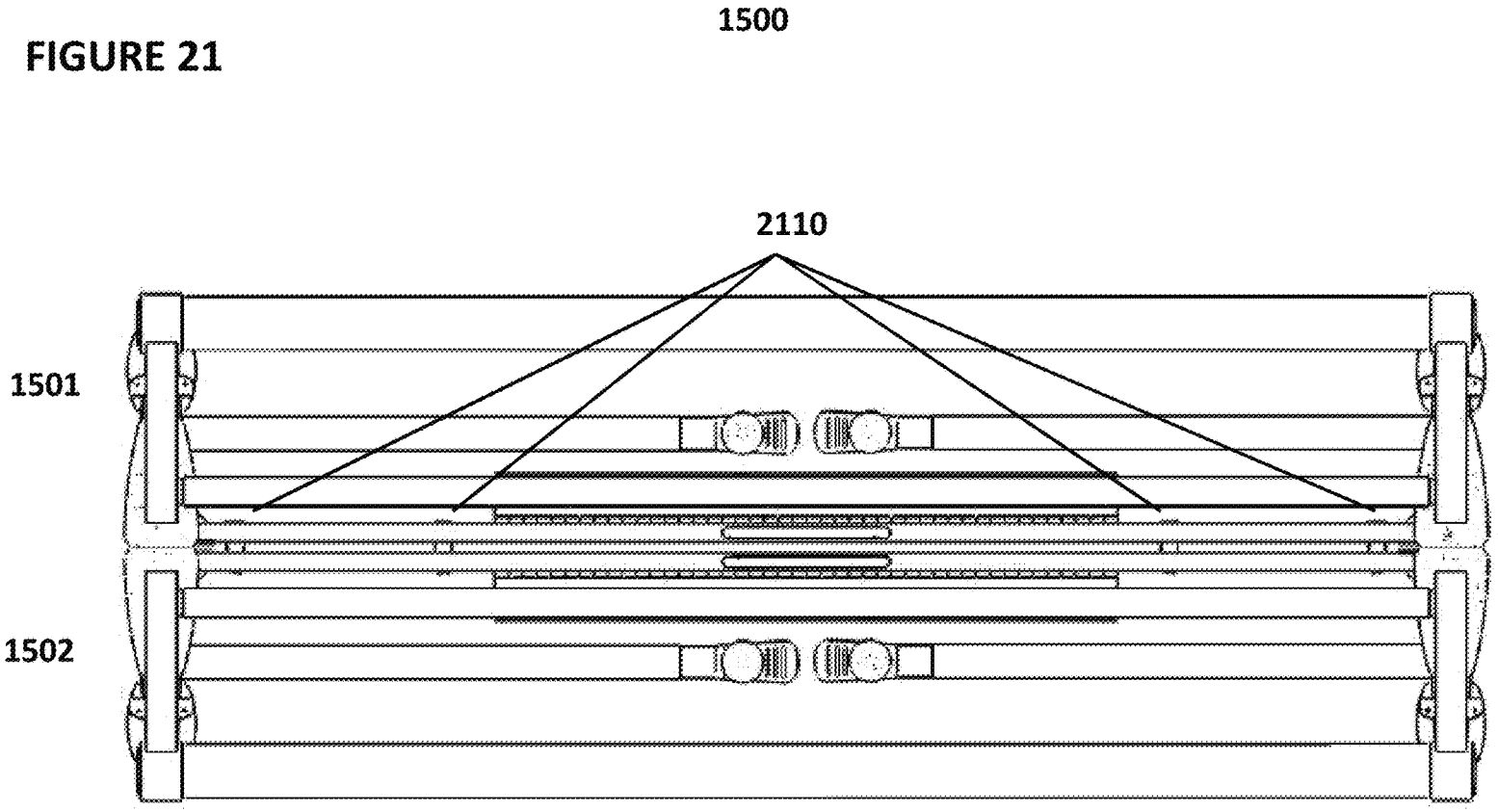
FIG. 21 depicts a top view of an embodiment of a double unit portable exercise bar device with legs and floorboards folded inward.

FIG. 21 depicts a top (bird's eye) view of double unit portable exercise bar 1500. Attachment devices 2110 are depicted and couple first module 1501 and second module 1502. Attachment devices 2110 can comprise, for example, a plurality of bolts that extends through one or more of plurality of holes 1561 and plurality of holes 1621 and are secured by a nut or wingnut such that attachment devices 2110 press the crossbar 1560 of first module 1501 and second module 1502 together and/or press the crossbar 1620 of first module 1501 and second module 1502 together.

WALL-MOUNTABLE DOUBLE UNIT PORTABLE EXERCISE BAR. It will be understood that first module 1501 and second module 1502 can be detached from one another by undoing attachment devices 2110. Once decoupled from one another, first module 1501 or second module 1502 can be used as a wall-mountable portable exercise bar 1000 shown previously in FIGS. 9-13

In addition, first module 1501 and second module 1502 can be attached from one another by undoing attachment devices 2110, and then assembly 1400 can be added to the rear of vertical columns 1531 and 1532 for first module 1501 and second module 1502, such that first module 1501 and second module 1502 each become portable exercise bar 100 (i.e., a standalone single unit).

Figure 22:
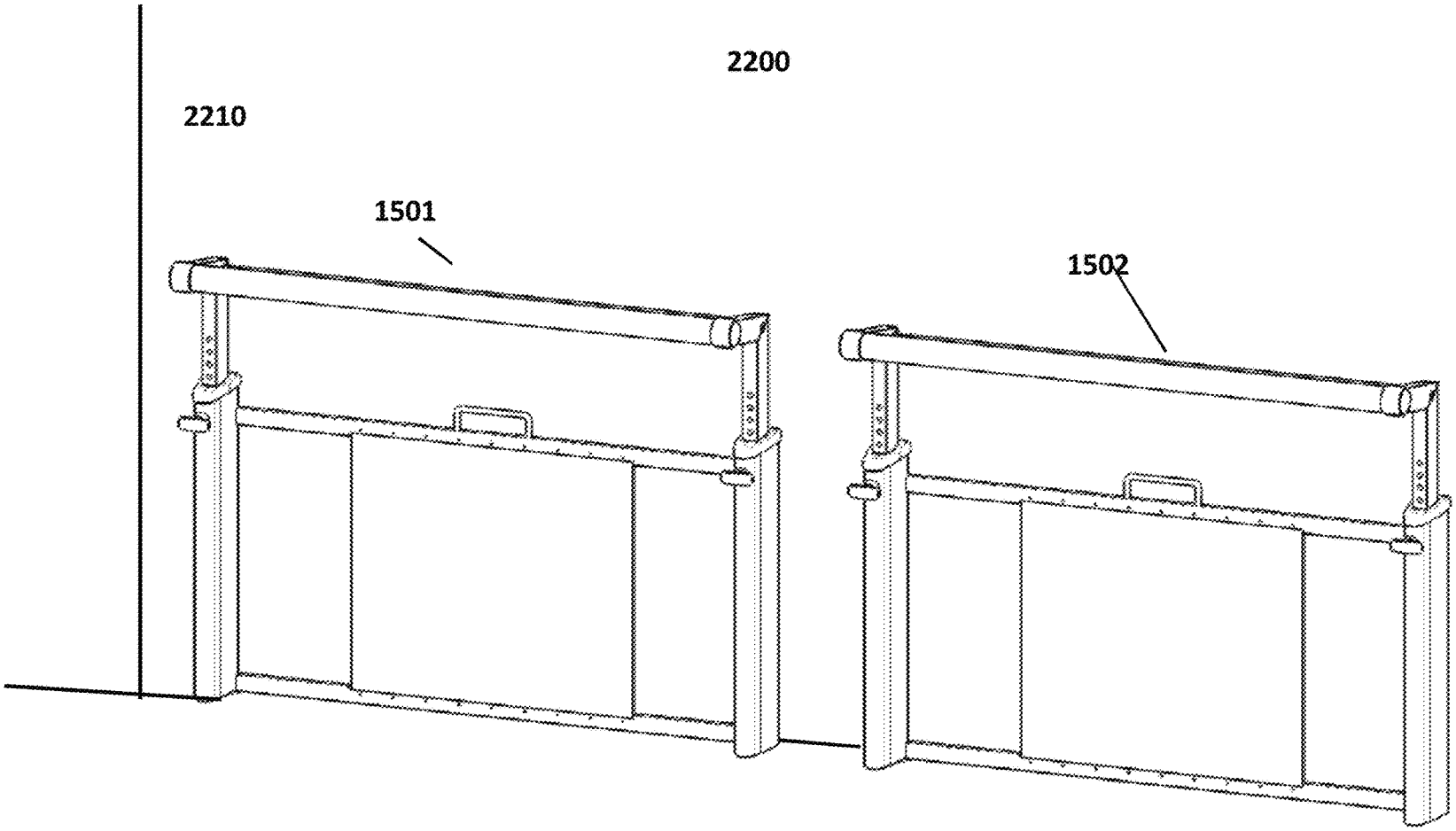
FIG. 22 depicts a front view of an embodiment of two halves of a double unit portable exercise bar device mounted on a wall.

In addition, both first module 1501 and second module 1502 can be used as wall-mountable units in a double configuration. With reference to FIG. 22, first module 1501 and second module 1502 are decoupled from one another and then mounted to wall 2210 in the same manner described previously for wall-mountable portable exercise bar 1000. In this configuration, first module 1501 and second module 1502 together are a double-unit, wall mountable portable exercise ballet bar system 2200.

Alternative Designs for Portable Exercise Bar Devices 100, 1000, 1500, and 2200. Numerous alternative designs are possible for various portions of the portable exercise device. These alternative designs are shown in FIGS. 25-66 and will be discussed in turn.

ALTERNATIVE LEG SECURING MECHANISMS. Numerous options are possible for securing the legs in the inward position when storing or transporting the portable exercise bar. For example, instead of using a magnet installed within a bore in the backboard, any of the alternatives shown in FIGS. 25-32 can be used.

Figure 25:
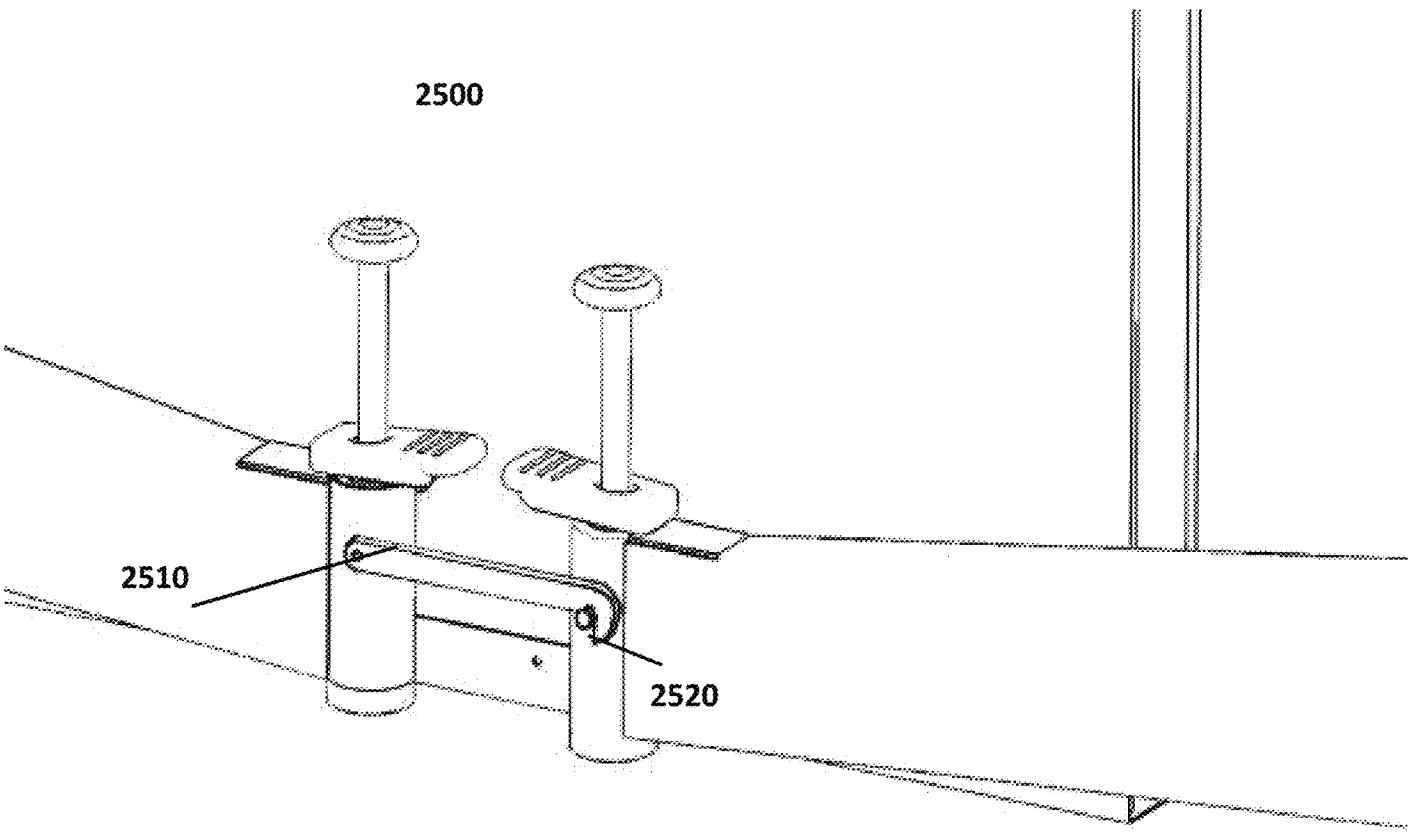
FIG. 25 depicts a hook mechanism for securing two legs in a portable exercise bar device.

With reference to FIG. 25, a hook mechanism 2500 is depicted. Hook mechanism comprises hook 2510 on a leg and connector 2520 on a cross bar or another leg.

Figure 26:
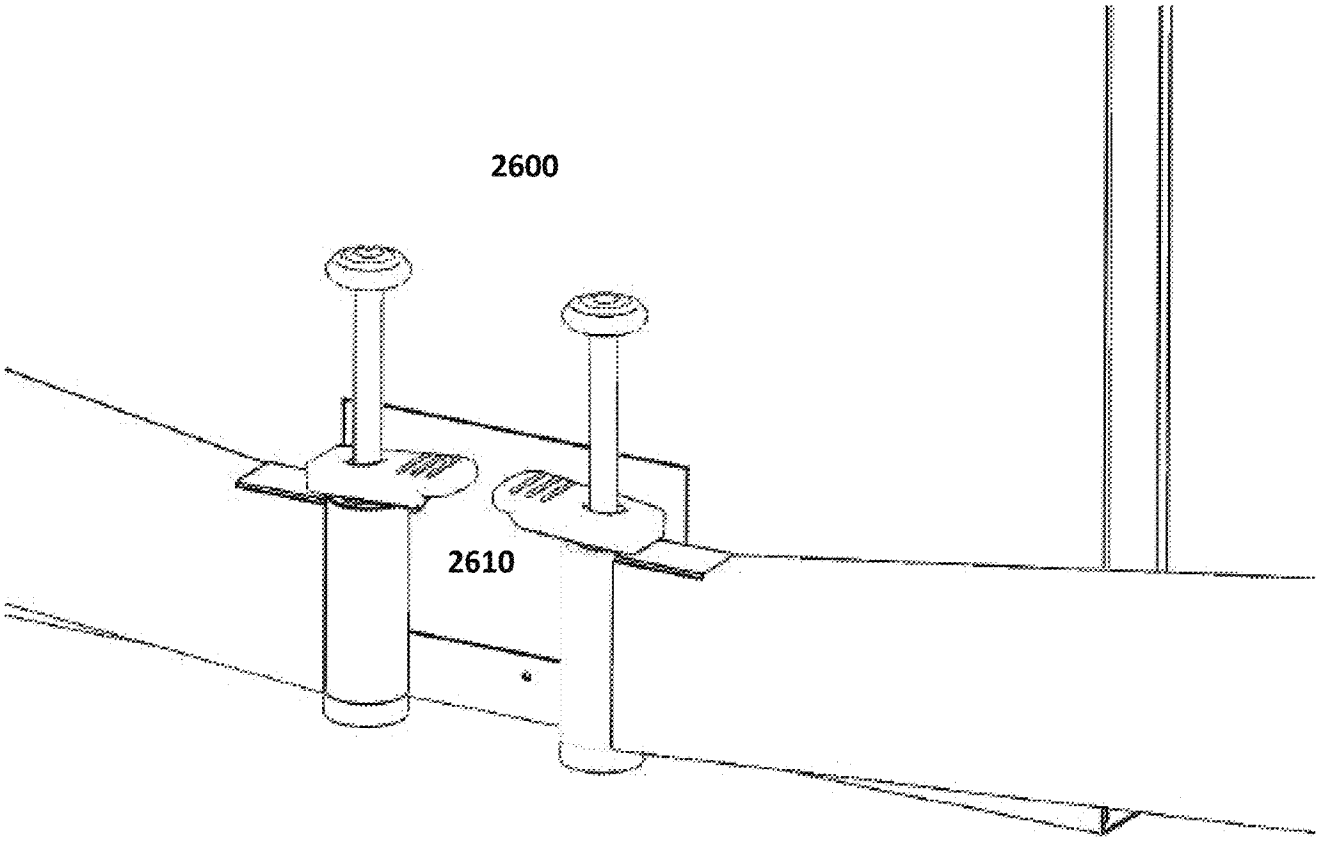
FIG. 26 depicts a velcro mechanism for securing two legs in a portable exercise bar device.

With reference to FIG. 26, a velcro mechanism 2600 is depicted. velcro mechanism 2600 comprises a velcro patch (not shown) installed on a leg and velcro patch 2610 installed on the mat.

Figure 27:
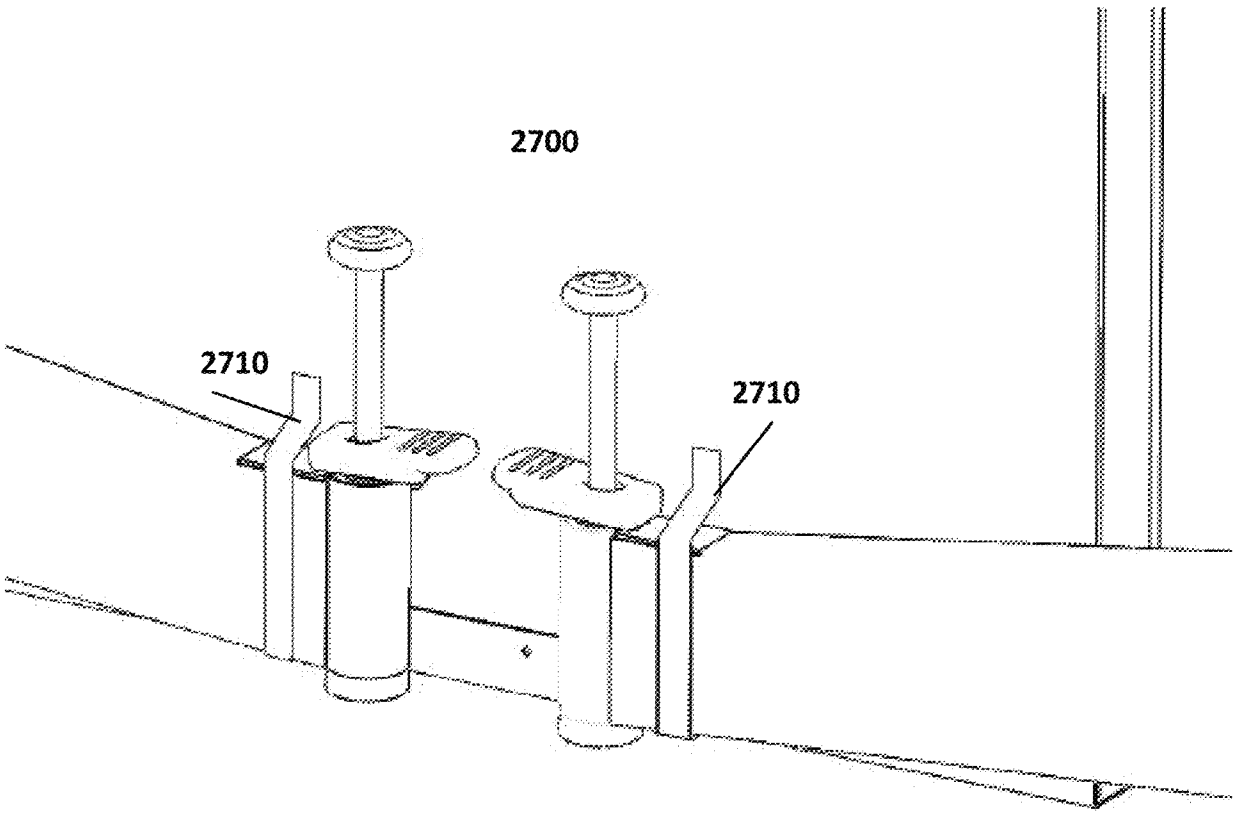
FIG. 27 depicts a strap mechanism for securing two legs in a portable exercise bar device.

With reference to FIG. 27, first strap mechanism 2700 is depicted. Strap mechanism 2700 comprises strap 2710 attached to the mat and wraps around the leg. Strap 2710 can be made of elastic and can be sewn to the mat. In the alternative, strap 2710 can be made of a non-stretchable material, and one end can be sewn to the mat and another end can be attached to the mat with velcro.

Figure 28:
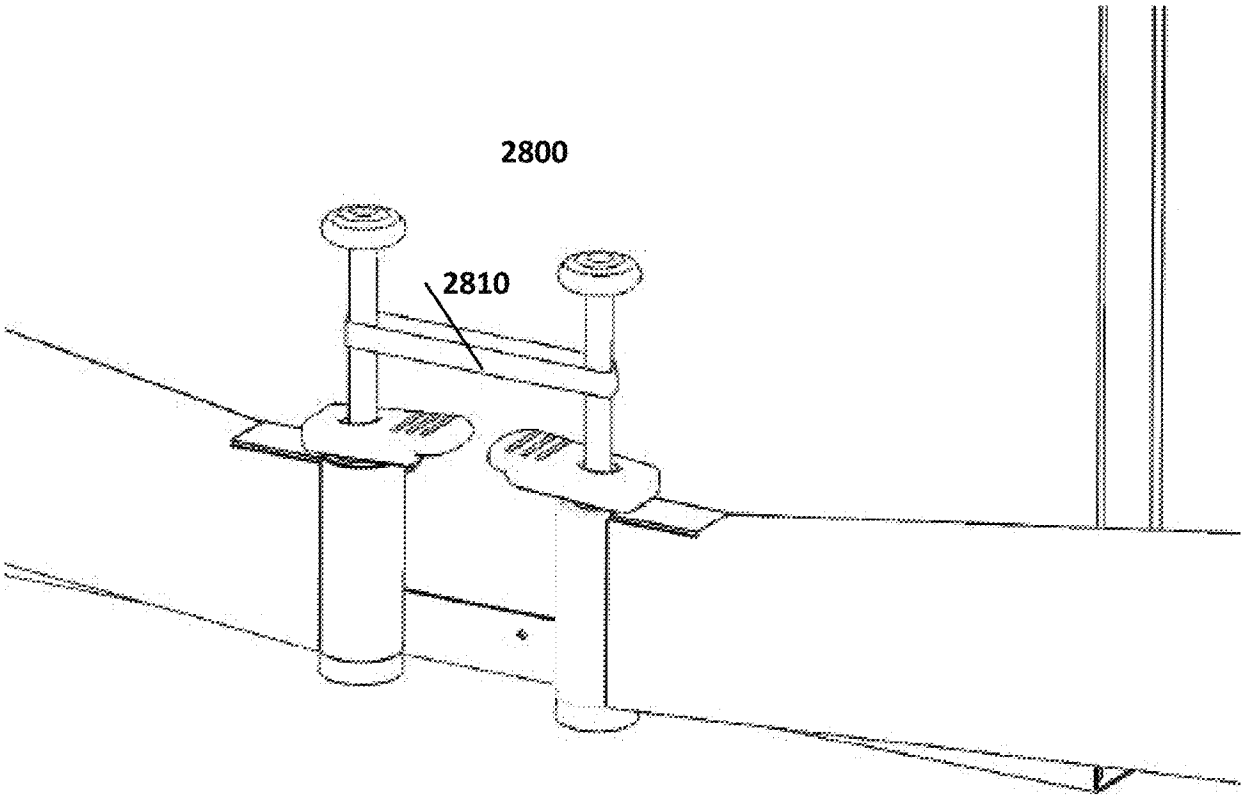
FIG. 28 depicts a strap mechanism for securing two legs in a portable exercise bar device.

With reference to FIG. 28, second strap mechanism 2800 is depicted. Second strap mechanism 2800 comprises strap 2810 that ties two legs together in the folded position. Strap 2810 is of an ideal length that prevents the legs from spreading apart when the portable exercise bar is being stored or moved. Strap 2810 can be made of elastic or similar stretchable material.

Figure 29:
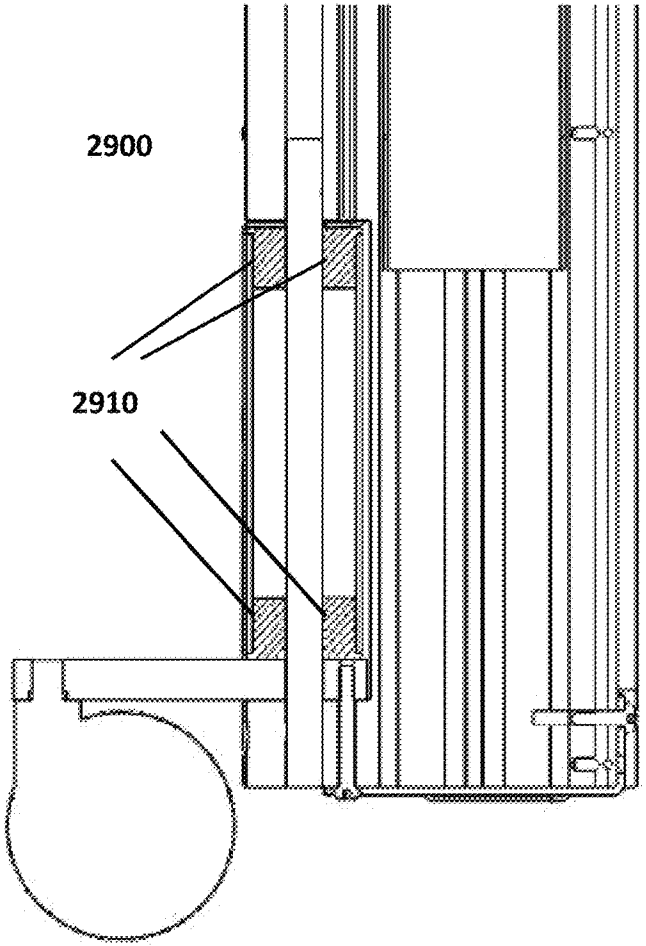
FIG. 29 depicts a friction bushing mechanism for securing a leg in a portable exercise bar device.

With reference to FIG. 29, friction bushing mechanism 2900 is depicted. Friction bushing mechanism 2900 comprises bushings 2910 that each have a larger diameter than the leg tube, which creates frictive resistance when a user tries to move the leg. This resistance keeps the legs secured in the folded position.

Figure 30:
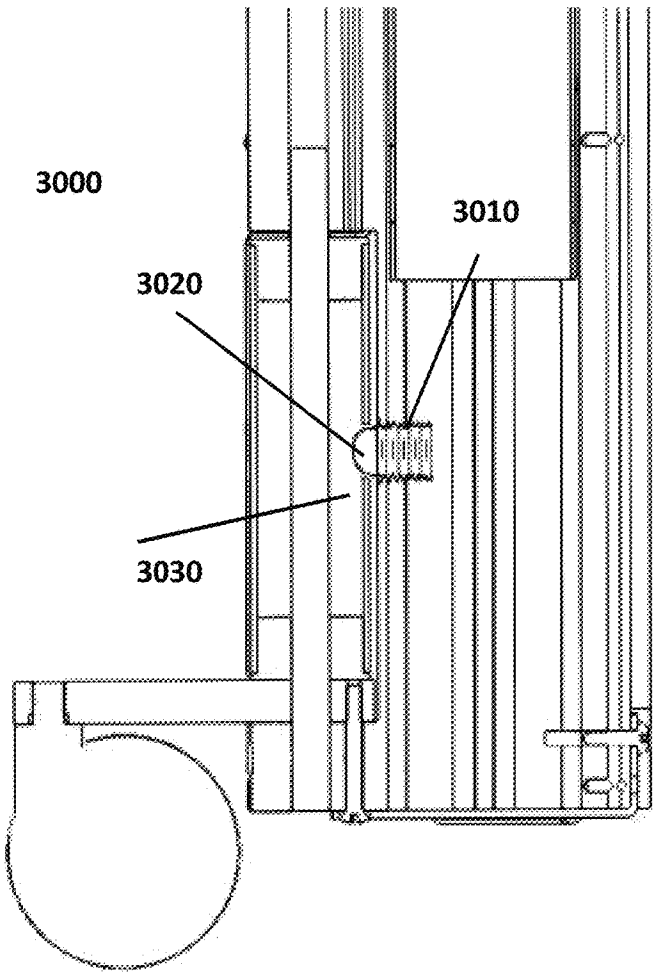
FIG. 30 depicts a spring loaded ball plunger mechanism for securing a leg in a portable exercise bar device.

With reference to FIG. 30, spring loaded ball plunger mechanism 3000 is depicted. Spring loaded ball plunger mechanism 3000 comprises spring 3010, ball 3020, and divot 3030. Spring 3010 and ball 3020 together are a spring loaded ball attached to the vertical column that are received by divot 3030 in the leg, which will then keep the leg secured to the column.

Figure 31:
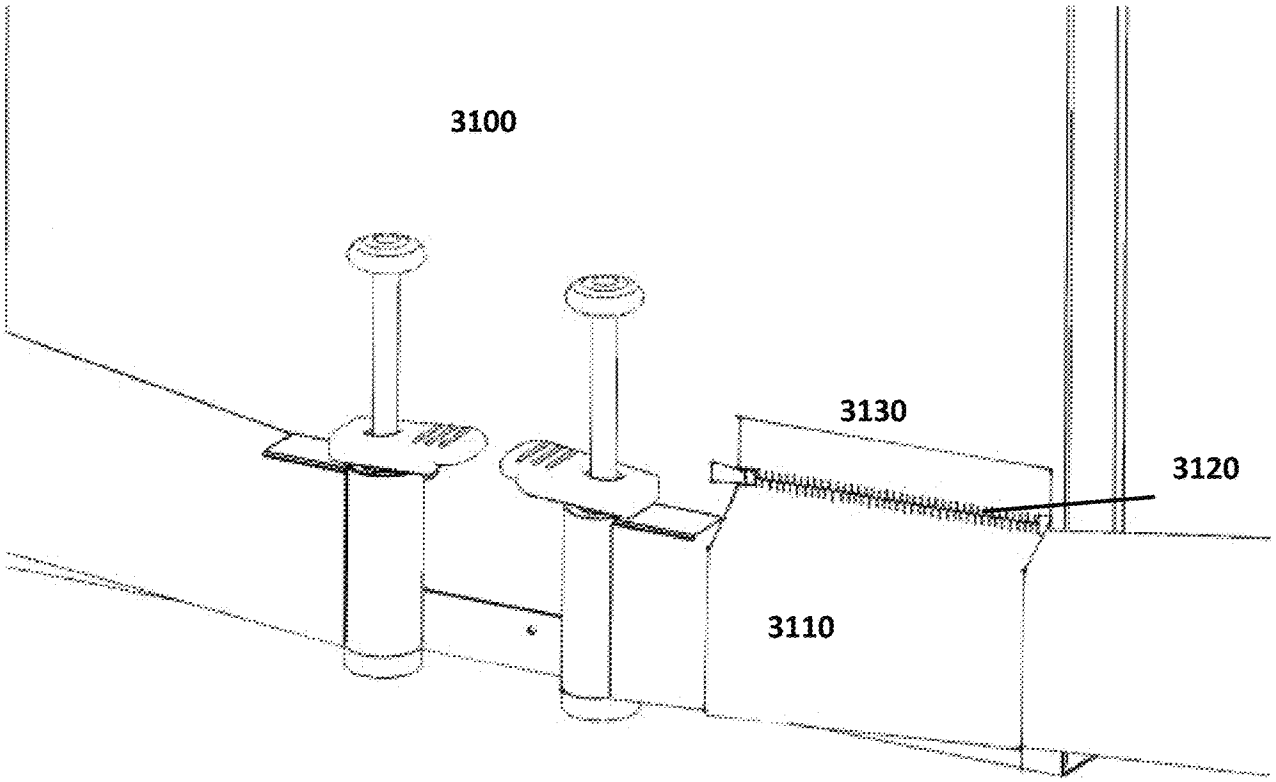
FIG. 31 depicts a zipper mechanism for securing a leg in a portable exercise bar device.

With reference to FIG. 31, zipper mechanism 3100 is depicted. Zipper mechanism 3100 comprises covering 3110 (which optionally is made of fabric) that is placed over the leg. Patch 3130 is attached to the mat, such as by being sewed onto the mat. Zipper 3120 is attached to patch 3130 and covering 3110 and can be used to secure the leg against the mat.

Figure 32B:
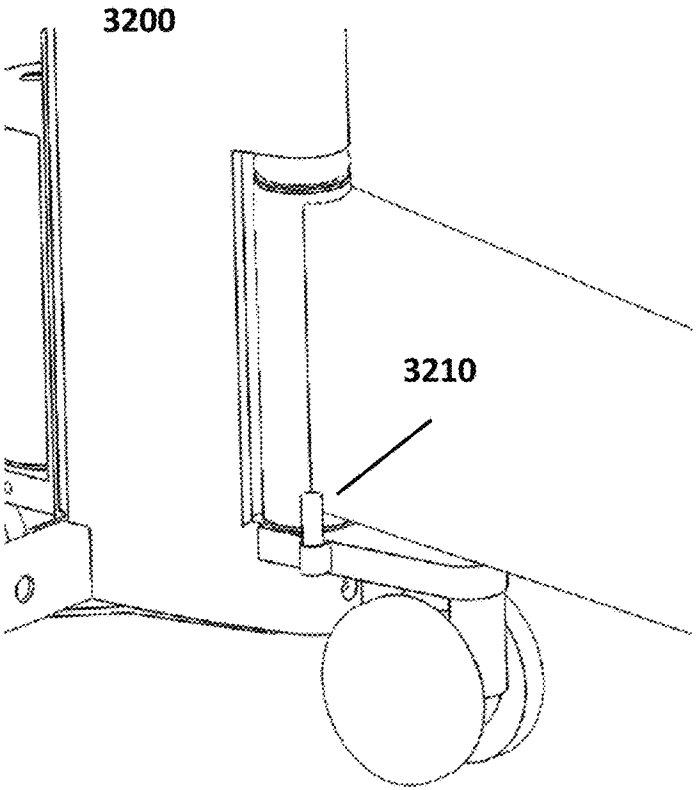
FIGS. 32A and 32B depict a lift and rotate mechanism for securing a leg in a portable exercise bar device.
Figure 32A:
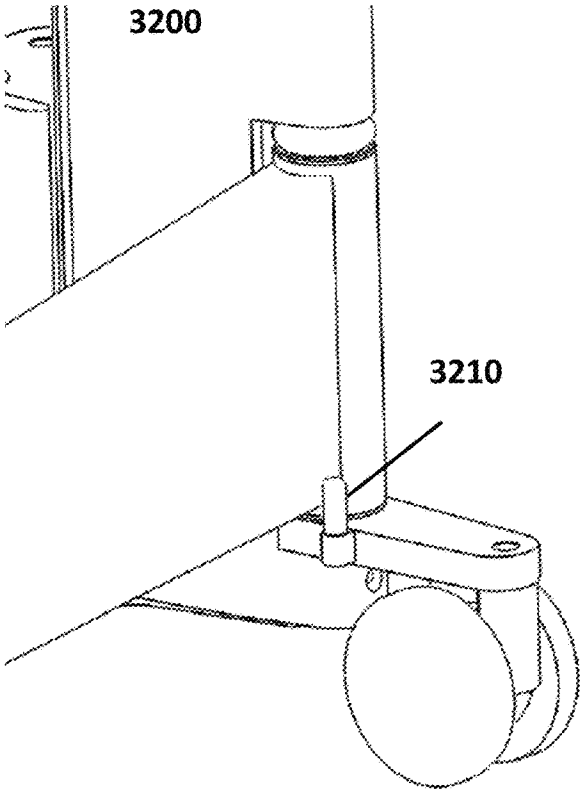

With reference to FIGS. 32A and 32B, lift and rotate mechanism 3200 is depicted. The leg needs to be lifted vertically over pin 3210 to be rotated. In FIG. 32A, the leg is in the folded position, and pin 3210 keeps the leg in place. In FIG. 32B, the leg is in an open, extended position, and pin 3210 again keeps the leg in place.

ALTERNATIVE NECK LOCKING MECHANISMS. Numerous options are possible for securing the neck of any of the embodiments described herein within the vertical column. For example, instead of using a knob that is inserted into a hole in the neck, any of the alternatives shown in FIGS. 33-36 can be used.

Figure 33:
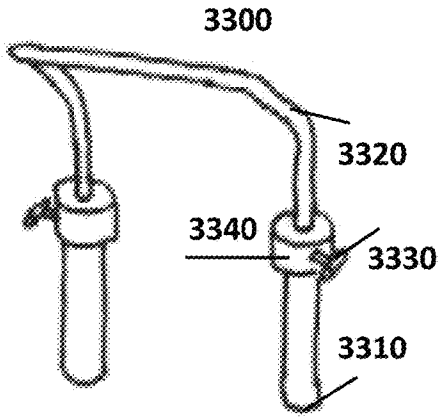
FIG. 33 depicts a collar mechanism for securing a vertical member in a portable exercise bar device.

With reference to FIG. 33, collar mechanism 3300 is depicted. Neck 3320 is inserted into vertical column 3310. Screw 3330 tightens collar 3340 around neck 3320 to hold neck 3320 in place.

Figure 34:
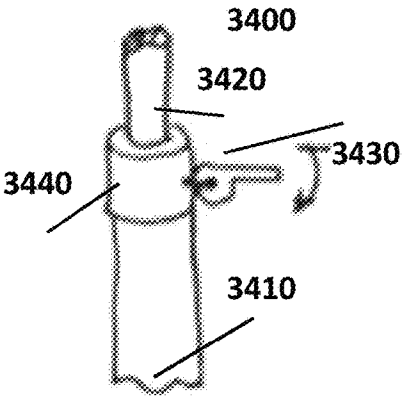
FIG. 34 depicts a cam lock pawl for securing a vertical member in a portable exercise bar device.

With reference to FIG. 34, cam lock pawl 3400 is depicted. Neck 3420 is inserted into vertical column 3410. Pawl 3430 is used to tighten collar 3440 around neck 3420 to hold neck 3420 in place.

Figure 35:
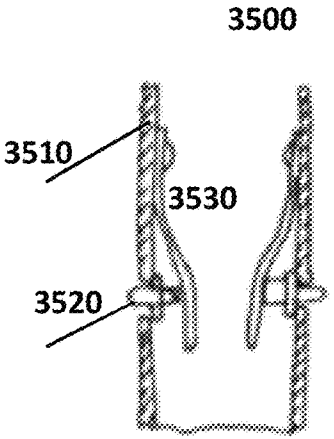
FIG. 35 depicts a spring loaded pin mechanism for securing a vertical member in a portable exercise bar device.

With reference to FIG. 35, spring loaded pin mechanism 3500 is depicted. Neck 3510 is inserted into vertical column (not shown). Pin 3520 is forced outward by spring 3530. Pin 3520 can be inserted into holes or divots in the vertical column. A user can depress pin 3520 to be able to move neck 3510 up and down within the vertical column.

Figure 36:
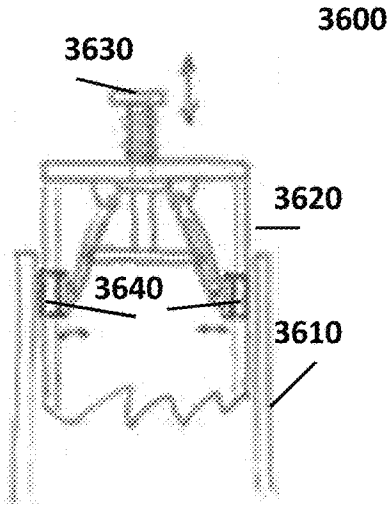
FIG. 36 depicts a push button side lock mechanism for securing a vertical member in a portable exercise bar device.

With reference to FIG. 36, push button side lock mechanism 3600 is depicted. Neck 3620 is inserted into vertical column 3610. Friction members 3640 exert force outward against the inside surface of vertical column 3610, this securing neck 3620 within vertical column 3610. A user presses button 3630 to release friction members 3640 to allow neck 3620 to move up and down within vertical column 3610.

ALTERNATIVE HORIZONTAL BAR HEIGHT ADJUSTMENT MECHANISMS. Numerous options are possible for adjusting the height of the horizontal bar of any of the embodiments described herein. For example, instead of using the vertical column, neck, and knob described above, any of the alternatives shown in FIGS. 37-49 can be used.

Figure 37:
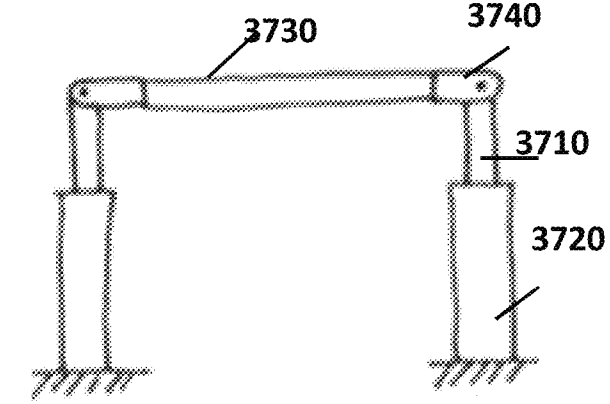
FIG. 37 depicts an independent adjustment mechanism for adjusting the height of a horizontal bar in a portable exercise bar device.

With reference to FIG. 37, independent adjustment mechanism 3700 is depicted. Neck 3710 can be moved up and down within vertical column 3720 to raise or lower one end of horizontal bar 3730, which connects to neck 3710 through joint 3740. Thus, each side of horizontal bar 3730 can be moved up or down independently of the other side.

Figure 38:
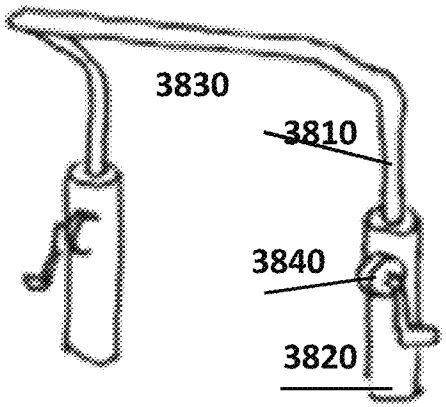
FIG. 38 depicts a screw jack mechanism for adjusting the height of a horizontal bar in a portable exercise bar device.

With reference to FIG. 38, screw jack mechanism 3800 is depicted. Neck 3810 can be moved up and down within vertical column 3820 to raise or lower horizontal bar 3830. The movement occurs by rotating reel 3830, which turns a screw (not shown) that is coupled to a screw portion (not shown) of neck 3810.

Figure 39:
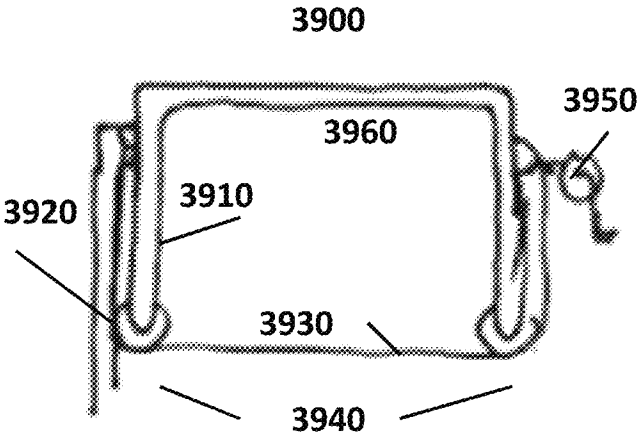
FIG. 39 depicts a cable lift mechanism for adjusting the height of a horizontal bar in a portable exercise bar device.

With reference to FIG. 39, cable lift mechanism 3900 is depicted. Neck 3910 can be moved up or down within vertical column 3920 by winding or unwinding cable 3930 with reel 3950. The other end of cable 3930 is attached to vertical column 3920. The cable is supported by pulleys 3940 located at the bottom of each neck 3920.

Figure 40:
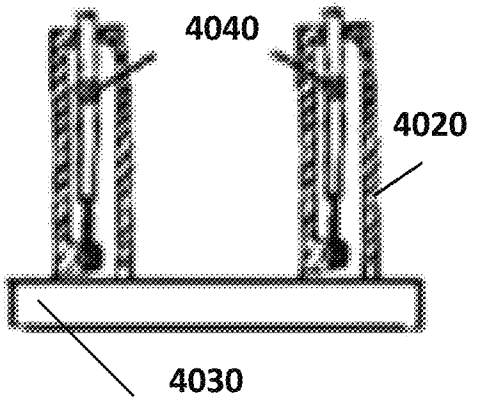
FIG. 40 depicts a gas cylinder lift for adjusting the height of a horizontal bar in a portable exercise bar device.

With reference to FIG. 40, gas cylinder lift 4000 is depicted. Neck 4010 can be moved up or down within vertical column 4020. Vertical column 4020 is attached to base 4030. Valve 4040 allows a user to pump gas into, or release gas from, the chamber created by neck 4010, vertical column 4020, and base 4030, thus causing neck 4010 to move upward or downward.

Figure 41:
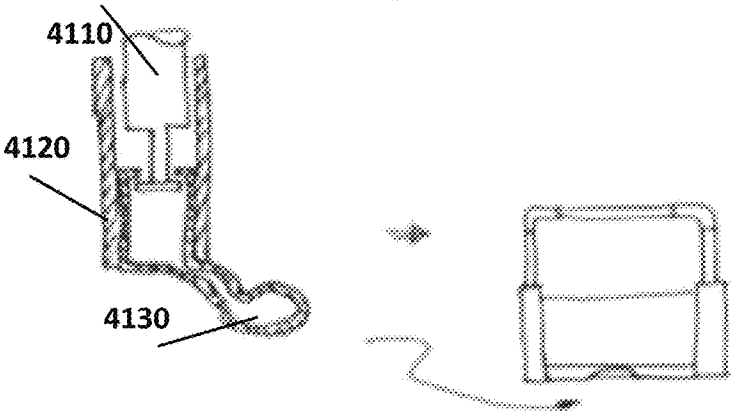
FIG. 41 depicts a foot pump lift for adjusting the height of a horizontal bar in a portable exercise bar device.

With reference to FIG. 41, foot pump lift 4010 is depicted. Neck 4110 can be moved up or down within vertical column 4120. Foot pump 4030 allows a user to pump air into, or release air from, the chamber created by neck 4110 and vertical column 4120, thus causing neck 4110 to move upward or downward.

Figure 42:
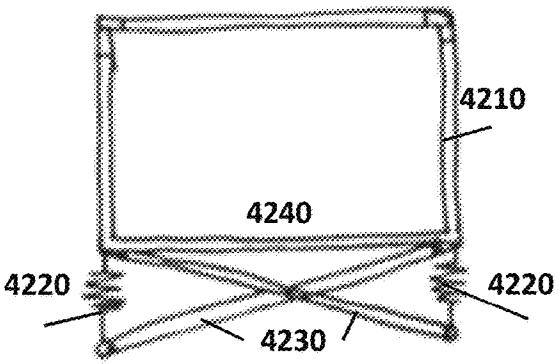
FIG. 42 depicts a spring lift mechanism for adjusting the height of a horizontal bar in a portable exercise bar device.

With reference to FIG. 42, spring lift mechanism 4200 is depicted. Vertical column 4210 is moved upward or downward by springs 4220 and scissors support 4230, where springs 4220 and scissors support 4230 are connected to cross bar 4250, which in turn is connected to vertical column 4210.

Figure 43:
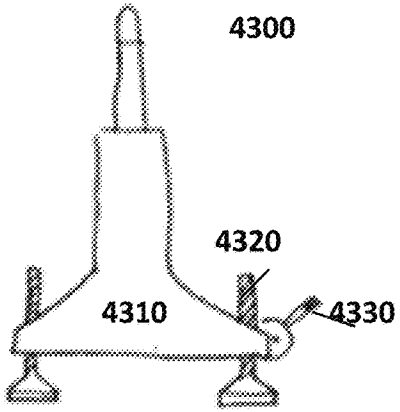
FIG. 43 depicts a foot lift for adjusting the height of a horizontal bar in a portable exercise bar device.

With reference to FIG. 43, foot lift mechanism 4300 is depicted. Vertical support structure 4310 is moved upward or downward by the movement by a user of lever 4330. Lever 4330 contains a screw portion that interacts with screw 4320 that is attached to vertical support structure 4310. Lever 4330 thus causes vertical support structure 4310 to move upward or downward.

Figure 44:
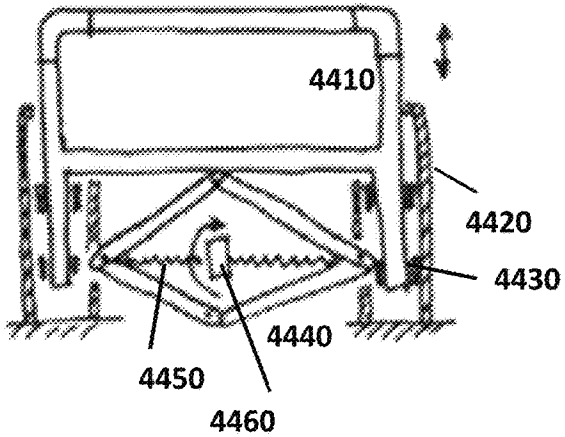
FIG. 44 depicts a center lift mechanism for adjusting the height of a horizontal bar in a portable exercise bar device.

With reference to FIG. 44, center lift mechanism 4400 is depicted. Neck 4410 can be moved up or down within vertical column 4420. Friction pads 4430 keep neck 4410 in place. The user can turn push lever 4460, which causes member 4450 to pull supportive pins out of vertical column 4420 so that neck 4410 can move upward or downward. This is convenient because a user could move neck 4410 (and its counterpart neck on the other side) up or down using a single hand mechanism.

Figure 45:
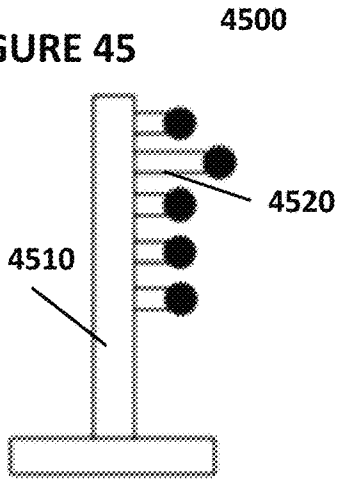
FIG. 45 depicts a multiple bar mechanism for a portable exercise bar device.

With reference to FIG. 45, multiple bar mechanism 4500 is depicted. Vertical column 4510 supports a plurality 4520 of horizontal bars, each located at a different height.

Figure 46:
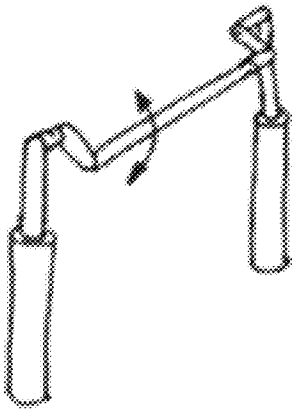
FIG. 46 depicts a rotating bar mechanism for a portable exercise bar device.

With reference to FIG. 46, rotating bar mechanism 4600 is depicted. Neck 4610 is supported by vertical column 4620 and is attached to horizontal bar 4630 through joint 4640. A user can move horizontal bar 4630 around joint 4640 to adjust the vertical height and horizontal placement of horizontal bar 4630.

Figure 47:
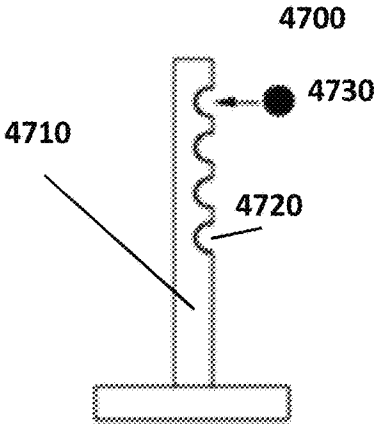
FIG. 47 depicts a multiple slot mechanism for a portable exercise bar device.

With reference to FIG. 47, multiple slot mechanism 4700 is depicted. Vertical column 4710 (or vertical neck) contains a plurality 4720 of slots, each located at a different height, into which horizontal bar 4730 can be placed.

Figure 48:
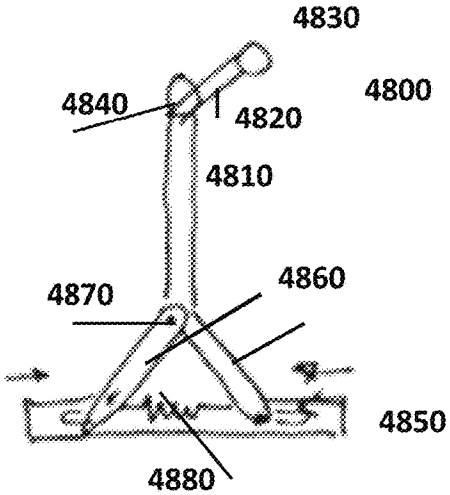
FIG. 48 depicts a multiple bar linkage mechanism for a portable exercise bar device.

With reference to FIG. 48, multiple bar linkage mechanism 4800 is depicted. Neck 4820 is connected to vertical column 4810 through joint 4840. Neck 4820 supports horizontal bar 4830. Vertical column 4810 is supported by dual support members 4860, which are connected to one another at joint 4870 and by spring 4880. Dual support members 4860 can move within base 4870 and can be locked in place through mechanical means within base 4870.

Figure 49:
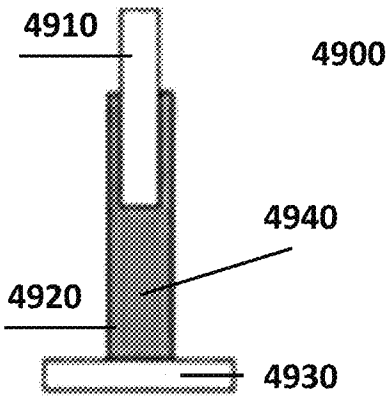
FIG. 49 depicts a damping grease mechanism for a portable exercise bar device.

With reference to FIG. 49, damping grease mechanism 4900 is depicted. Neck 4910 can move up or down within vertical column 4920, which is supported by base 4930. The chamber formed by neck 4910, vertical column 4920, and base 4930 is filled with grease 4940. Grease 4940 provides a damping effect that keeps neck 4910 in a fixed position.

ALTERNATIVE HORIZONTAL BAR HEIGHT SLIDING ADJUSTMENT MECHANISMS. Numerous sliding options are possible for adjusting the height of the horizontal bar of any of the embodiments described herein. For example, instead of using the vertical column, neck, and knob, any of the alternatives shown in FIGS. 50-52 can be used.

Figure 50:
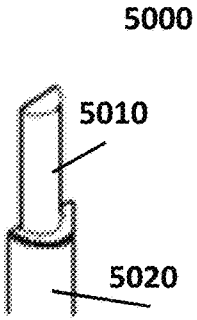
FIG. 50 depicts an extrusion in extrusion mechanism for sliding a horizontal bar vertically in a portable exercise bar device.

With reference to FIG. 50, an extrusion-in-extrusion mechanism 5000 is depicted. Neck 5010 slides within vertical column 5020. Neck 5010 and vertical column 5020 are sized to optimize the amount of friction between them, such that neck 5010 can slide when force is applied but will remain stationary when no force (other than gravity) is applied.

Figure 51:
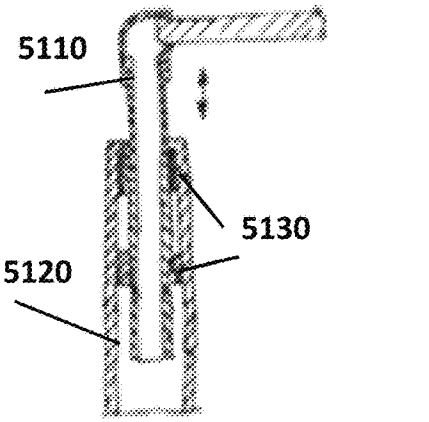
FIG. 51 depicts a stock tubing with rollers mechanism for sliding a horizontal bar vertically in a portable exercise bar device

With reference to FIG. 51, a stock tubing with rollers mechanism 5100 is depicted. Neck 5110 slides within vertical column 5120. Rollers 5130 assist in the movement and minimize the amount of force the user must exert to move neck 5110 up and down.

Figure 52:
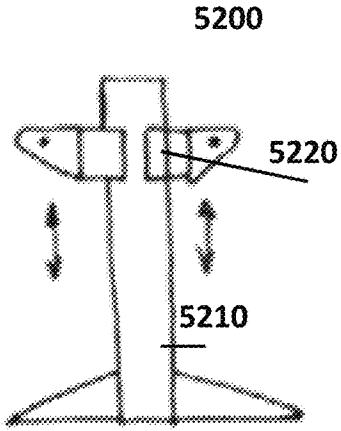
FIG. 52 depicts an external carriage mechanism for sliding a horizontal bar vertically in a portable exercise bar device

With reference to FIG. 52, external carriage mechanism 5200 is depicted. Carriage 5220 slides up and down vertical column 5210 using bearings or wheels (not shown). Carriage 5220 holds one end of a horizontal bar (not shown).

ALTERNATIVE HORIZONTAL BAR ADJUSTMENT MECHANISMS. Numerous adjustment options are possible for the horizontal bar of any of the embodiments described herein. For example, instead of placing the horizontal bar in a fixed position within the neck, any of the alternatives shown in FIGS. 53-55 can be used. This may be useful for collapsing, moving, storing, and/or stacking the portable exercise bar.

Figure 53:
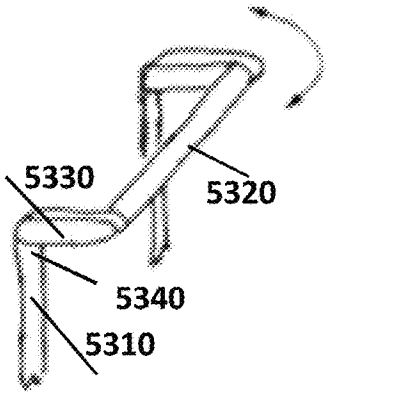
FIG. 53 depicts a rotating bar for a portable exercise bar device.

With reference to FIG. 53, rotating bar 5300 is depicted. Neck 5310 connects to support member 5330 through joint 5340. Support member 5330 holds one end of horizontal bar 5320. Horizontal bar 5320 can rotate about joint 5340.

Figure 54:
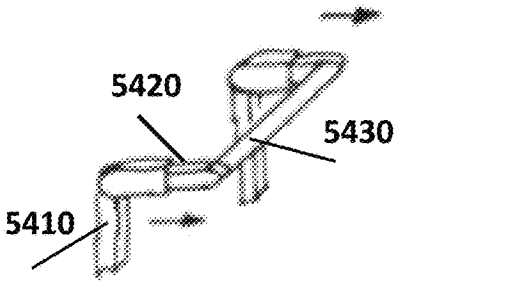
FIG. 54 depicts a telescoping bar for a portable exercise bar device.

With reference to FIG. 54, telescoping bar 5400 is depicted. Horizontal bar 5430 is connected to supporting member 5420, which is slidable within neck 5410. Thus, horizontal bar 5430 can be moved toward the user or away from the user.

Figure 55:
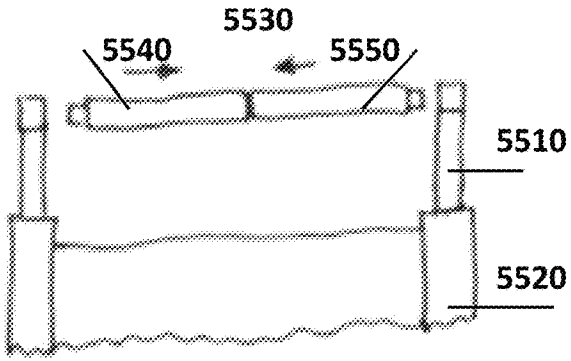
FIG. 55 depicts a removable bar for a portable exercise bar device.

With reference to FIG. 55, removable bar mechanism 5500 is depicted. Neck 5510 slides within vertical column 5520. Horizontal bar 5530 comprises two pieces, first member 5540 and second member 5550. Second member 5550 is slightly smaller in diameter and can fit within first member 5540. A spring is placed between the inside structures of first member 5540 and second member 5550 to exert force in the outer direction toward the neck 5510 on each side. Thus, the user can push first member 5540 and second member 5550 together to remove the horizontal bar 5530 from the neck 5510 on each side for storage.

ALTERNATIVE LEG MECHANISMS. Numerous alternative leg mechanisms are possible for any of the embodiments described herein, including the alternatives shown in FIGS. 56-57.

Figure 56:
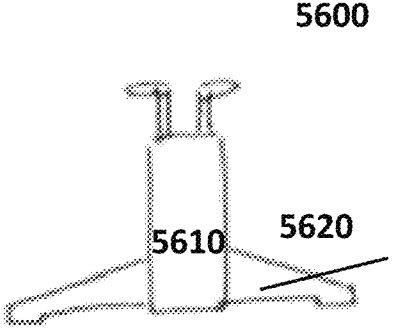
FIG. 56 depicts a fixed leg mechanism for a portable exercise bar device.

With reference to FIG. 56, fixed leg mechanism 5600 is depicted. Leg 5620 is fixed in a non-movable fashion to vertical column 5610. There are at least four legs of the type leg 5620.

Figure 57:
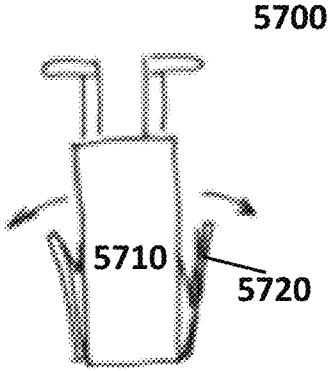
FIG. 57 depicts a folding leg mechanism for a portable exercise bar device.

With reference to FIG. 57, folding leg mechanism 5700 is depicted. Leg 5720 folds up vertically toward vertical column 5710 and can fold down toward the floor.

ALTERNATIVE BACKBOARD AND FLOORBOARD CONFIGURATIONS. Numerous alternatives exist for connecting the backboard and floorboard for any of the embodiments described herein, including the alternatives shown in FIGS. 58-60.

Figure 58:
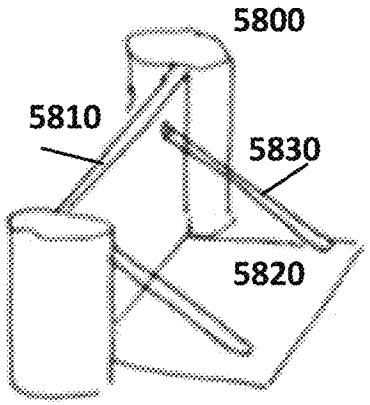
FIG. 58 depicts a fixed floorboard mechanism for a portable exercise bar device.

With reference to FIG. 58, fixed floor board mechanism 5800 is depicted. Floorboard 5820 is connected to backboard 5810 through a fixed support member 5930.

Figure 59:
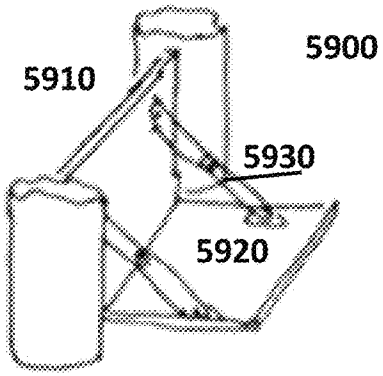
FIG. 59 depicts a fold down floorboard mechanism for a portable exercise bar device.

With reference to FIG. 59, fold down floorboard mechanism 5900 is depicted. Floorboard 5820 is connected to backboard 5910 through a hinged support member 5930, which allows floorboard 5820 to fold up toward backboard 5910 or to fold down toward the floor.

Figure 60:
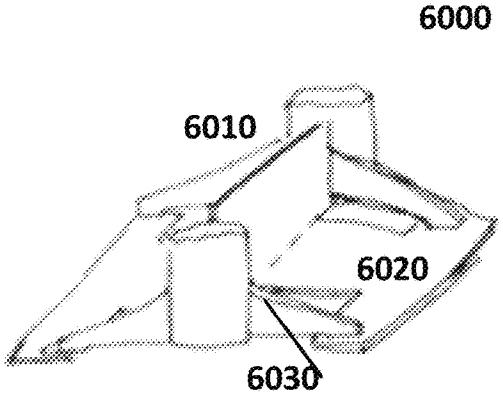
FIG. 60 depicts an extended floorboard for a portable exercise bar device.

With reference to FIG. 60, extended floorboard mechanism 6000 is depicted. Floorboard 6020, when folded to the floor extends in the right and left directions such that parts of floorboard 6020 are captured under each leg 6030. Floorboard 6020 also is attached to backboard 6010 through a hinge or other means.

ALTERNATIVE WHEEL CONFIGURATIONS. Numerous alternatives exist for wheel configurations of any of the embodiments described herein, including the alternatives shown in FIGS. 61-62.

Figure 61:
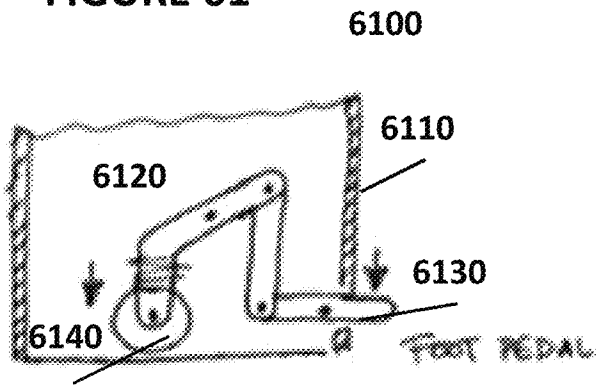
FIG. 61 depicts a retractable wheel mechanism for a portable exercise bar device.

With reference to FIG. 61, retractable wheel mechanism 6100 is depicted. Wheel apparatus 6120 is contained within vertical column 6110. Wheel apparatus 6120 comprises a pedal 6130 and wheel 6140. When pedal 6130 is pressed toward the floor, wheel 6140 is moved toward the floor and can be locked in that position to enable vertical column 6110 to roll on the floor.

Figure 62:
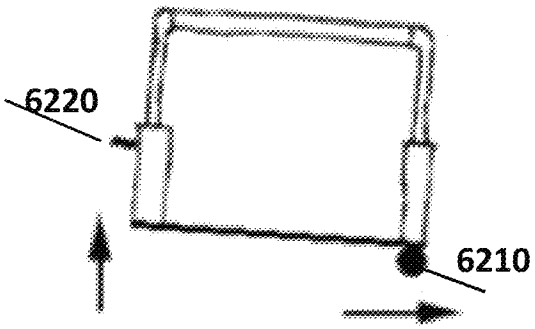
FIG. 62 depicts a wheel mechanism for a portable exercise bar device.

With reference to FIG. 62, single set of wheels mechanism 6200 is depicted. Wheels 6210 are installed only on one side of the portable exercise bar device. Handle 6220 is installed on the other side of the portable exercise bar device. The user can lift handle 6220 and toll the device using wheels 6210.

ALTERNATIVE FOOT LEVEL LOCK AND RETRACTION MECHANISM. Numerous alternatives exist for the foot mechanism of any of the embodiments described herein, including the alternative shown in FIG. 63.

Figure 63:
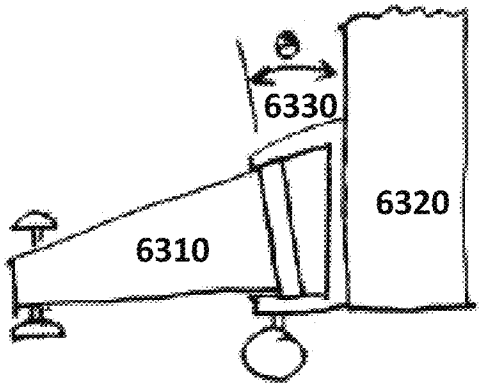
FIG. 63 depicts a bracket for attaching a leg to a vertical column in a portable exercise bar device.

With reference to FIG. 63, mechanism 6300 is shown. Leg 6310 is connected to vertical column 6320 through angled bracket 6330. Angled bracket 6330 allows leg 6310 to rotate toward vertical column 6320 when leg 6310 is folded inward to provide more clearance with the floor when leg 6310 is in the folded position. In the extended position, leg 6310 can be forced outward by an internal leaf spring or coiled spring, by scissor jacks, by conical springs (which would cause reduced internal stack height), which pushes leg 6310 toward the floor, reducing the need for feet (such as foot mechanisms 181, 182, 183, and 184). Angled bracket 6330 can be designed in a ratcheting configuration so that it angles upward in discrete steps.

ALTERNATIVE HORIZONTAL BAR MOUNTING METHODS. Numerous alternatives exist for mounting the horizontal bar of any of the embodiments described herein, including the alternative shown in FIGS. 64-66.

Figure 64:
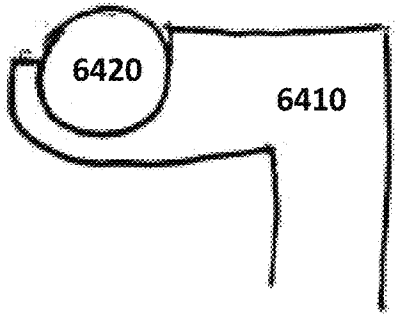
FIG. 64 depicts an underneath mounting method for a horizontal bar in a portable exercise bar device.

With reference to FIG. 64, an underneath mounting method 6400 is depicted. Support structure 6410 supports the underside of horizontal bar 6420.

Figure 65:
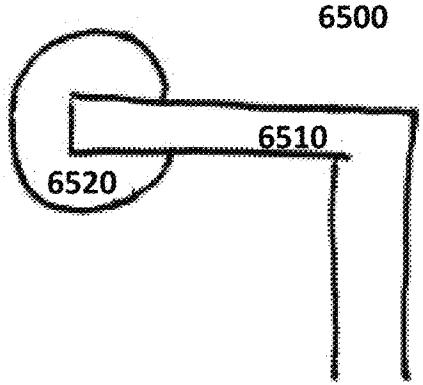
FIG. 65 depicts a center mounting method for a horizontal bar in a portable exercise bar device.

With reference to FIG. 65, a center mounting method 6500 is depicted. Support structure 6510 is attached to the center of horizontal bar 6520, such as through a screw or a bar that runs through the entire middle of horizontal bar 6520 (to another support structure 6510 on the opposite end of horizontal bar 6520.

Figure 66:
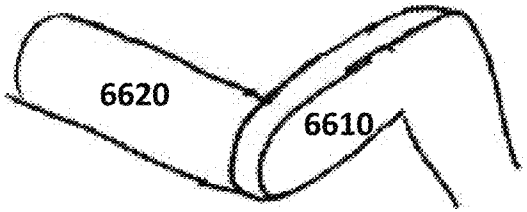
FIG. 66 depicts an end mounting method for a horizontal bar in a portable exercise bar device.

With reference to FIG. 66, an end mounting method 6600 is depicted. Support structure 6510 is attached to the end face of horizontal bar 6620. Support structure 6510 can include a recess for receiving the end of horizontal bar 6620. Optionally, a screw can be inserted through support structure 6510 into horizontal bar 6620.

With reference to FIG. 67, a leg mounting mechanism 6700 is shown. Leg 6710 attaches to shaft 6720, which attaches to bracket 6730, which attaches to vertical column 6740. Bracket 6730 prevent leg 6710 from extending beyond the position where the 6710 is parallel with a floorboard in the unfolded position (i.e., it prevents over-extension of the leg).

Figure 68:
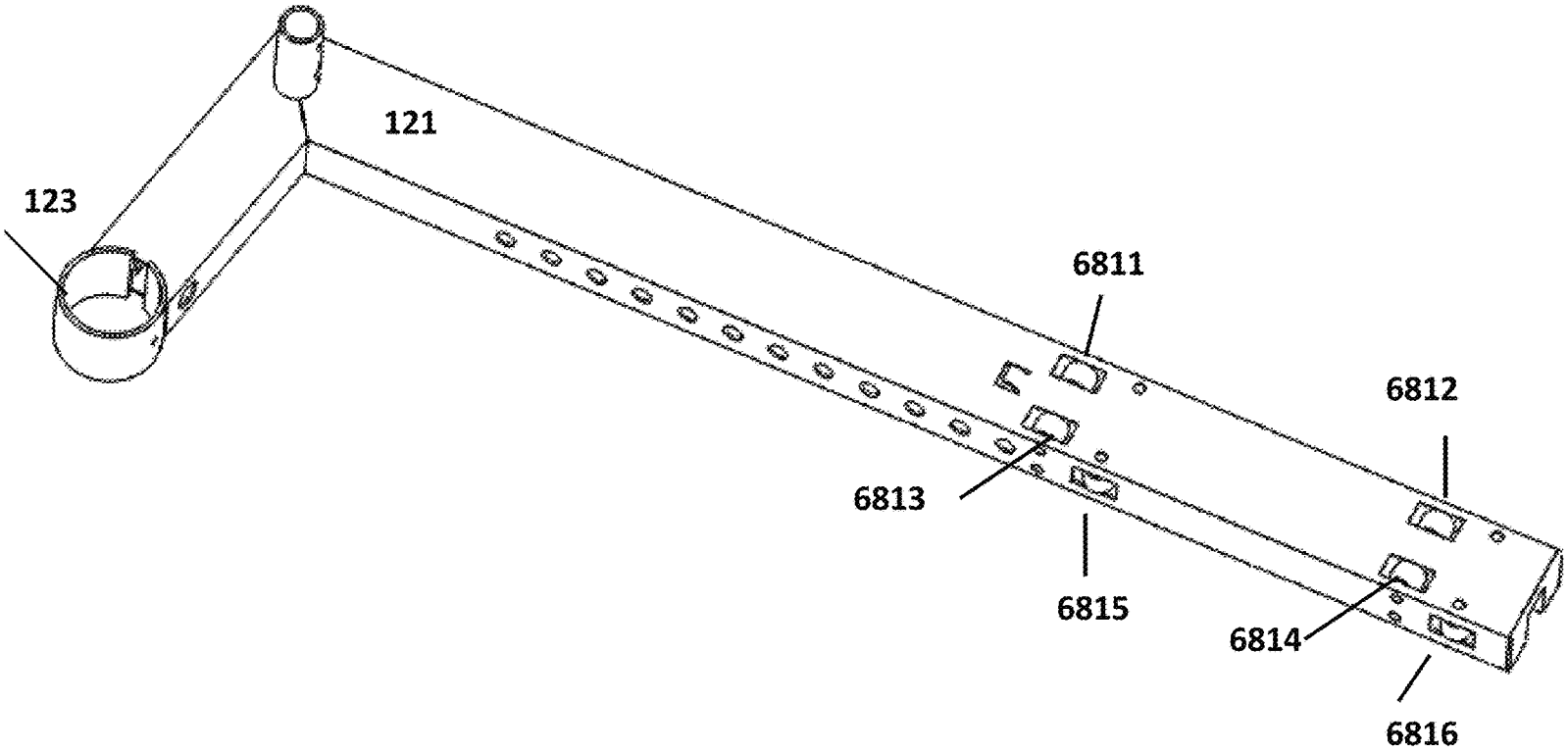
FIG. 68 depicts a side view of a neck for use in a portable exercise bar device.
Figure 69:
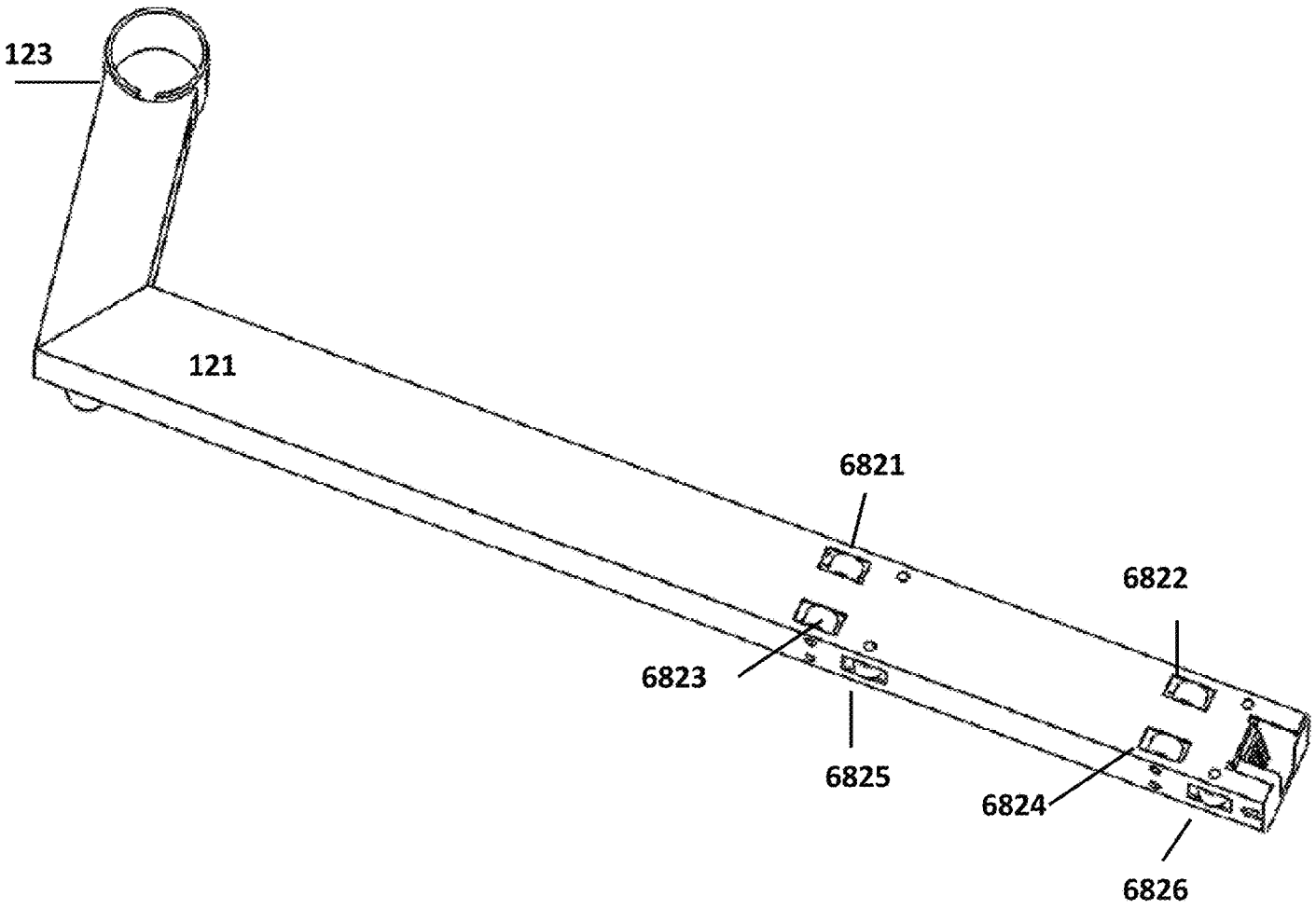
FIG. 69 depicts an opposite side view of the neck from FIG. 68 for use in a portable exercise bar device.

OPTIONAL NECK AND VERTICAL COLUMN DESIGNS. With reference to FIG. 68, an embodiment of neck 121 is depicted. In this embodiment, neck 121 comprises wheels 6811, 6812, 6813, and 6814 on a first side and wheels 6815 and 6816 on a second side. With reference to FIG. 69, an opposite side of neck 121 is depicted. Neck 121 further comprises wheels 6821, 6822, 6823, and 6824 on a third side and wheel 6825 and 6826 on a fourth side.

Figure 70:
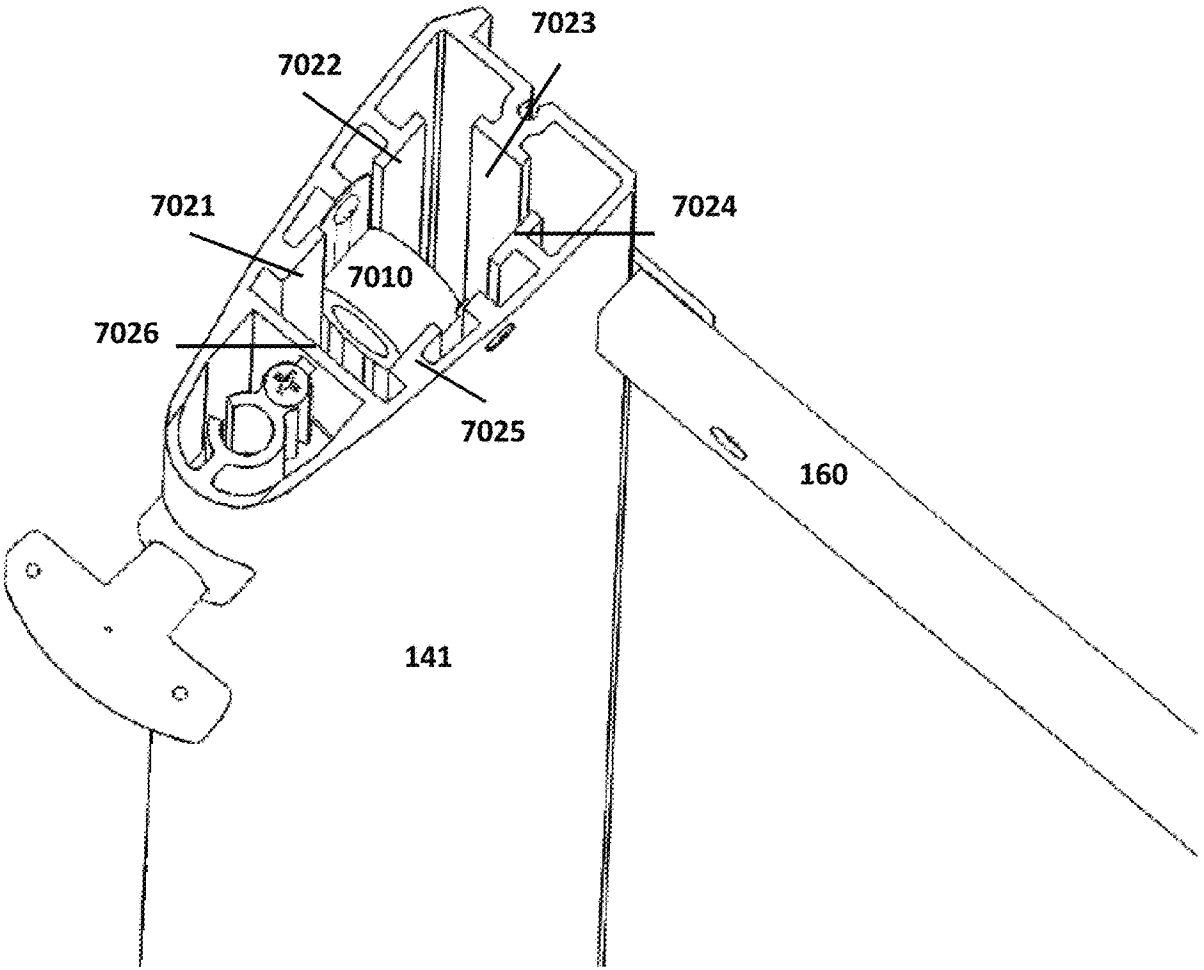
FIG. 70 depicts a top view of a vertical column for receiving the neck from FIG. 68-69 for use in a portable exercise bar device.

With reference to FIG. 70, an embodiment of vertical column 141 is depicted. Vertical column 141 is designed to receive the embodiment of neck 121 shown in FIGS. 68 and 69. Vertical column 141 comprises constant force spring 7010, wall 7026, and wall segments 7021, 7022, 7023, 7024, and 7025. Wall 7026 is configured to receive wheels 6815 and 6816, wall segment 7021 is configured to receive wheels 6821 and 6822, wall segment 7022 is configured to receive wheels 6823 and 6824, wall segment 7023 is configured to receive wheels 6825 and 6826, wall segment 7024 is configured to receive wheels 6811 and 6812, and wall segment 7025 is configured to receive wheels 6813 and 6814.

Figure 71:
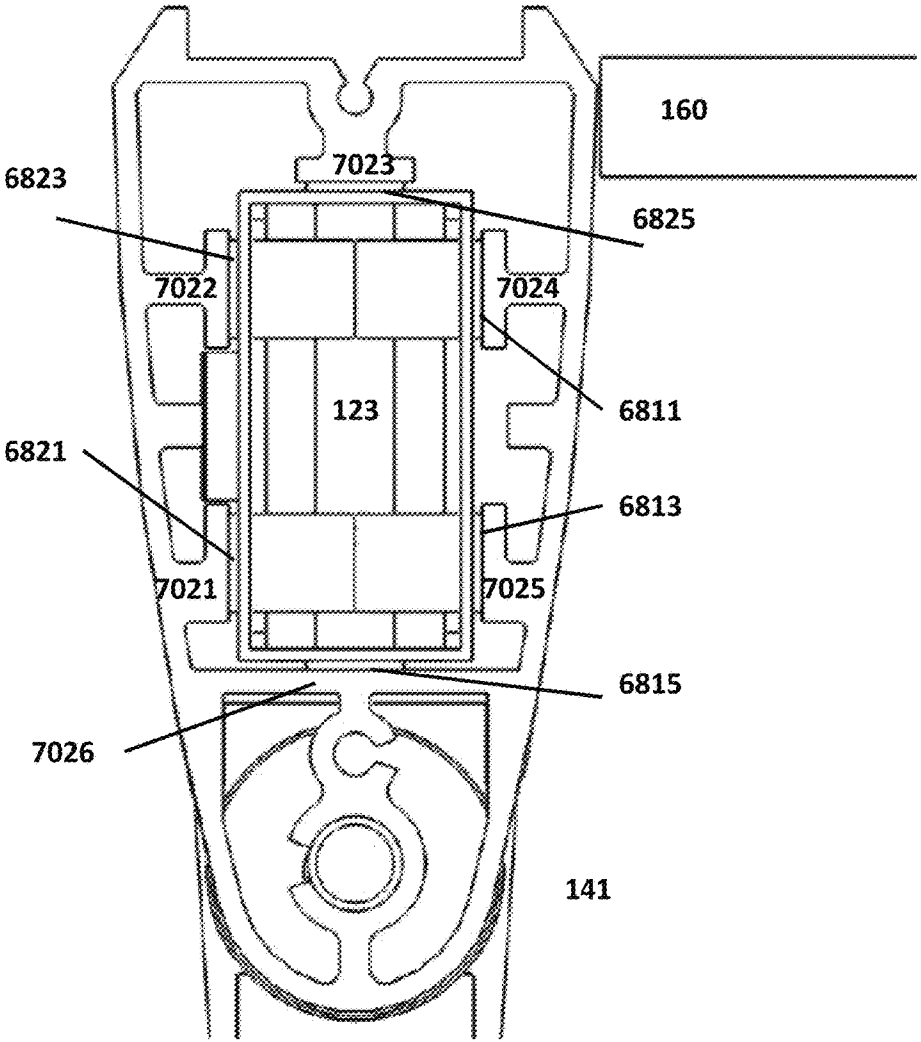
FIG. 71 depicts a top view of a vertical column and a neck for use in a portable exercise bar device.

With reference to FIG. 71, another top view of vertical column 141 is depicted, this time with neck 121 within vertical column 141. Wheels 6815, 6821, 6823, 6825, 6811, and 6813 are shown in contact with wall 7026 and wall segments 7021, 7022, 7023, 7024, and 7025, respectively.

Figure 72:
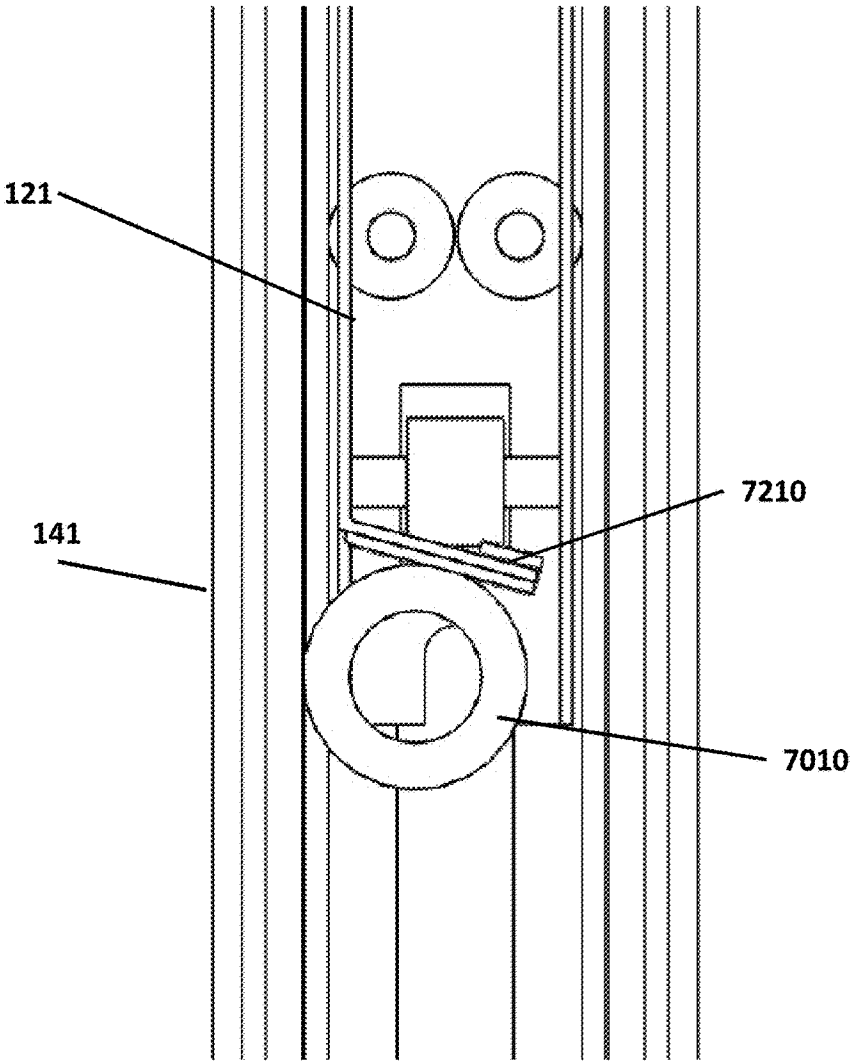
FIG. 72 depicts a cross-section from a front view of a constant force spring for exerting force against a neck within a vertical column for use in a portable exercise bar device.
Figure 73:
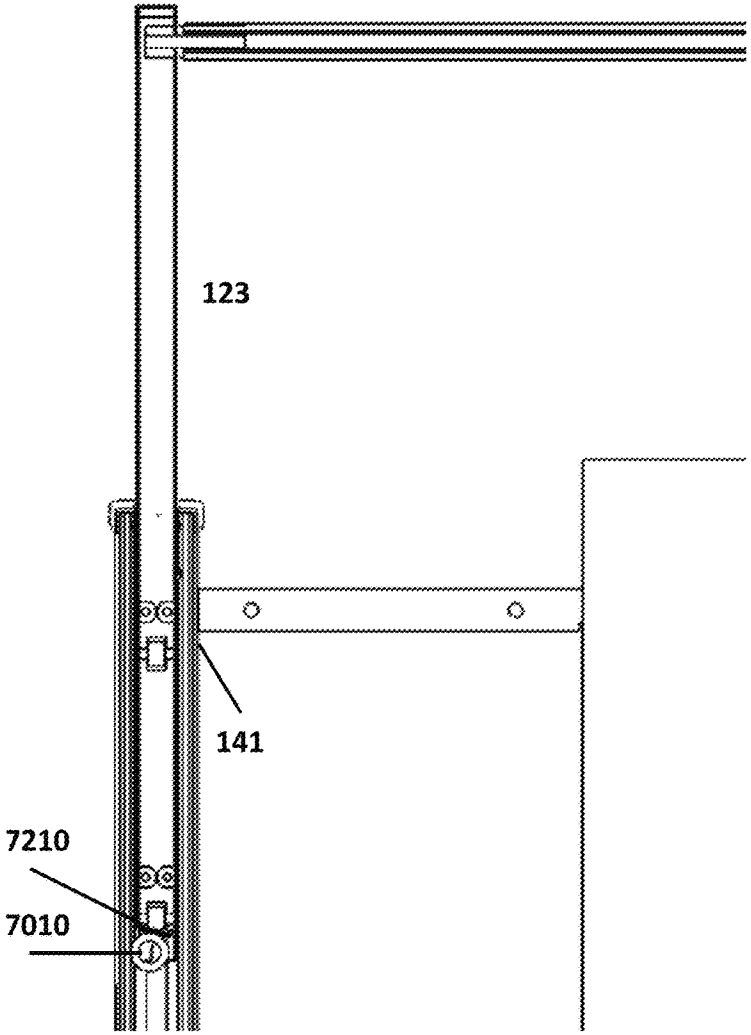
FIG. 73 depicts a cross-section from a front view of a constant force spring for exerting force against a neck within a vertical column for use in a portable exercise bar device.

With reference to FIG. 72, a cross-section side view of vertical column 141 and neck 121 is shown. Neck 121 comprises diagonal piece 7210, against which constant force spring 7010 is in contact. With reference to FIG. 73, the same view is shown but from a greater distance. During operation, when a user pushes neck 121 downward, constant force spring 7010 is elongated. When the user pulls neck 123 upward, constant force spring 7010 is retracted. The force exerted by constant force spring 7010 serves as a counterbalance to the weight of neck 123 itself as well as horizontal bars 110 and 210. This makes it easier for the user to adjust horizontal bar 110 to the correct height with minimal exertion and it also prevents horizontal bar 110 from dropping quickly when knobs 141 and 142 are pulled outward.

Figure 74:
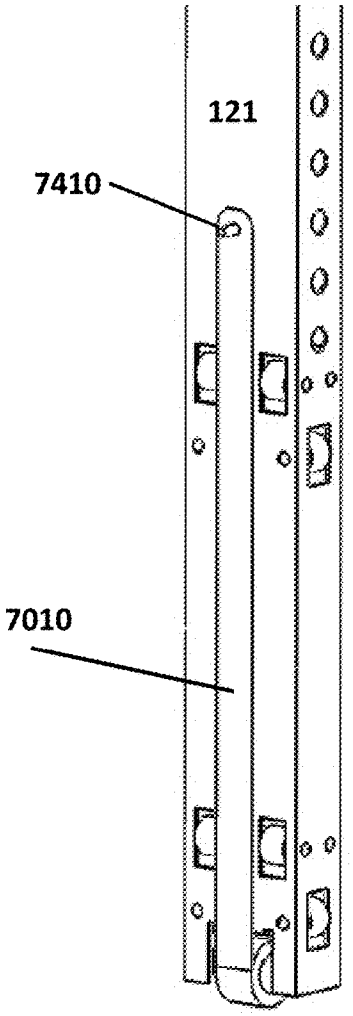
FIG. 74 depicts a side view of a constant force spring attached to a neck for use in a portable exercise bar device.

With reference to FIG. 74, neck 121 is shown with constant force spring 7010 partially elongated. Constant force spring 7010 attaches to vertical column 141 with attachment 7410 (which can be a pin, bolt, hook, etc.).

It is to be understood that the design of FIGS. 68 through 74 can be applied to any neck and any vertical column of the embodiments described herein, and that typically, a portable bar exercise device will contain such designs, if used at all, in all of its necks and vertical columns.

MATERIALS. The horizontal bars described above, such as horizontal bars 110, 210, 1010, 1210, and 1510, can be constructed of wood, plastic, metal, or other materials. The crossbars bars described above, such as crossbars 160, 1060, 1080, and 1560, can be constructed of wood, plastic, metal, or other materials. The floorboards described above, such as floorboards 150 and 1550, can be constructed of wood, plastic, metal, or other materials. The backboards describe above, such as backboards 230, 1220, and 1720, can be constructed of word, plastic, metal, or other materials. The backboards each can comprise a vacuum-formed back plate, a perforated metal back plate, a honeycomb plastic backboard, roto-molded plastic, or a fabric, lawn chair-type backboard. The mats described above, such as mats 610, 1110, and 1910, each can comprise a laminate plastic/rubber structure attached to a floorboard or backboard, the backboard, or each can be created using self-skinning foam. All other structures can be constructed of wood, plastic, metal, or other materials.

References to the present invention herein are not intended to limit the scope of any claim or claim term, but instead merely make reference to one or more features that may be covered by one or more of the claims. Materials, processes and numerical examples described above are exemplary only, and should not be deemed to limit the claims. It should be noted that, as used herein, the terms "over" and "on" both inclusively include "directly on" (no intermediate materials, elements or space disposed there between) and "indirectly on" (intermediate materials, elements or space disposed there between). Likewise, the term "adjacent" includes "directly adjacent" (no intermediate materials, elements or space disposed there between) and "indirectly adjacent" (intermediate materials, elements or space disposed there between). For example, forming an element "over a substrate" can include forming the element directly on the substrate with no intermediate materials/elements there between, as well as forming the element indirectly on the substrate with one or more intermediate materials/elements there between.

What is claimed is:

1. A portable exercise device, comprising:
a first horizontal bar with a first end and second end;
a first neck attached to the first end;
a second neck attached to the second end;
a first supporting structure for receiving the first neck, wherein the first neck is movable within the first supporting structure to alter the vertical height of the first horizontal bar;
a second supporting structure for receiving the second neck, wherein the second neck is movable within the second supporting structure to alter the vertical height of the first horizontal bar;
a second bar attached to the top of the first supporting structure and the top of the second supporting structure;
a third bar substantially parallel to the second bar and coupled to the first supporting structure and the second supporting structure;
a backboard attached to the second bar and third bar; and
a floorboard attached to the backboard with a hinge;
wherein the backboard prevents the second bar and third bar from moving with respect to one another; and
wherein the hinge is movable in the vertical direction and the floorboard can move between a position substantially parallel to the backboard and a position substantially perpendicular to the backboard.

2. The device of claim 1, wherein the hinge is spring-loaded.

3. A portable exercise device, comprising:
a first horizontal bar with a first end and second end;
a first neck attached to the first end;
a second neck attached to the second end;
a first supporting structure for receiving the first neck, wherein the first neck is movable within the first supporting structure to alter the vertical height of the first horizontal bar;
a second supporting structure for receiving the second neck, wherein the second neck is movable within the second supporting structure to alter the vertical height of the first horizontal bar;
a second bar attached to the top of the first supporting structure and the top of the second supporting structure;
a third bar substantially parallel to the second bar and coupled to the first supporting structure and the second supporting structure;
a backboard attached to the second bar and third bar;
a floorboard attached to the backboard with a hinge;
a first leg attached to the first supporting structure; and
a second leg attached to the second supporting structure;
wherein the backboard prevents the second bar and the third bar from moving with respect to one another.

4. The device of claim 3, wherein the first neck is secured to the first supporting structure with a first collar mechanism, and the second neck is secured to the second supporting structure with a second collar mechanism.

5. The device of claim 3, wherein the first neck is attached to the first horizontal bar with a first joint and the second neck is attached to the first horizontal bar with a second joint.

6. The device of claim 3, wherein the first neck is slidably embedded in the first supporting structure and the second neck is slidably embedded in the second supporting structure.

7. The device of claim 3, further comprising: a first retractable wheel coupled to the first leg and a second retractable wheel coupled to the second leg.

8. The device of claim 3, wherein the first end of the horizontal bar is covered by the first neck and the second end of the horizontal bar is covered by the second neck.

9. A portable exercise device, comprising:

a first horizontal bar with a first end and second end;

a first neck attached to the first end;

a second neck attached to the second end;

a first supporting structure for receiving the first neck, wherein the first neck is movable within the first supporting structure to alter a vertical height of the first horizontal bar;

a second supporting structure for receiving the second neck, wherein the second neck is movable within the second supporting structure to alter the vertical height of the first horizontal bar;

one or more legs attached to the first supporting structure and configured to swing relative to the first supporting structure; and one or more legs attached to the second supporting structure and configured to swing relative to the second supporting structure;

wherein the one or more legs attached to the first supporting structure and the one or more legs attached to the second supporting structure each comprise an adjustable foot mechanism for supporting the leg on the floor, wherein each adjustable foot mechanism can expand or contract in a direction towards or away from the floor during operation of the device.

10. A portable exercise device, comprising:

a first horizontal bar with a first end and second end;

a first neck attached to the first end;

a second neck attached to the second end;

a first supporting structure for receiving the first neck, wherein the first neck is movable within the first supporting structure to alter a vertical height of the first horizontal bar;

a second supporting structure for receiving the second neck, wherein the second neck is movable within the second supporting structure to alter a vertical height of the first horizontal bar;

a second horizontal bar attached to the top of the first supporting structure and the top of the second supporting structure;

a third horizontal bar parallel to the second horizontal bar and the first horizontal bar;

a backboard attached to the second horizontal bar;

a floorboard attached to the backboard with a hinge;

a first leg attached to the first supporting structure; and a second leg attached to the second supporting structure;

wherein the floorboard comprises a first magnet that attracts the first leg with magnetic force when the first leg is folded inward, and a second magnet that attracts the second leg with magnetic force when the second leg is folded inward.

11. The device of claim 10, wherein the first magnet is embedded in a first bore in the floorboard and the second magnet is embedded in a second bore in the floorboard.

12. A portable exercise device, comprising:

a first horizontal bar with a first end and second end;

a first neck attached to the first end;

a second neck attached to the second end;

a first supporting structure for receiving the first neck, wherein the first neck is movable within the first-supporting structure to alter a vertical height of the first horizontal bar;

a second supporting structure for receiving the second neck, wherein the second neck is movable within the second-supporting structure to alter a vertical height of the first horizontal bar;

a second horizontal bar attached to the top of the first-supporting structure and the top of the second supporting structure;

a third horizontal bar parallel to the first horizontal bar and the second horizontal bar;

a backboard attached to the second horizontal bar;

a floorboard attached to the backboard with a hinge;

a first leg attached to the first supporting structure;

a second leg attached to the second supporting structure; and a mat comprising a pocket to receive the floorboard.

13. The device of claim 12, wherein the mat covers the backboard.

14. A portable exercise device, comprising:

a first horizontal bar with a first end and second end;

a first neck attached to the first end by a first clamping device comprising:

a first band wrapped around the first horizontal bar and secured by a first bolt; and a first screw embedded in the first horizontal bar through the first band;

a second neck attached to the second end by a second clamping device comprising:

a second band wrapped around the first horizontal bar and secured by a second bolt; and a second screw embedded in the first horizontal bar through the second band;

a first supporting structure for receiving the first neck, wherein the first neck is movable within the first-supporting structure to alter a vertical height of the first horizontal bar; and a second supporting structure for receiving the second neck, wherein the second neck is movable within the second supporting structure to alter a vertical height of the first horizontal bar.

15. A portable exercise device, comprising:

a first horizontal bar with a first end and second end;

a first neck attached to the first end;

a second neck attached to the second end;

a first supporting structure for receiving the first neck, wherein the first neck is movable within the first supporting structure to alter a vertical height of the first horizontal bar;

a second supporting structure for receiving the second neck, wherein the second neck is movable within the second supporting structure to alter the vertical height of the first horizontal bar;

a second horizontal bar attached to the top of the first supporting structure and the top of the second supporting structure;

a third horizontal bar parallel to the first horizontal bar and the second horizontal bar;

a backboard attached to the second horizontal bar;

a floorboard attached to the backboard with a hinge;

a first leg attached to the first supporting structure; and a second leg attached to the second supporting structure;

wherein the first leg comprises a hook and the second leg comprises a connector, wherein the hook can attach to the connector to hold the first leg and second leg in a folded position.

16. A portable exercise device, comprising:

a first horizontal bar with a first end and second end;

a first neck attached to the first end;

a second neck attached to the second end;

a first supporting structure for receiving the first neck, wherein the first neck is movable within the first supporting structure to alter a vertical height of the first horizontal bar;

a second supporting structure for receiving the second neck, wherein the second neck is movable within the second supporting structure to alter the vertical height of the first horizontal bar;

a first front member and a first back member attached to the first supporting structure; and a second front member and a second back member attached to the second supporting structure;

a second horizontal bar attached to the first supporting structure and second supporting structure;

a third horizontal bar attached to the first supporting structure and second supporting structure;

a backboard attached to the second horizontal bar and the third horizontal bar; and a floorboard attached to the backboard;

wherein the first front member and the first back member and the second front member and the second back member are removable to enable the device to be mounted on a wall.

17. The device of claim 16, wherein the first neck is slidably embedded in the first supporting structure and the second neck is slidably embedded in the second supporting structure.

18. A portable exercise device, comprising:

a first horizontal bar with a first end and second end;

a first neck attached to the first end;

a second neck attached to the second end;

a first supporting structure for receiving the first neck, wherein the first neck is movable within the first supporting structure to alter a vertical height of the first horizontal bar;

a second supporting structure for receiving the second neck, wherein the second neck is movable within the second supporting structure to alter the vertical height of the first horizontal bar;

a first front member and a first back member attached to the first supporting structure; and a second front member and a second back member attached to the second supporting structure; and a first constant force spring attached to the first supporting structure for exerting force against the first neck and a second constant force spring attached to the second supporting structure for exerting force against the second neck;

wherein the first front member and the first back member and the second front member and the second back member are removable to enable the device to be mounted on a wall; and wherein the first neck is slidably embedded in the first supporting structure and the second neck is slidably embedded in the second supporting structure.

19. A portable exercise device, comprising:

a first horizontal bar with a first end and second end;

a first neck attached to the first end;

a second neck attached to the second end;

a first supporting structure for receiving the first neck, wherein the first neck is movable within the first supporting structure to alter a vertical height of the first horizontal bar;

a second supporting structure for receiving the second neck, wherein the second neck is movable within the second supporting structure to alter the vertical height of the first horizontal bar;

a first front member attached to a first bracket attached to the first supporting structure and a first back member attached to a second bracket attached to the first supporting structure, the first bracket limiting a motion of the first front member and the second bracket limiting a motion of the first back member;

a second front member attached to a third bracket attached to the second supporting structure and a second back member attached to a fourth bracket attached to the second supporting structure, the third bracket limiting a motion of the second front member and the fourth bracket limiting a motion of the second back member;

a second horizontal bar attached to the first supporting structure and second supporting structure;

a third horizontal bar attached to the first supporting structure and second supporting structure;

a backboard, wherein a top portion of the backboard is attached to the second horizontal bar and a bottom portion of the backboard is attached to the third horizontal bar; and a floorboard attached to the backboard.

20. The device of claim 19, wherein the first front member is attached to the first bracket by a first pin, the first back member is attached to the second bracket by a second pin, the second front member is attached to the third bracket by a third pin, and the second back member is attached to the fourth bracket by a fourth pin.

21. The device of claim 19, wherein a distance between a bottom of the first supporting structure and the floor is at least 1.80 inches and a distance between a bottom of the second supporting structure and the floor is at least 1.80 inches.

* * * * *